US009254694B2

(12) United States Patent
Tanjo et al.

(10) Patent No.: US 9,254,694 B2
(45) Date of Patent: Feb. 9, 2016

(54) RECORDING APPARATUS

(71) Applicant: SEIKO EPSON CORPORATION, Tokyo (JP)

(72) Inventors: Toru Tanjo, Shiojiri (JP); Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/666,982

(22) Filed: Mar. 24, 2015

(65) Prior Publication Data

US 2015/0273891 A1 Oct. 1, 2015

(30) Foreign Application Priority Data

Mar. 27, 2014 (JP) ..... 2014-065429
Nov. 25, 2014 (JP) ..... 2014-238088

(51) Int. Cl.

| | |
|---|---|
| ***B41J 2/01*** | (2006.01) |
| ***B41J 11/04*** | (2006.01) |
| ***B41J 3/60*** | (2006.01) |
| ***B41J 29/13*** | (2006.01) |
| ***B41J 11/00*** | (2006.01) |

(52) U.S. Cl.

CPC .. *B41J 11/04* (2013.01); *B41J 3/60* (2013.01); *B41J 11/006* (2013.01); *B41J 29/13* (2013.01)

(58) Field of Classification Search

CPC ..... B41J 11/006; B41J 3/60; B41J 13/009; B41J 13/25

See application file for complete search history.

(56) References Cited

U.S. PATENT DOCUMENTS

| | | | | |
|---|---|---|---|---|
| 5,598,257 | A * | 1/1997 | Keller et al. | 399/364 |
| 7,587,166 | B2 * | 9/2009 | Aono | 399/401 |
| 7,967,290 | B2 * | 6/2011 | Yasui et al. | 271/301 |
| 8,684,487 | B2 | 4/2014 | Imoto | |
| 8,708,482 | B2 | 4/2014 | Yamamoto | |
| 2006/0072138 | A1 | 4/2006 | Nakanishi et al. | |
| 2013/0027490 | A1 * | 1/2013 | Sugimoto et al. | 347/104 |
| 2013/0300054 | A1 * | 11/2013 | Ishii | 271/225 |

(Continued)

FOREIGN PATENT DOCUMENTS

| | | |
|---|---|---|
| JP | 2002-274727 | 9/2002 |
| JP | 2008-214020 | 9/2008 |

(Continued)

OTHER PUBLICATIONS

European Search Report for Application No. 15160496.4 dated Aug. 26, 2015.

*Primary Examiner* — Shelby Fidler
*Assistant Examiner* — Tracey McMillion
(74) *Attorney, Agent, or Firm* — Workman Nydegger

(57) ABSTRACT

A recording apparatus includes: a first transporting path which is a transporting path that transports a medium, passes along a recording portion that performs recording on the medium, and extends to an upstream side and a downstream side of the recording portion; a second transporting path which is a transporting path that is connected to the first transporting path, and switches back and transports the medium in a direction reverse to a feeding direction after the medium which passes along the recording portion is fed; and a third transporting path which is a transporting path that is connected to the second transporting path, makes the medium transported in the reverse direction detour an upper side of the recording portion, reverses the medium, and makes the medium merge at a position on the upstream side of the recording portion in the first transporting path.

14 Claims, 32 Drawing Sheets

(56) References Cited

U.S. PATENT DOCUMENTS

| | | | |
|---|---|---|---|
| 2014/0064814 | A1 | 3/2014 | Sato |
| 2014/0267494 | A1 | 9/2014 | Yamamoto |

FOREIGN PATENT DOCUMENTS

| | | |
|---|---|---|
| JP | 2010-253754 | 11/2010 |
| JP | 2013-136242 | 7/2013 |

* cited by examiner

RECORDING APPARATUS

BACKGROUND

1. Technical Field

The present invention relates to a recording apparatus which performs recording on a medium.

2. Related Art

In a recording apparatus which is represented by a facsimile or a printer, particularly in a recording apparatus which can perform recording on both surfaces of a medium, a medium transporting path for reversing the medium is necessary. There are various types of medium transporting paths for reversing the medium, and for example, there is a case where a configuration in which a reversing path for bending and reversing the medium and a path for switching back the medium are combined is employed.

If the medium transporting path is complicated in this manner, when a paper jam occurs in the medium transporting path, an operation for removing the jammed paper becomes a problem. In JP-A-2002-274727, a configuration in which a part of a paper transporting path is opened by opening a manual feeding paper supplying stand is disclosed. In addition, in JP-A-2008-214020, a configuration in which a part of a paper transporting path is opened by opening a manual feeding tray is disclosed. Furthermore, in JP-A-2010-253754, a configuration in which a part of a paper transporting path is opened by detaching a bending and reversing unit is disclosed.

In addition, as one type of the recording apparatus, an ink jet type printer, which performs printing (recording) by ejecting ink with respect to the medium, such as a paper sheet, from a line head (recording portion) which has a fixed type head, is known (for example, refer to JP-A-2013-136242). In the printer, an apparatus casing, in which an upper casing provided with a paper discharging portion on an upper surface thereof can rotationally move around an axial line that extends in a horizontal direction with respect to a lower casing, is provided.

In other words, the upper casing is configured to be rotationally movable between a proximity position which is proximate to the lower casing and a separation position which is separated from the lower casing. Since a line type head is loaded on the upper casing, the printer can perform maintenance of the head by accessing the head of the upper casing from an opening on a front side which is formed when the upper casing rotationally moves to the separation position.

On an apparatus layout, when the reversing path for reversing the medium is formed to go around a recording head, the recording head becomes an obstacle when jam processing is performed, and particularly, it is not possible to move the recording head for a jam processing operation when the recording head is provided to be fixed, and it is difficult to perform the jam processing operation. However, in a configuration in which the recording head which is provided to be fixed is movable, a size of the apparatus becomes large, and the positional accuracy of the recording head deteriorates.

In addition, in the above-described printer, a head is attached to the upper casing. In other words, the head is provided in the upper casing which is different from the lower casing having the transported medium on which printing is performed by the head. For this reason, it is necessary to ensure accuracy of a hinge with respect to the lower casing in the upper casing, which is supposed to ensure the printing accuracy. However, since it is difficult to ensure the accuracy of the hinge, in some cases, there is a problem that the positional accuracy of the head cannot be ensured.

SUMMARY

An advantage of some aspects of the invention is to more easily perform a jam processing operation in a recording apparatus provided with a reversing path which reverses a medium and a path for switching back the medium. In addition, the invention is to provide a recording apparatus which can easily perform a maintenance operation of a recording portion while ensuring the positional accuracy of the recording portion.

Application Example 1

According to this application example, there is provided a recording apparatus, including: a first transporting path which is a transporting path that transports a medium, passes along a recording portion that performs recording on the medium, and extends to an upstream side and a downstream side of the recording portion; a second transporting path which is a transporting path that is connected to the first transporting path, and switches back and transports the medium in a direction reverse to a feeding direction after the medium which passes along the recording portion is fed; a third transporting path which is a transporting path that is connected to the second transporting path, makes the medium transported in the reverse direction detour an upper side of the recording portion, reverses the medium, and makes the medium merge at a position on the upstream side of the recording portion in the first transporting path; and an upper member which is a path forming member that forms an upper section of the recording portion in the third transporting path, is positioned on an upper side of the upper section, and can open the upper section.

In this case, in the third transporting path, that is, in a path which makes the medium detour the upper side of the recording portion, reverses the medium, and makes the medium merge at the position on the upstream side of the recording portion in the first transporting path, since the upper section of the recording portion is formed of the upper member which can open the upper section, by opening the upper member, without moving the recording portion, and without making the recording portion an obstacle, it is possible to easily perform the jam processing operation for removing the jammed medium in the upper section.

Application Example 2

In the recording apparatus according to the application example, the upper section may be provided with a roller pair which nips and transports the medium. As one roller which constitutes the roller pair is provided in the upper member and the upper member is opened, the one roller which constitutes the roller pair may be separated from the other roller.

In this case, as the upper section is provided with the roller pair which nips and transports the medium, one roller which constitutes the roller pair is provided in the upper member, and the upper member is opened, since the one roller which constitutes the roller pair is separated from the other roller, a nipped state of the medium by the roller pair is released, and thus, it is possible to more easily remove the jammed medium.

Application Example 3

In the recording apparatus according to the application example, the one roller provided in the upper member may be a roller which can rotate in a driven manner, and the other roller may be a roller which is rotationally driven by a driving source.

In this case, since the one roller provided in the upper member is the roller which can rotate in a driven manner, it is not necessary to provide a power transmission mechanism in the upper member, and it is possible to avoid an increase in weight of the upper member, and to easily open and close the upper member with a low amount of force.

Application Example 4

In the recording apparatus according to the application example, the one roller provided in the upper member may be a serrated roller which has a plurality of teeth on an outer circumference, and the serrated roller may be in contact with the one surface on which recording is already performed on the medium.

In this case, since the one roller provided in the upper member is the serrated roller which has the plurality of teeth on the outer circumference, and the serrated roller is in contact with the one surface on which recording is already performed on the medium, it is possible to suppress transfer omission or white spots on a recording surface.

Application Example 5

In the recording apparatus according to the application example, a medium receiving tray which is positioned above the upper section and receives the discharged medium and a fourth transporting path which is a transporting path that is connected to the first transporting path and transports the medium that passes along the recording portion together with the medium receiving tray, may be further provided. The medium receiving tray may be configured to be integrated with the upper member, and may be able to be opened and closed.

In this case, since the medium receiving tray is formed to be integrated with the upper member, and can be opened and closed, as the medium receiving tray in which an opening/closing region is ensured to be large and the upper member are configured to be integrated, it is possible to more easily perform the jam processing operation in a state where the upper member is opened.

Application Example 6

In the recording apparatus according to the application example, the medium receiving tray may have an upwardly inclined posture toward a side far from an outlet of the fourth transporting path in a closed state. The medium receiving tray may be able to be opened and closed by rotational movement, and a rotational movement fulcrum thereof is positioned on an upstream side of the medium receiving tray during the rotational movement.

In this case, since the medium receiving tray has the upwardly inclined posture toward the side far from the outlet of the fourth transporting path in the closed state, can be opened and closed by the rotational movement, and the rotational movement fulcrum thereof is positioned on the upstream side of the medium receiving tray during the rotational movement, it is possible to ensure a large range of rotational movement of the medium receiving tray and the upper member, and to more easily perform the jam processing operation by opening the upper member.

Application Example 7

In the recording apparatus according to the application example, an accommodation unit which accommodates the recording portion and a discharging portion which discharges the medium on which recording is performed by the recording portion, may be further provided. The recording portion may include a fixed type head which performs recording on the transported medium. The upper member may receive and support the medium which is discharged by the discharging member, and be provided to be able to be opened and closed with respect to the accommodation unit. As the upper member performs an opening operation, an access path which makes it possible to access the recording portion from above may be formed.

In this case, as the upper member performs the opening operation, the access path which makes it possible to access the recording portion from above is formed. In addition, even when the upper member performs the opening operation, the recording portion does not move. Therefore, it is possible to easily perform the maintenance operation of the recording portion while ensuring the positional accuracy of the recording portion.

Application Example 8

In the recording apparatus according to the application example, the upper member may be configured to be able to be opened until a part which is overlapped with the recording portion when viewed from above becomes smaller than that when the upper member is in a closed state.

In this case, it is possible to easily access the recording portion from above.

Application Example 9

In the recording apparatus according to the application example, the accommodation unit which accommodates the recording portion, the discharging portion which discharges the medium on which recording is performed by the recording portion, and a reversing path forming member which is disposed between the upper member and the recording portion and forms a reversing path that reverses the medium, may be further provided. The recording portion may include the fixed type head which performs recording on the transported medium. The upper member may receive and support the medium which is discharged by the discharging member, and be provided to be able to be opened and closed with respect to the accommodation unit. As the reversing path forming member performs an opening operation in a state where the upper member is opened, an access path which makes it possible to access the recording portion from above may be formed.

In this case, as the reversing path forming member performs the opening operation in a state where the upper member is opened, the access path which makes it possible to access the recording portion from above may be formed. In addition, even when the upper member and the reversing path forming member perform the opening operation, the recording portion does not move. Therefore, it is possible to easily perform the maintenance operation of the recording portion while ensuring the positional accuracy of the recording portion.

Application Example 10

In the recording apparatus according to the application example, the reversing path forming member may be inclined so that a height thereof increases towards a discharging direction in which the medium is discharged, and an opening/closing fulcrum when the reversing path forming member performs the opening/closing operation may be positioned on an upstream side of the discharging direction.

In this case, it is possible to easily open the reversing path forming member.

Application Example 11

In the recording apparatus according to the application example, the reversing path forming member may be configured to be attachable to and detachable from the accommodation unit.

In this case, by detaching the reversing path forming member from the accommodation unit, it is possible to more easily access the recording portion from above.

Application Example 12

In the recording apparatus according to the application example, the upper member may be inclined so that the height thereof increases towards the discharging direction in which the medium is discharged, and an opening/closing fulcrum when the upper member performs the opening/closing operation may be positioned on the upstream side of the discharging direction.

In this case, it is possible to easily open the upper member.

Application Example 13

In the recording apparatus according to the application example, the upper member may be configured to be attachable to and detachable from the accommodation unit.

In this case, by detaching the upper member from the accommodation unit, it is possible to more easily access the recording portion from above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
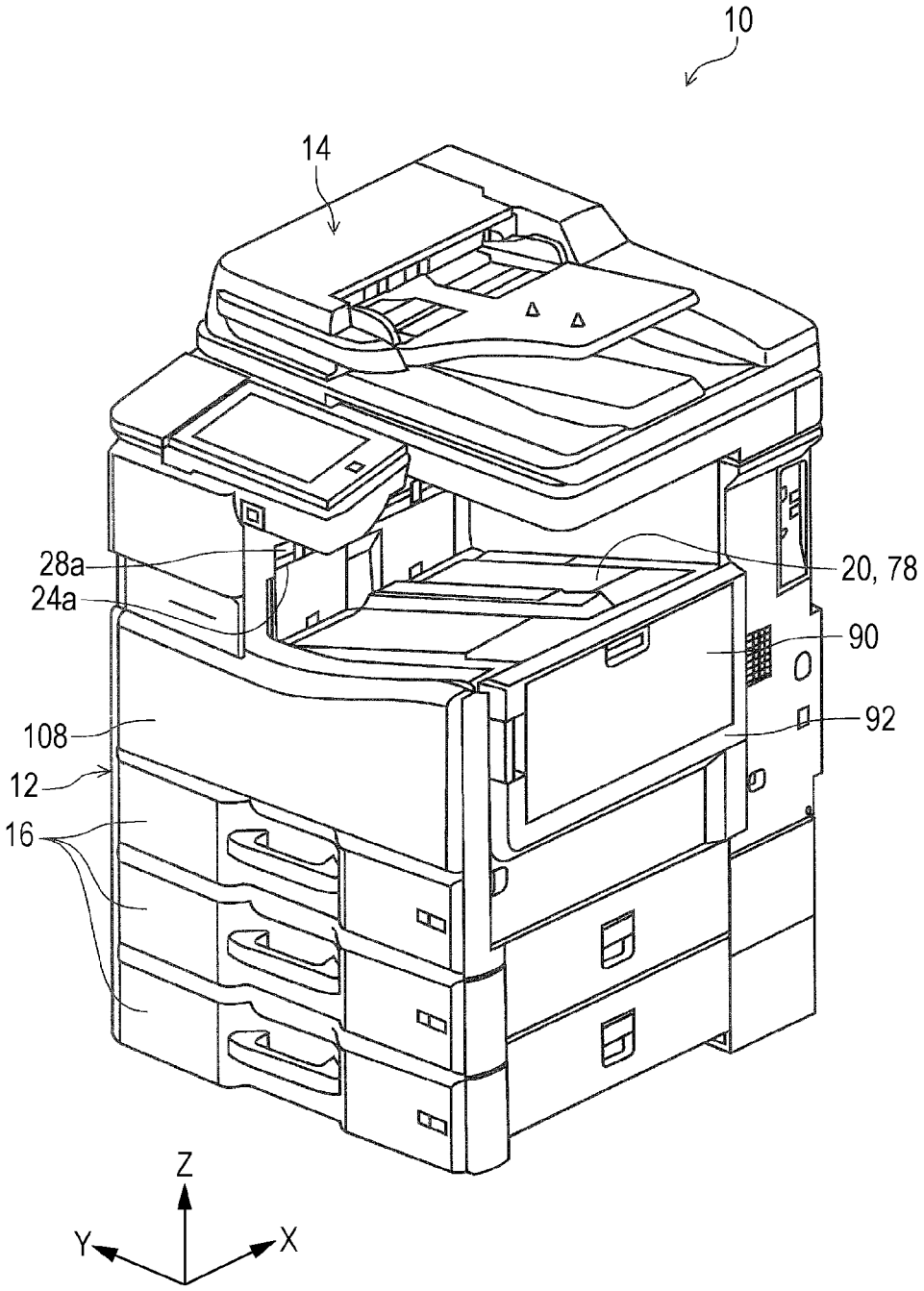
FIG. 1 is a perspective view of an external appearance of a recording apparatus.

Hereinafter, embodiments of the invention will be described with reference to the drawings. The same configuration elements in each embodiment are given the same reference numerals, and only the first embodiment will be described, and the description about the configuration elements in the following embodiments will be omitted.

Figure 2:
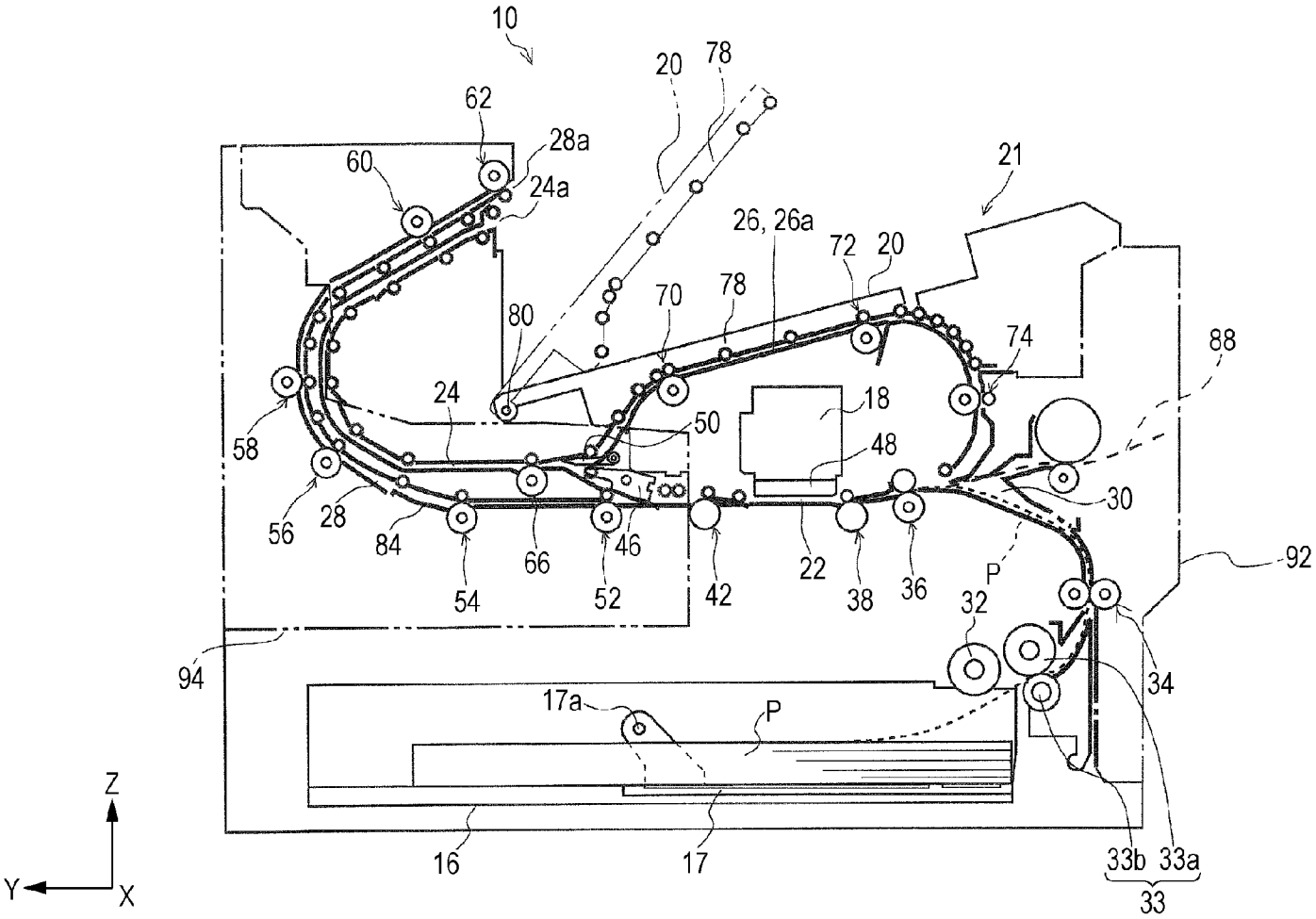
FIG. 2 is a view illustrating a medium transporting path in the recording apparatus.
Figure 3:
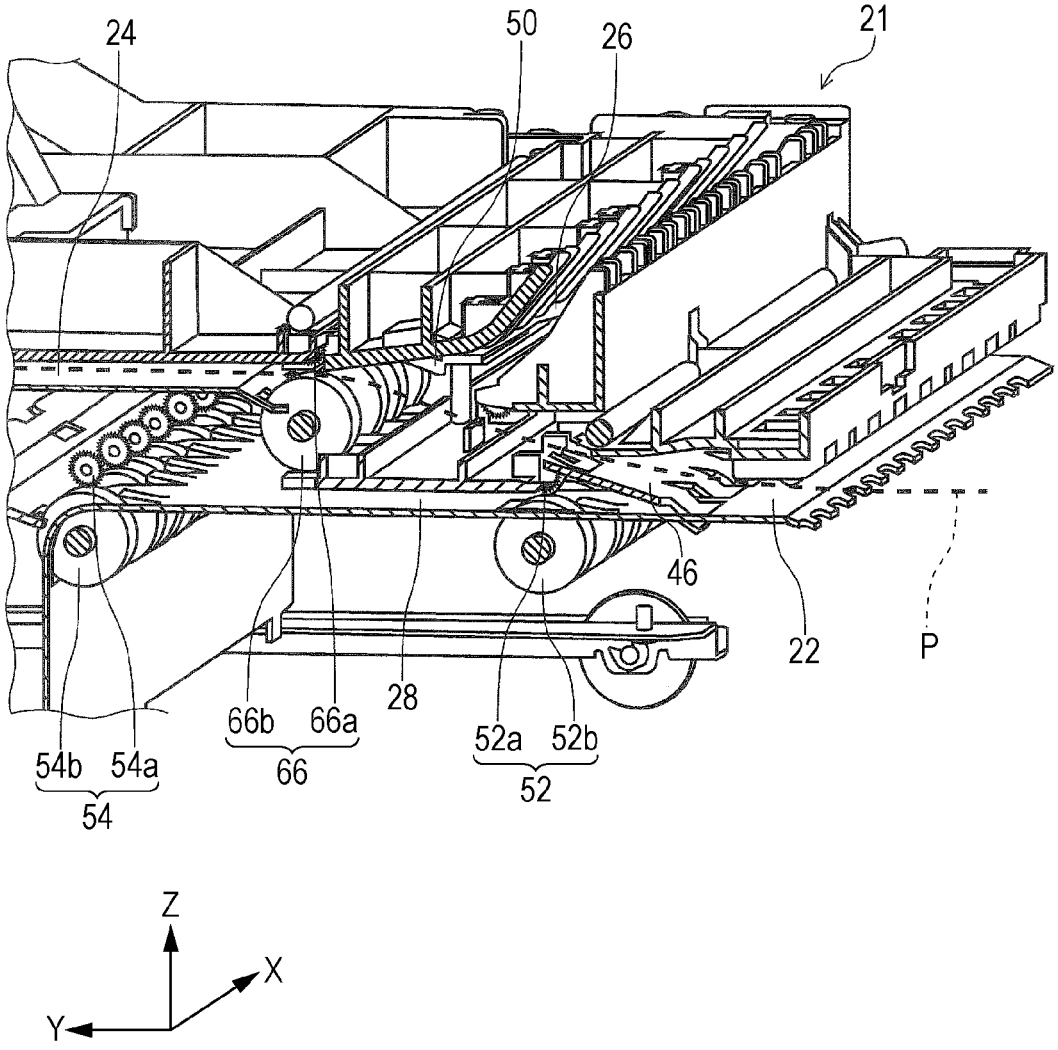
FIG. 3 is a perspective view illustrating a state of a flap which connects a first transporting path and a second transporting path when a medium is transported from the first transporting path to the second transporting path.
Figure 4:
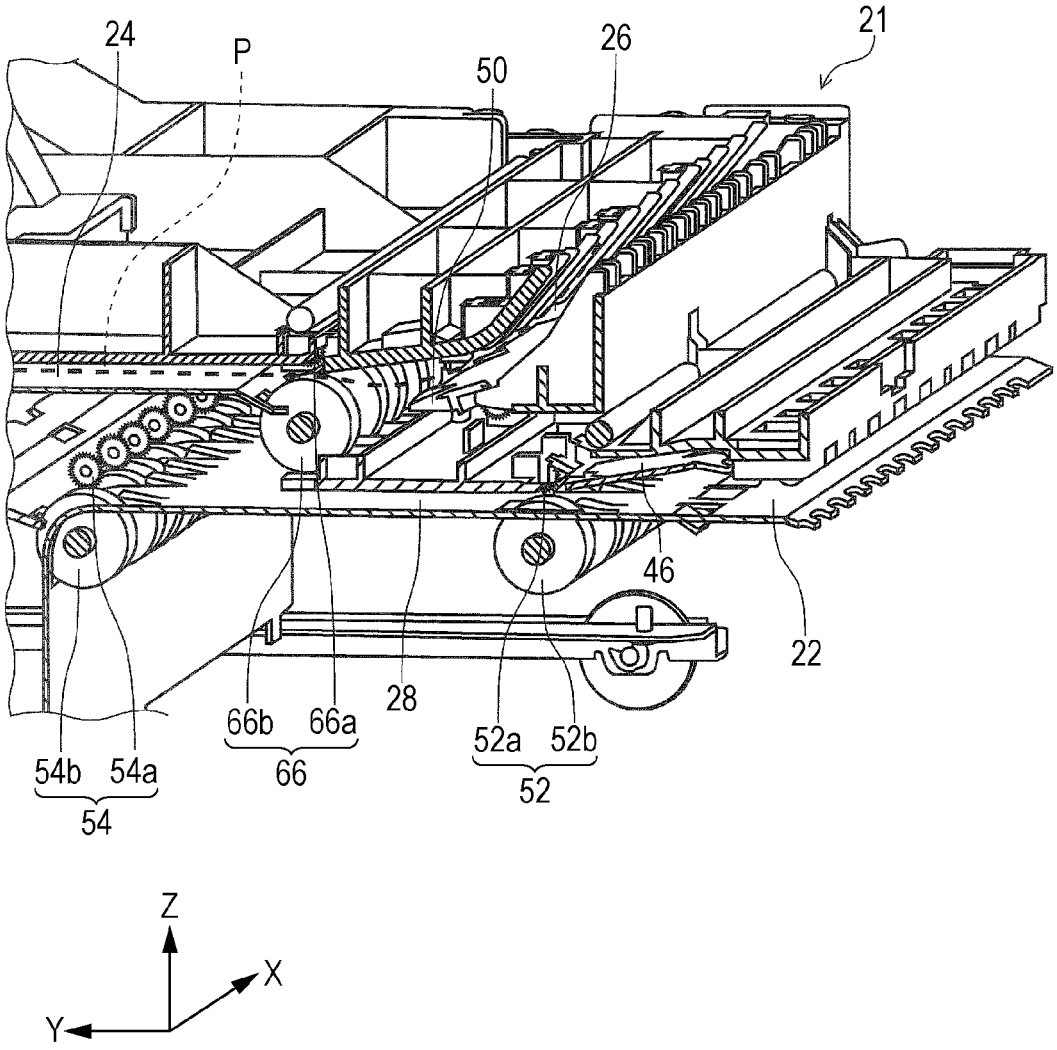
FIG. 4 is a perspective view illustrating a state of a flap which connects the second transporting path and a third transporting path when the medium is transported from the second transporting path to the third transporting path.
Figure 5:
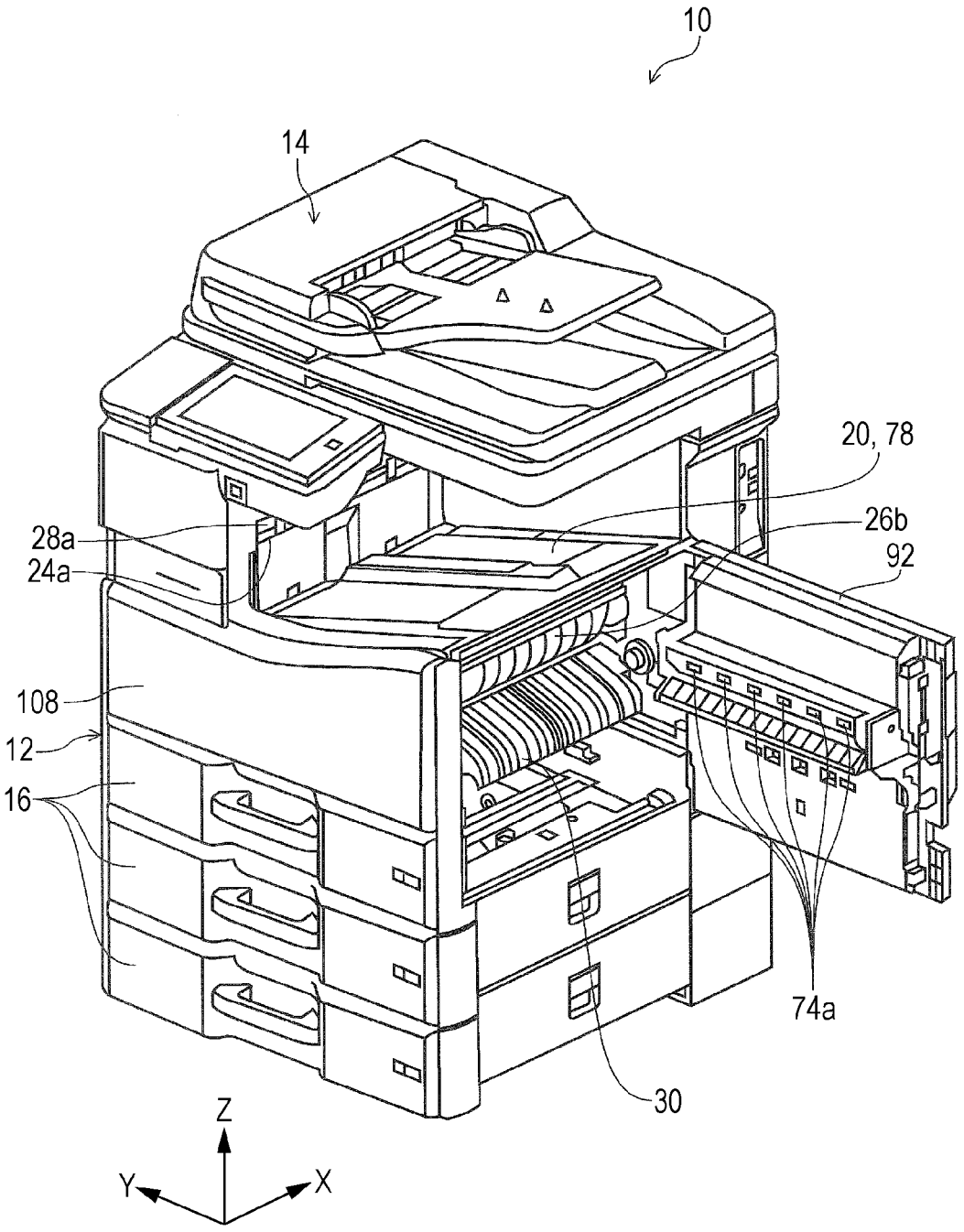
FIG. 5 is a perspective view in a state where an opening/closing body which constitutes a part of a transporting path is opened with respect to an apparatus main body in the recording apparatus.

FIG. 1 is a perspective view of an external appearance of a printer according to the invention. FIG. 2 is a view illustrating a medium transporting path in the printer according to the invention. FIG. 3 is a perspective view illustrating a state of a flap which connects a first transporting path and a second transporting path when a medium is transported from the first transporting path to the second transporting path. FIG. 4 is a perspective view illustrating a state of a flap which connects the second transporting path and a third transporting path when the medium is transported from the second transporting path to the third transporting path. FIG. 5 is a perspective view in a state where an opening/closing body which constitutes a part of a transporting path is opened with respect to an apparatus main body in the printer according to the invention.

Figure 6:
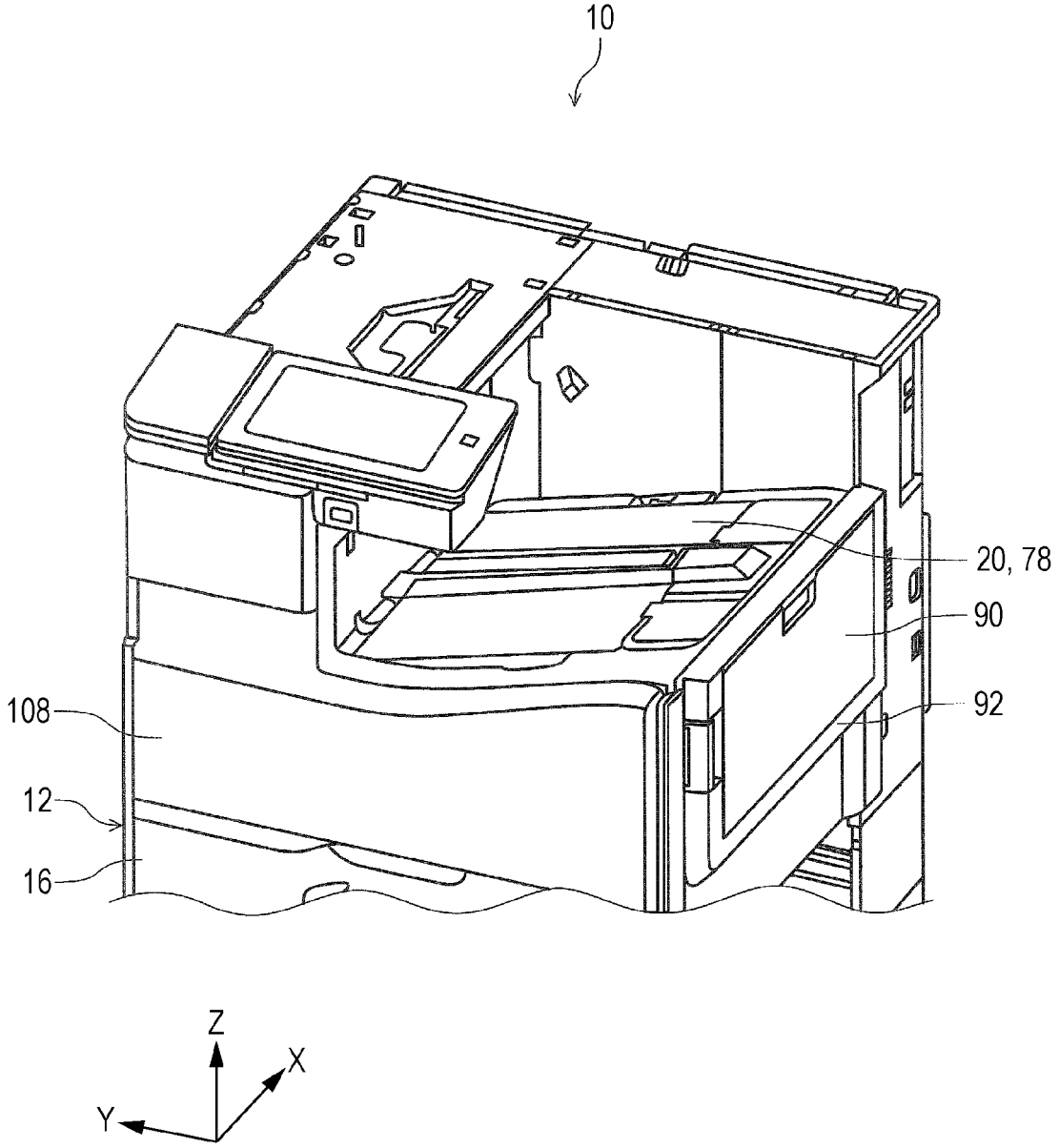
FIG. 6 is a perspective view illustrating a medium receiving tray in the recording apparatus.
Figure 7:
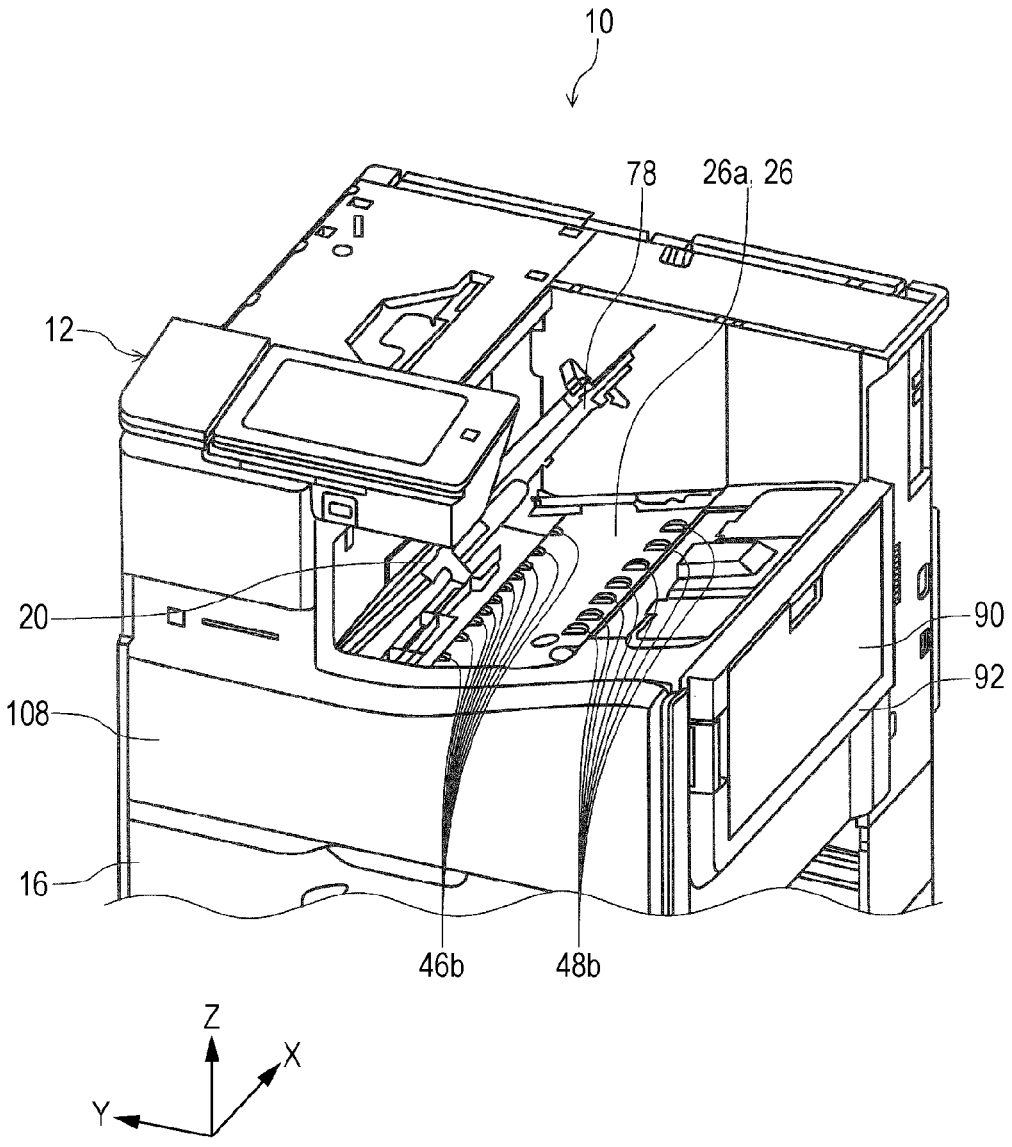
FIG. 7 is a perspective view of a state where the medium receiving tray is opened with respect to the apparatus main body.
Figure 8:
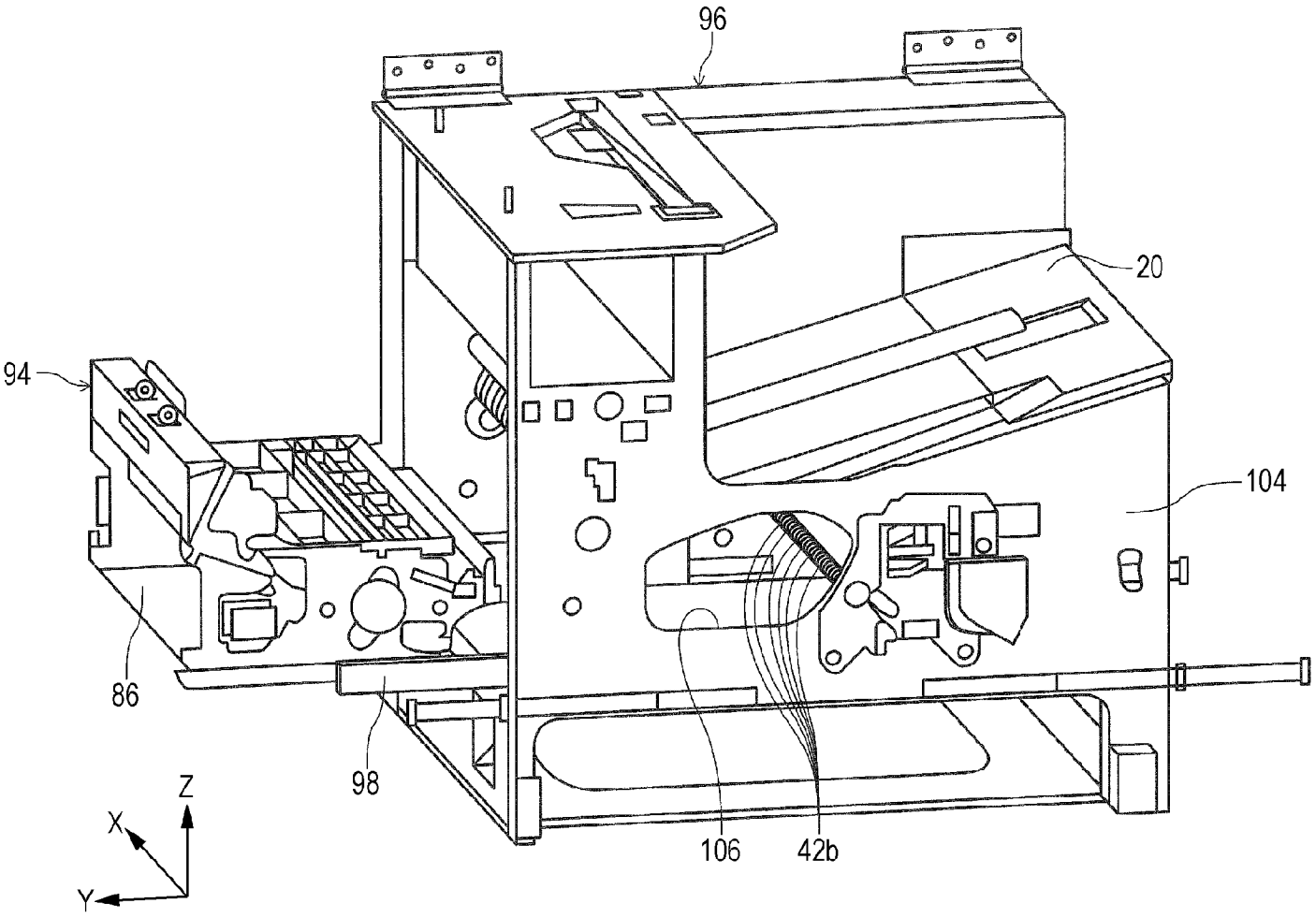
FIG. 8 is a perspective view illustrating a state where a unit body is drawn out in the apparatus main body.
Figure 9:
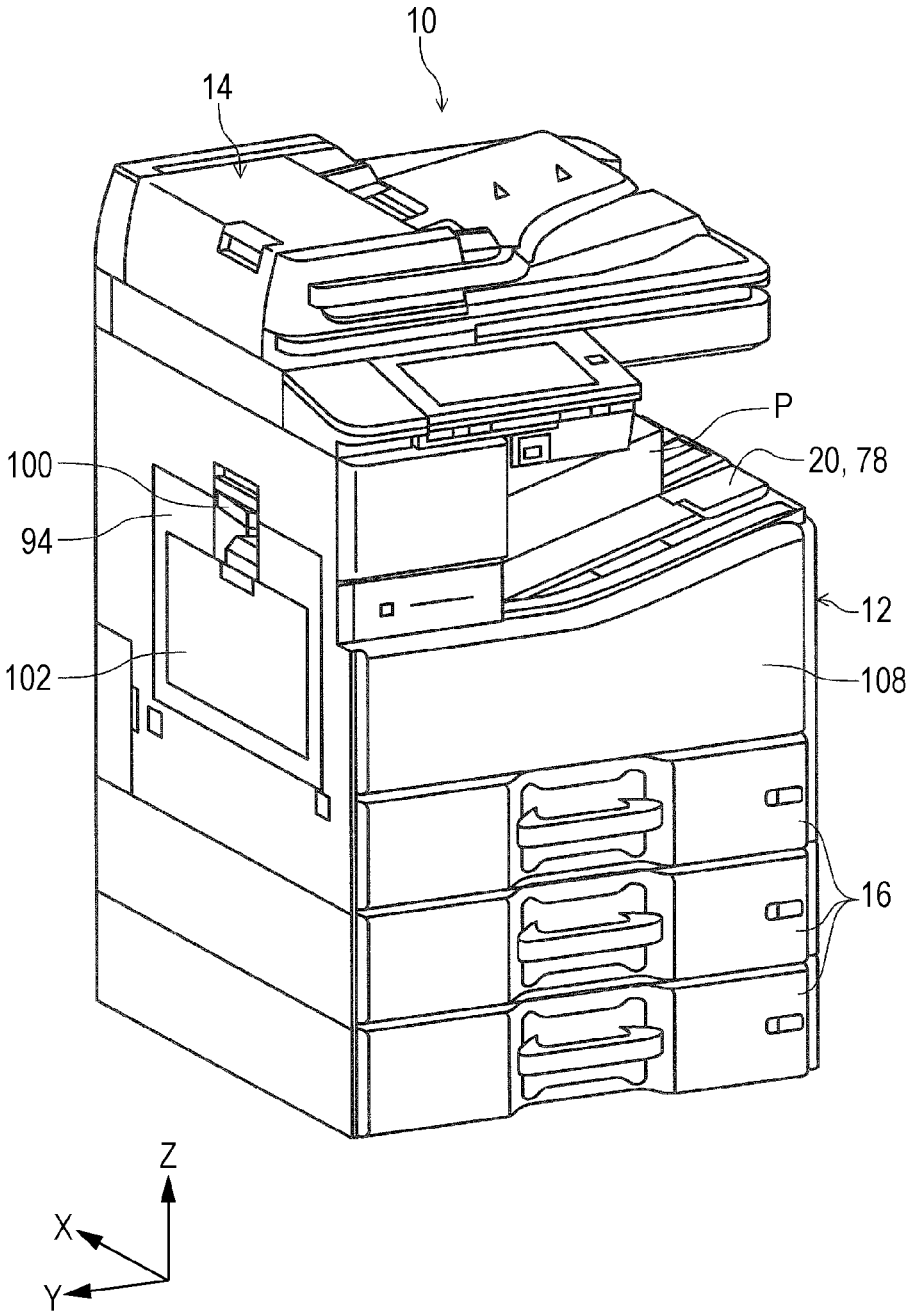
FIG. 9 is a perspective view of the recording apparatus.
Figure 10:
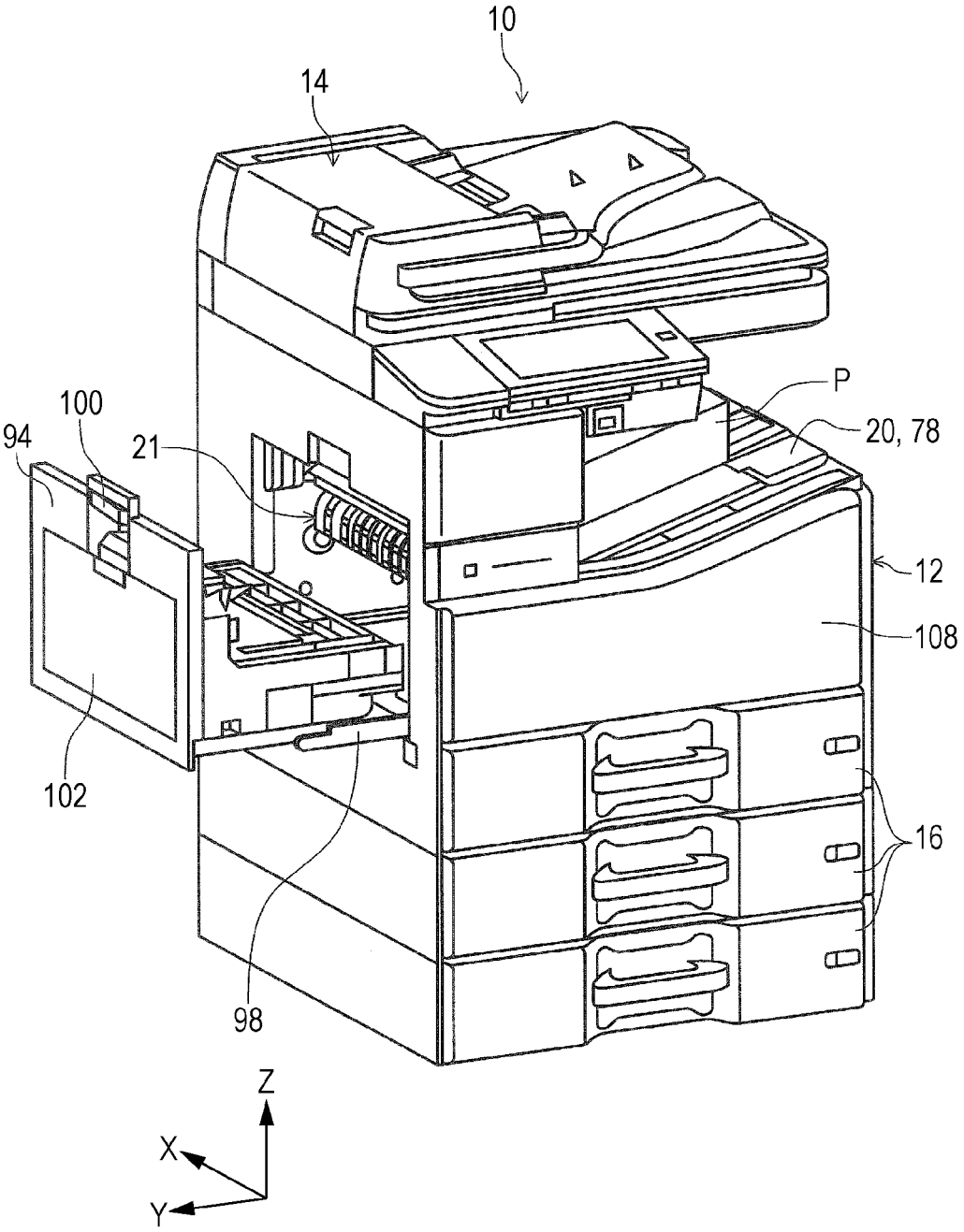
FIG. 10 is a perspective view illustrating a state where a unit which constitutes a part of the medium transporting path is drawn out from the apparatus main body.

FIG. 6 is a perspective view illustrating a medium receiving tray in the printer according to the invention. FIG. 7 is a perspective view of a state where the medium receiving tray is opened with respect to the apparatus main body. FIG. 8 is a perspective view illustrating a state where a unit body is drawn out in the apparatus main body. FIG. 9 is a perspective view of the printer according to the invention. FIG. 10 is a perspective view illustrating a state where a unit which constitutes a part of the medium transporting path is drawn out from the apparatus main body.

Figure 11:
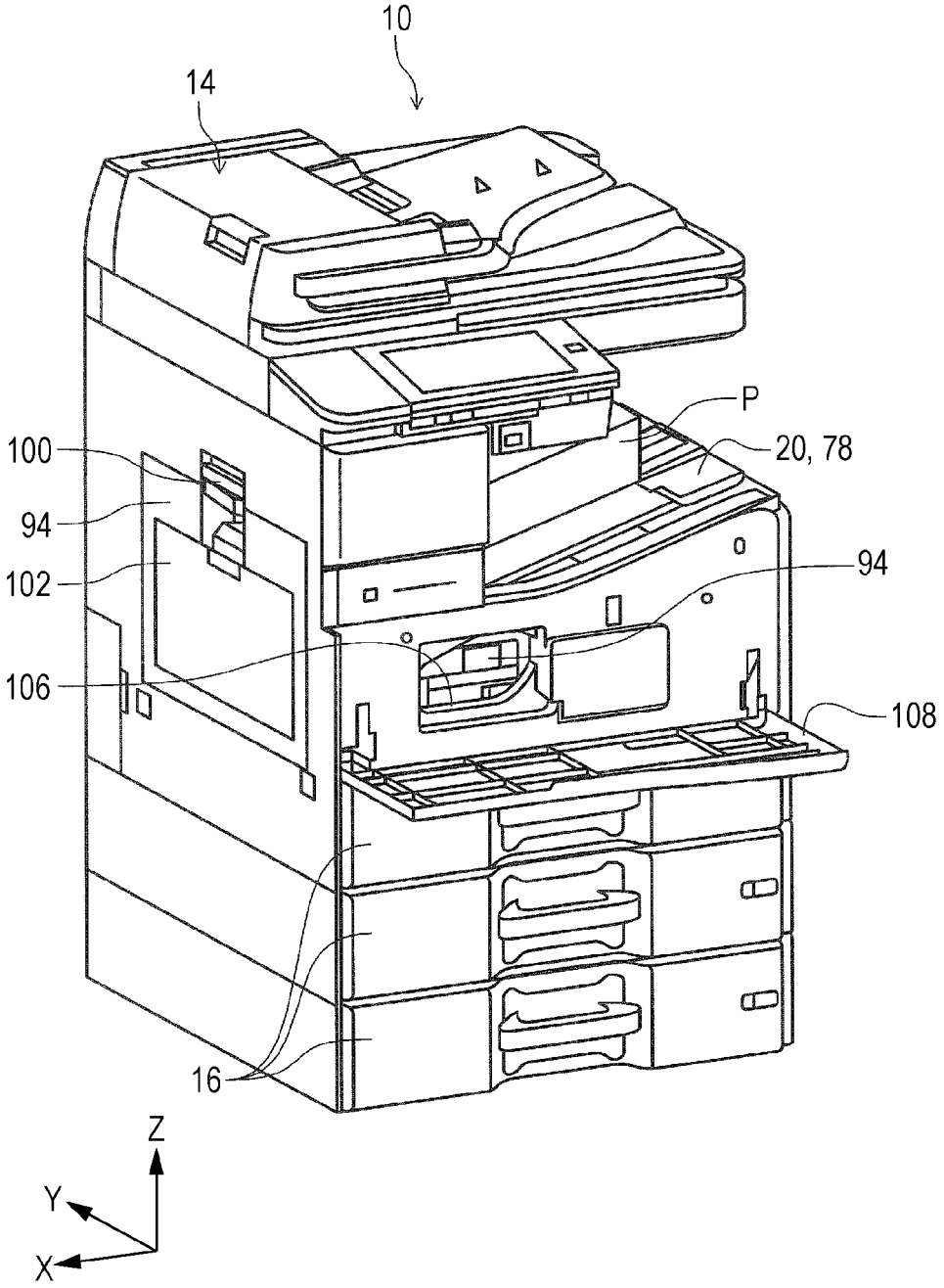
FIG. 11 is a perspective view illustrating a state where a cover on a front side of the recording apparatus is opened.
Figure 12:
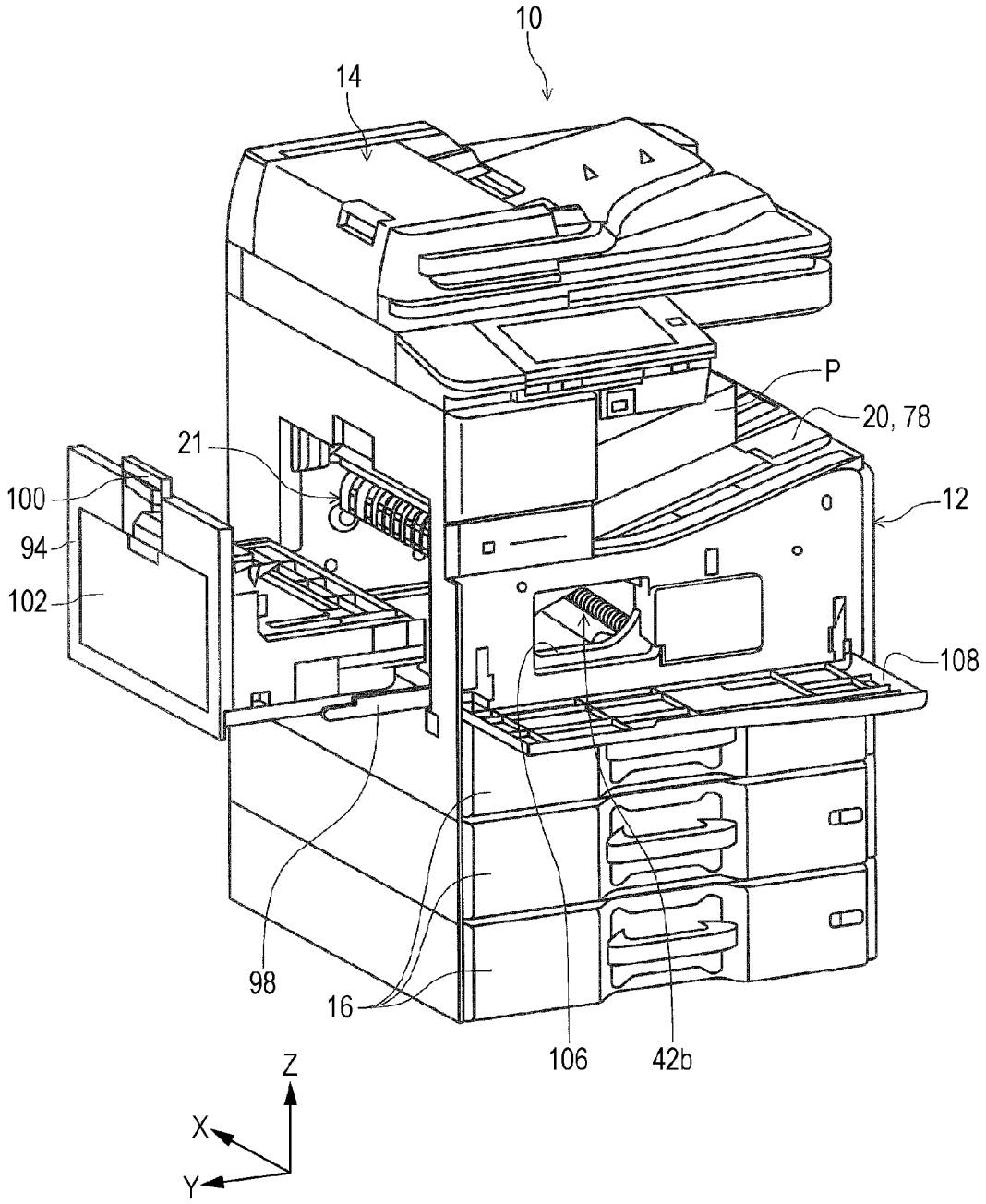
FIG. 12 is a perspective view illustrating a state where the cover on the front side of the recording apparatus is opened, the unit is drawn out from the apparatus main body, and a transporting roller pair can be accessed from an opening.
Figure 13:
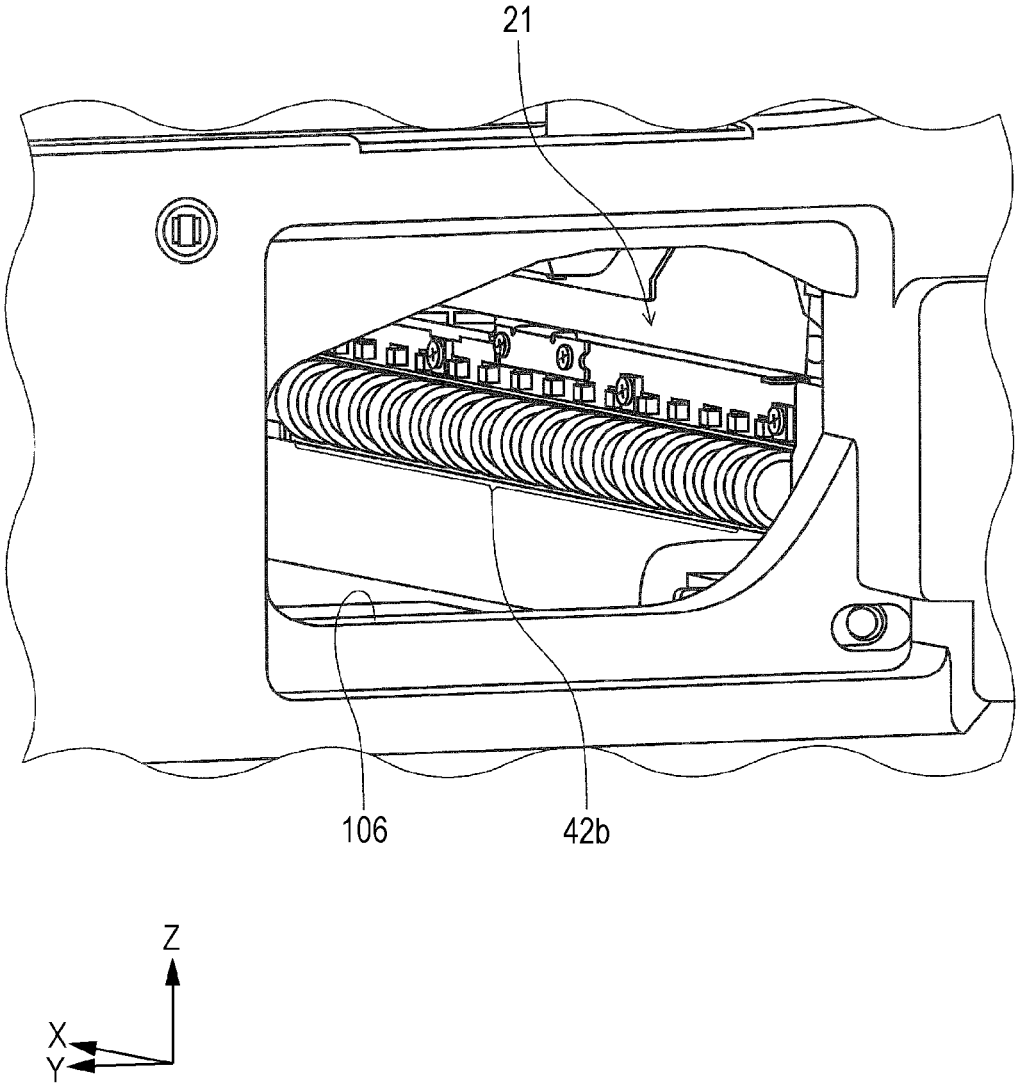
FIG. 13 is a perspective view when the transporting roller pair which can be accessed from an opening portion is viewed.
Figure 14:
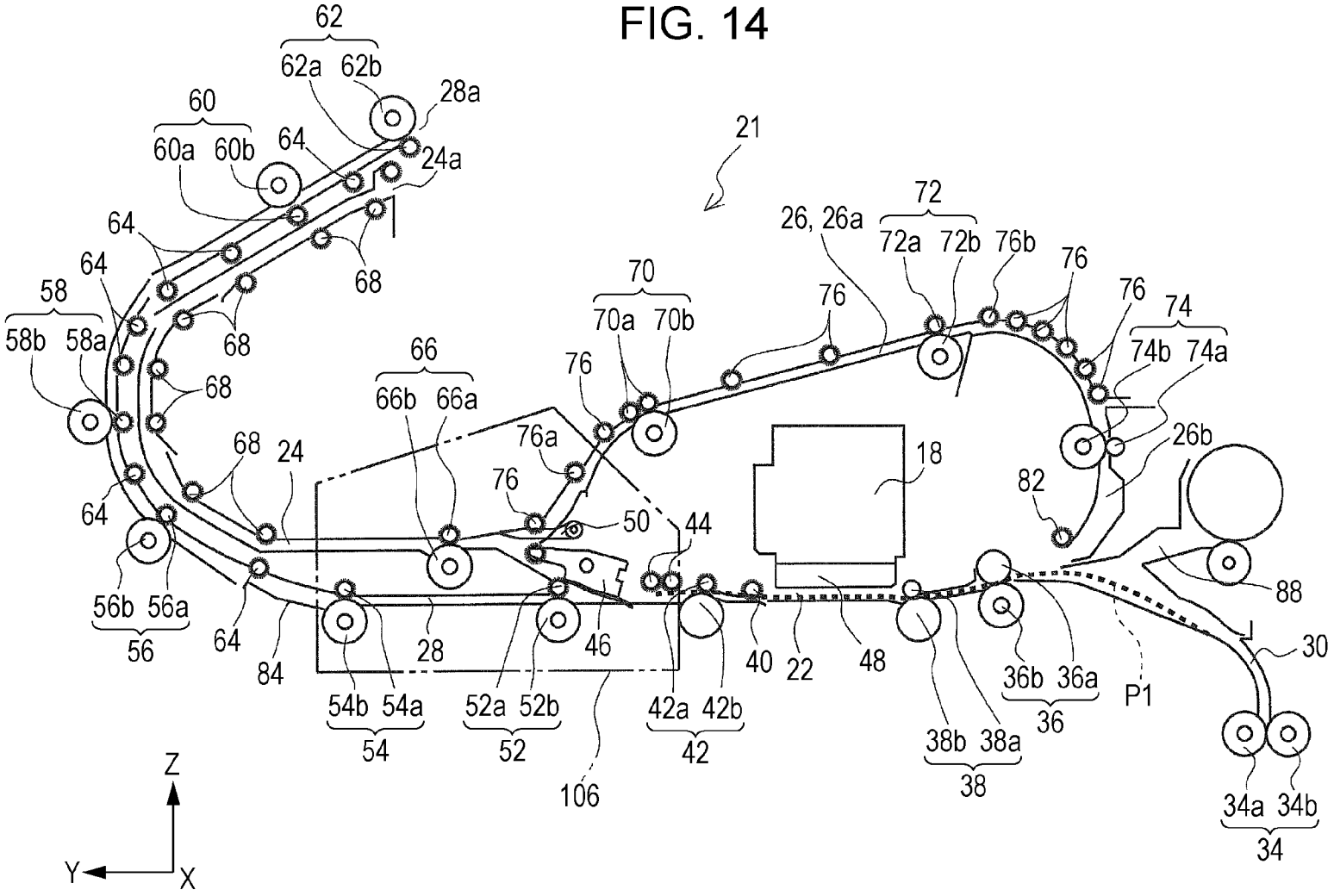
FIG. 14 is a view illustrating a first state of the medium which is transported in the medium transporting path.
Figure 15:
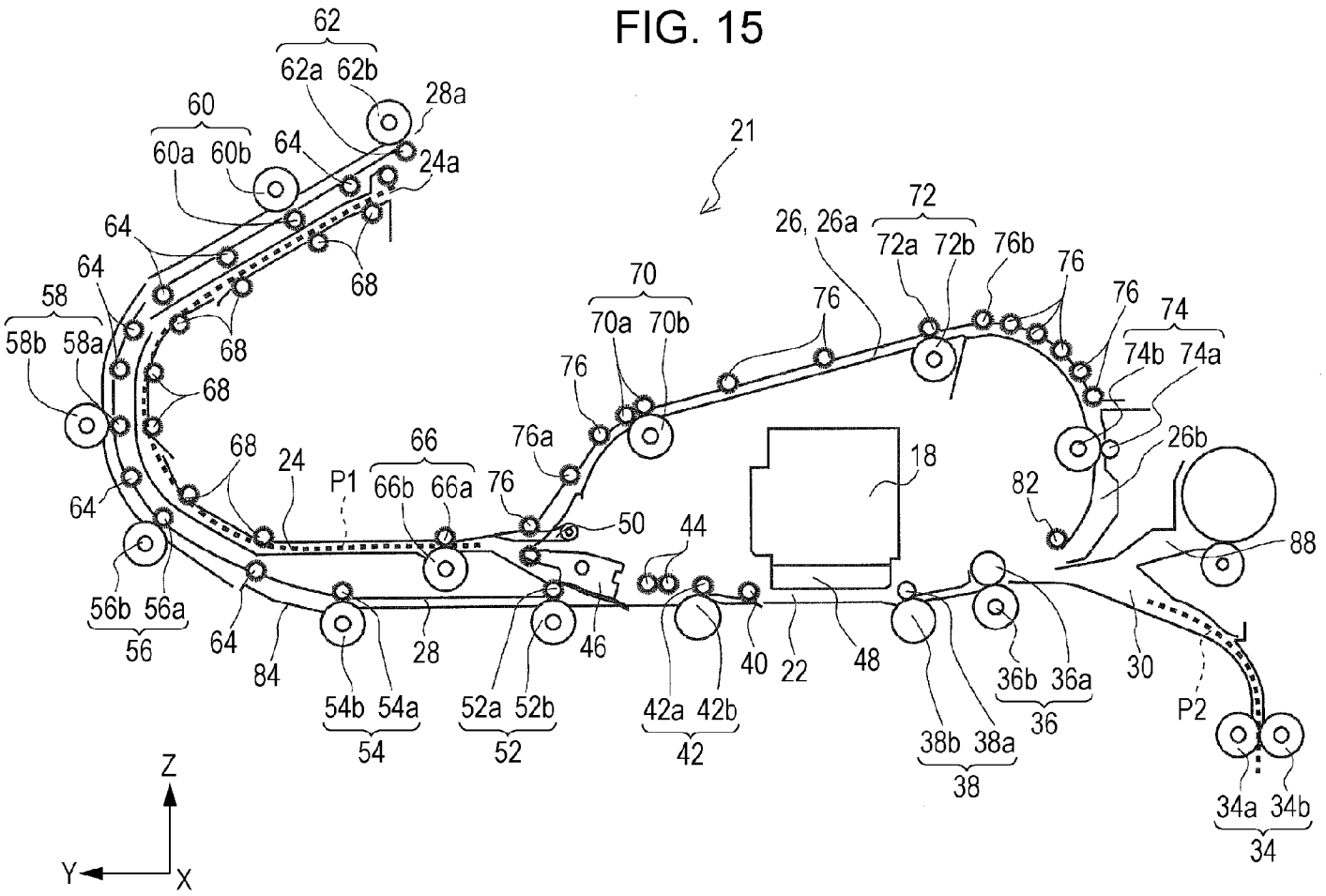
FIG. 15 is a view illustrating a second state of the medium which is transported in the medium transporting path.

FIG. 11 is a perspective view illustrating a state where a cover on a front side of the printer is opened. FIG. 12 is a perspective view illustrating a state where the cover on the front side of the recording apparatus is opened, the unit is drawn out from the apparatus main body, and a transporting roller pair can be accessed from an opening. FIG. 13 is a perspective view when the transporting roller pair which can be accessed from an opening portion is viewed. FIG. 14 is a view illustrating a first state of the medium which is transported in the medium transporting path. FIG. 15 is a view illustrating a second state of the medium which is transported in the medium transporting path.

Figure 16:
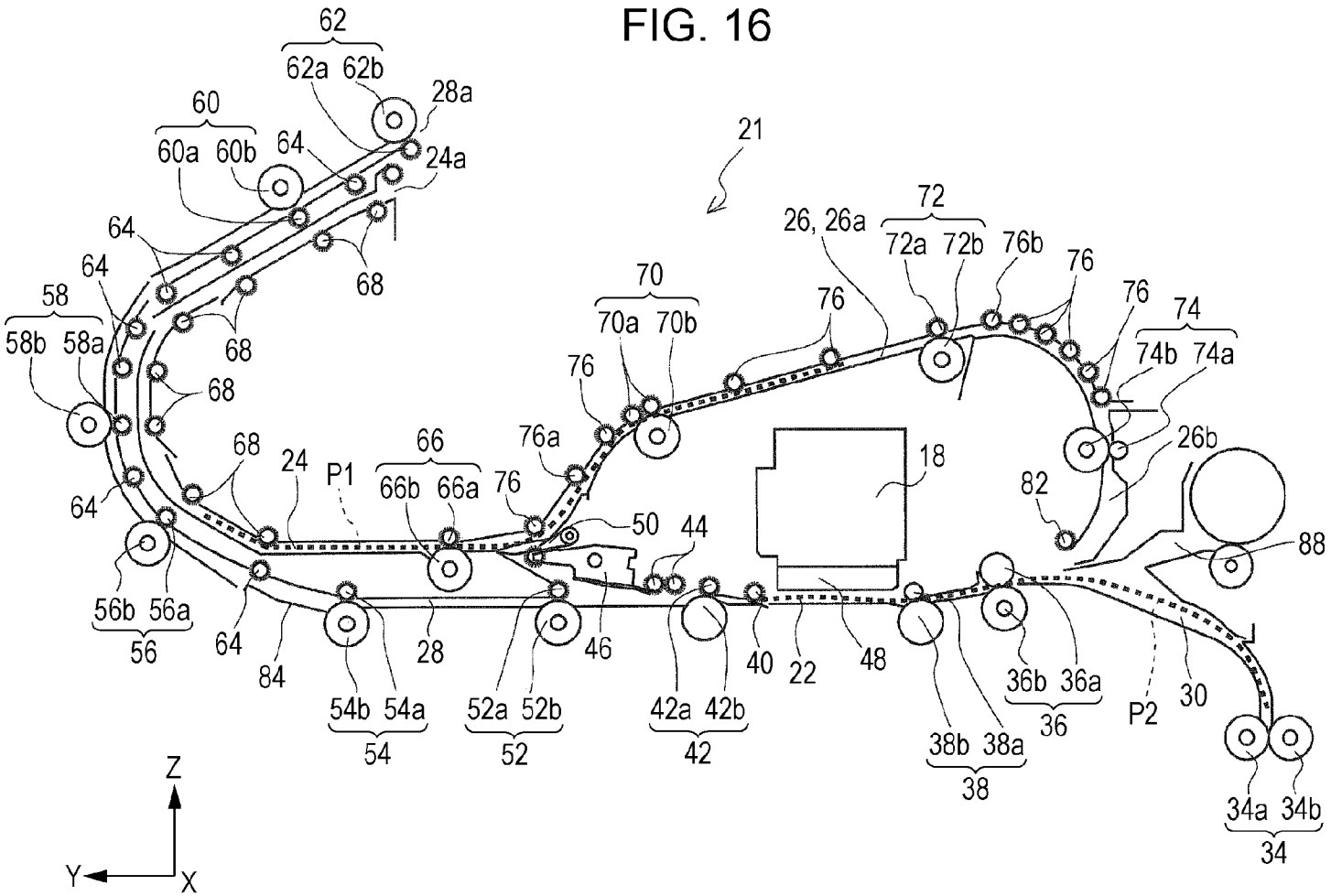
FIG. 16 is a view illustrating a third state of the medium which is transported in the medium transporting path.
Figure 17:
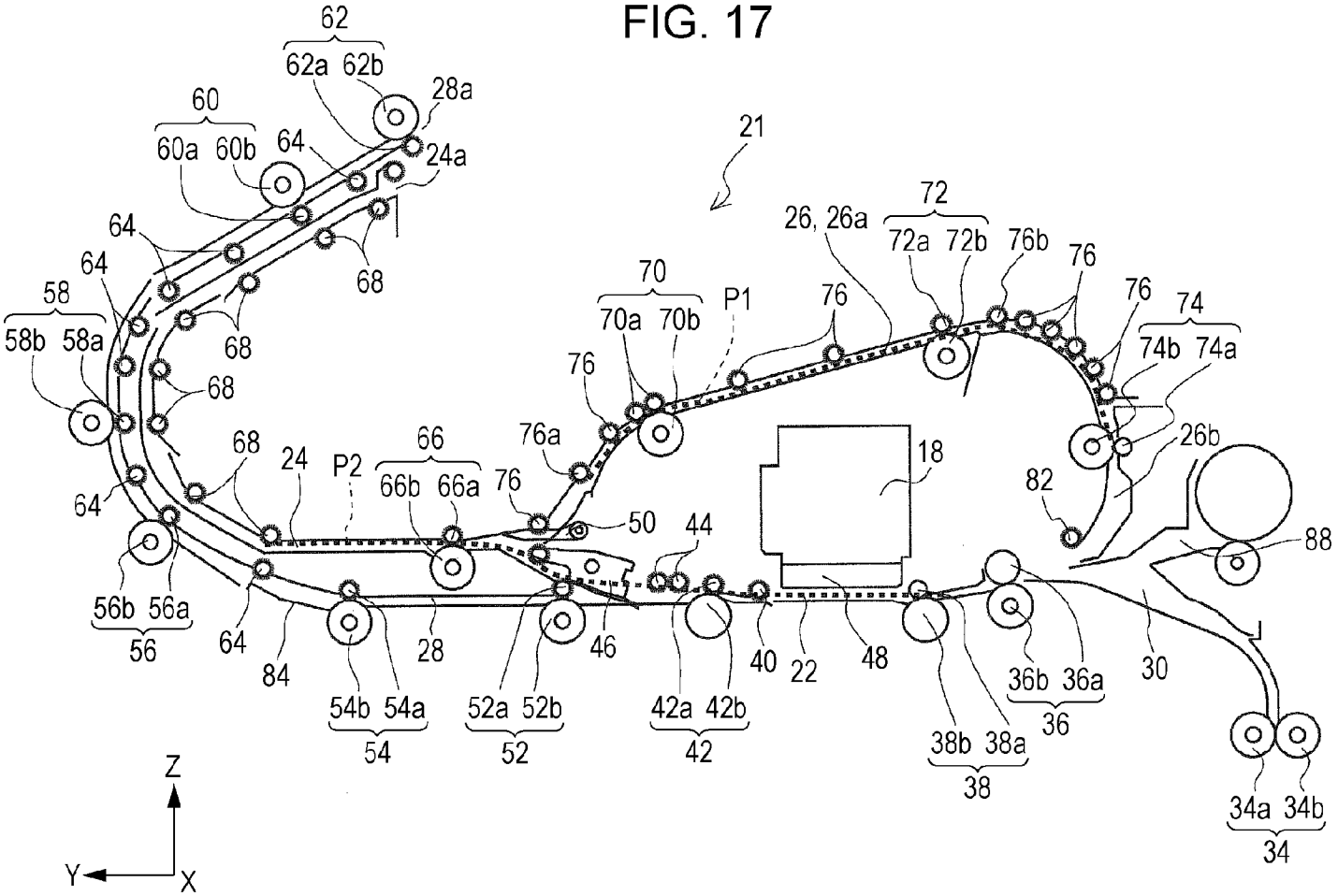
FIG. 17 is a view illustrating a fourth state of the medium which is transported in the medium transporting path.
Figure 18:
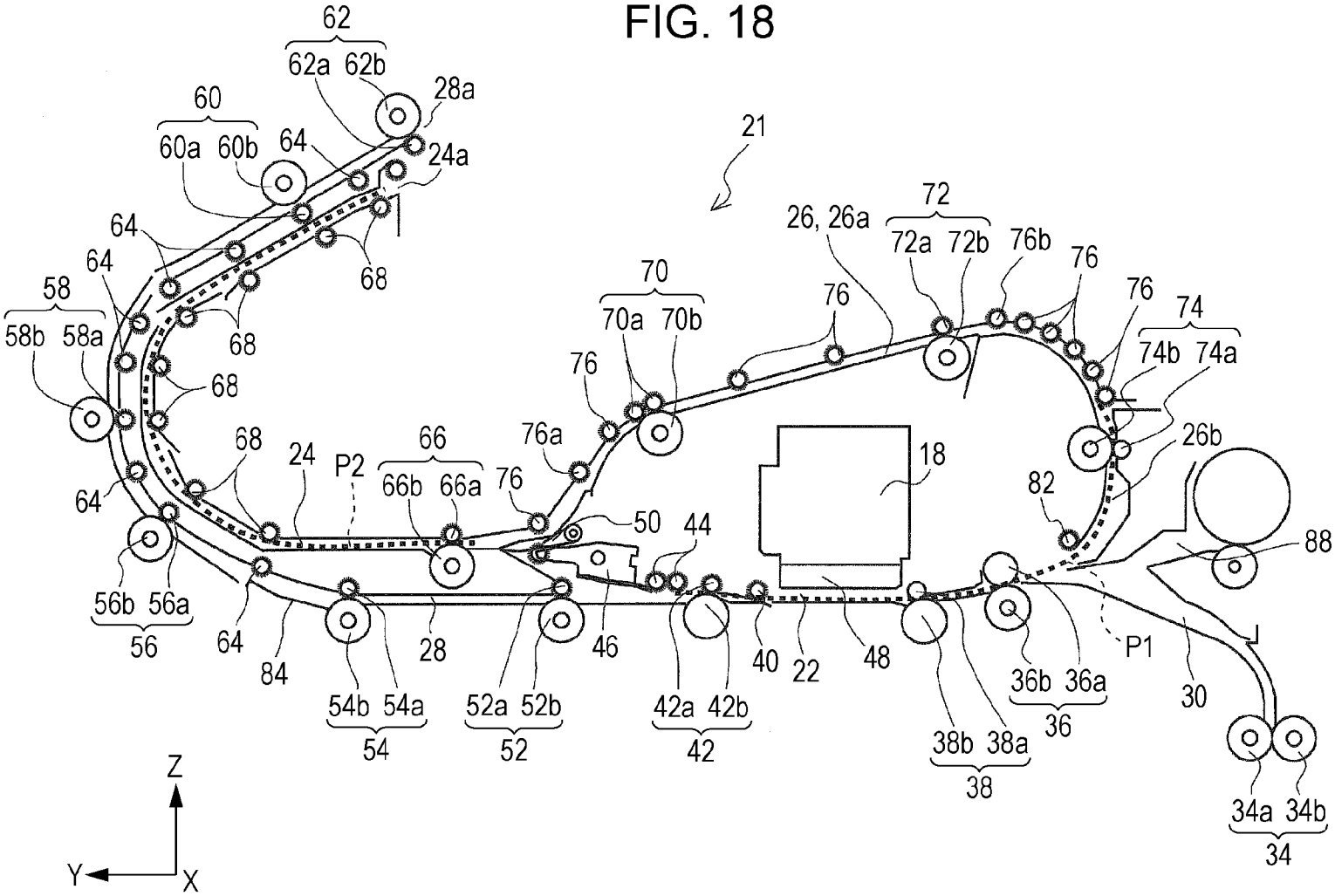
FIG. 18 is a view illustrating a fifth state of the medium which is transported in the medium transporting path.
Figure 19:
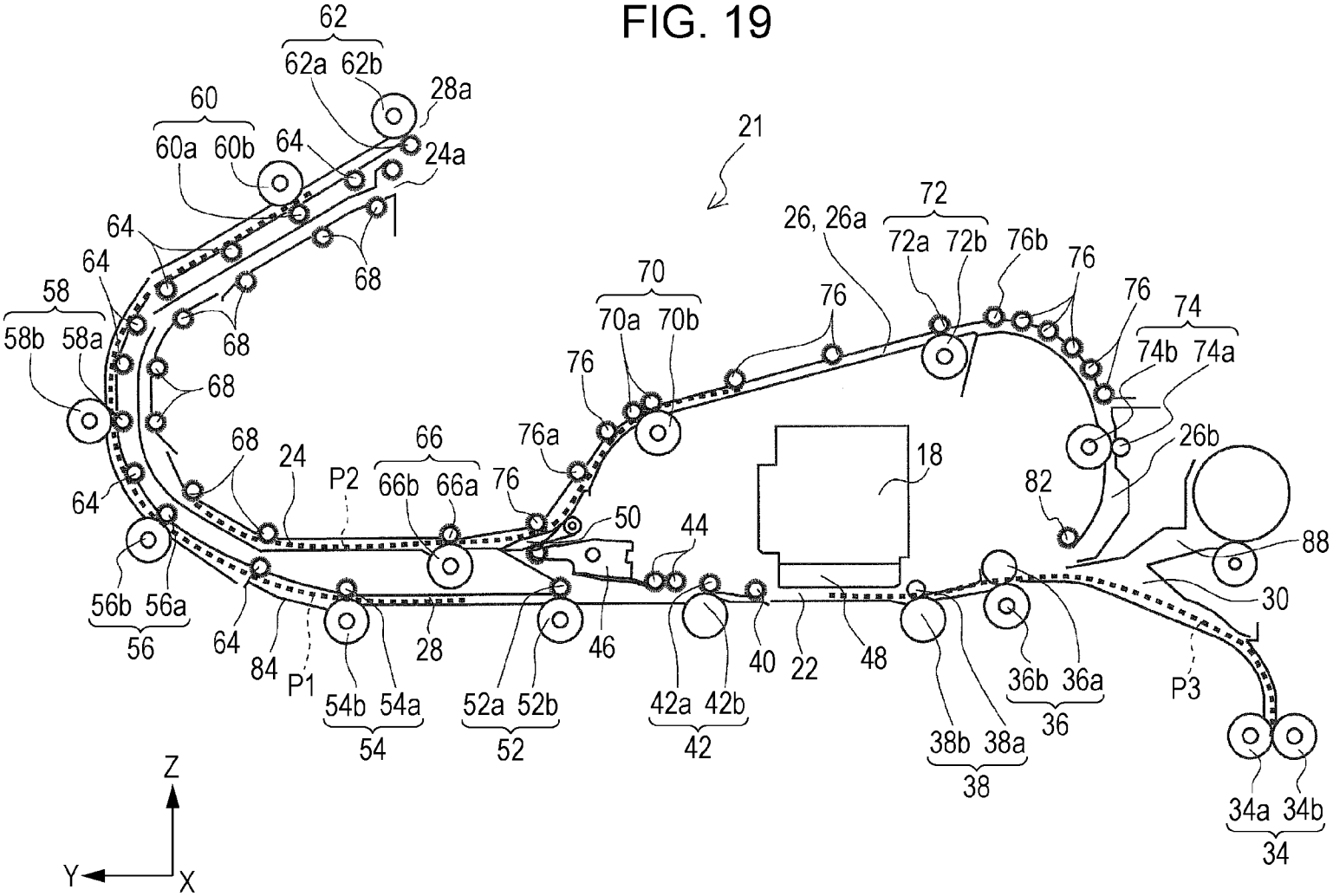
FIG. 19 is a view illustrating a sixth state of the medium which is transported in the medium transporting path.
Figure 20:
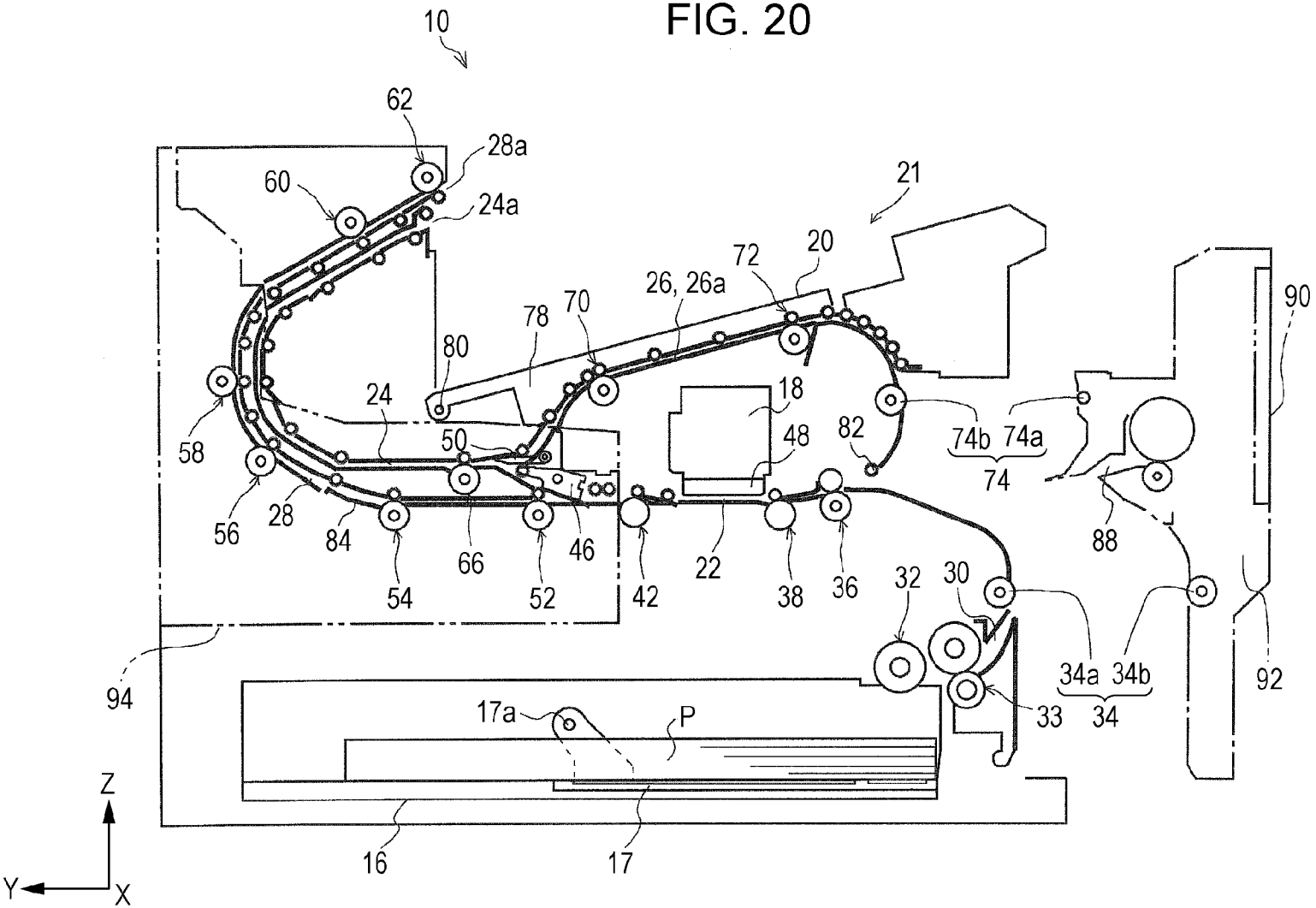
FIG. 20 is a view illustrating a state where an opening/closing unit is detached from the medium transporting path.
Figure 21:
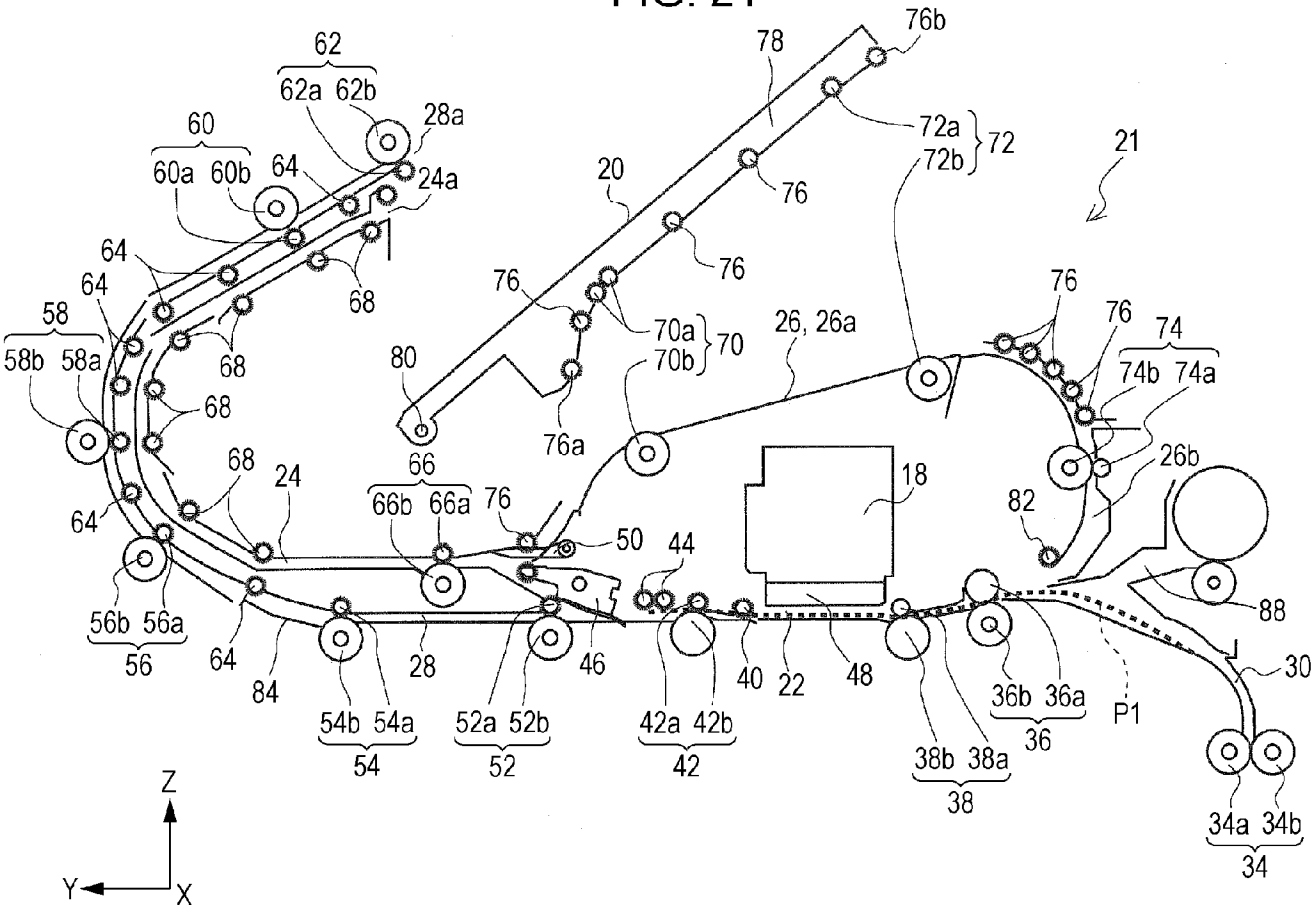
FIG. 21 is a view illustrating a state where an upper member is rotationally moved and an upper section is exposed in the medium transporting path.
Figure 22:
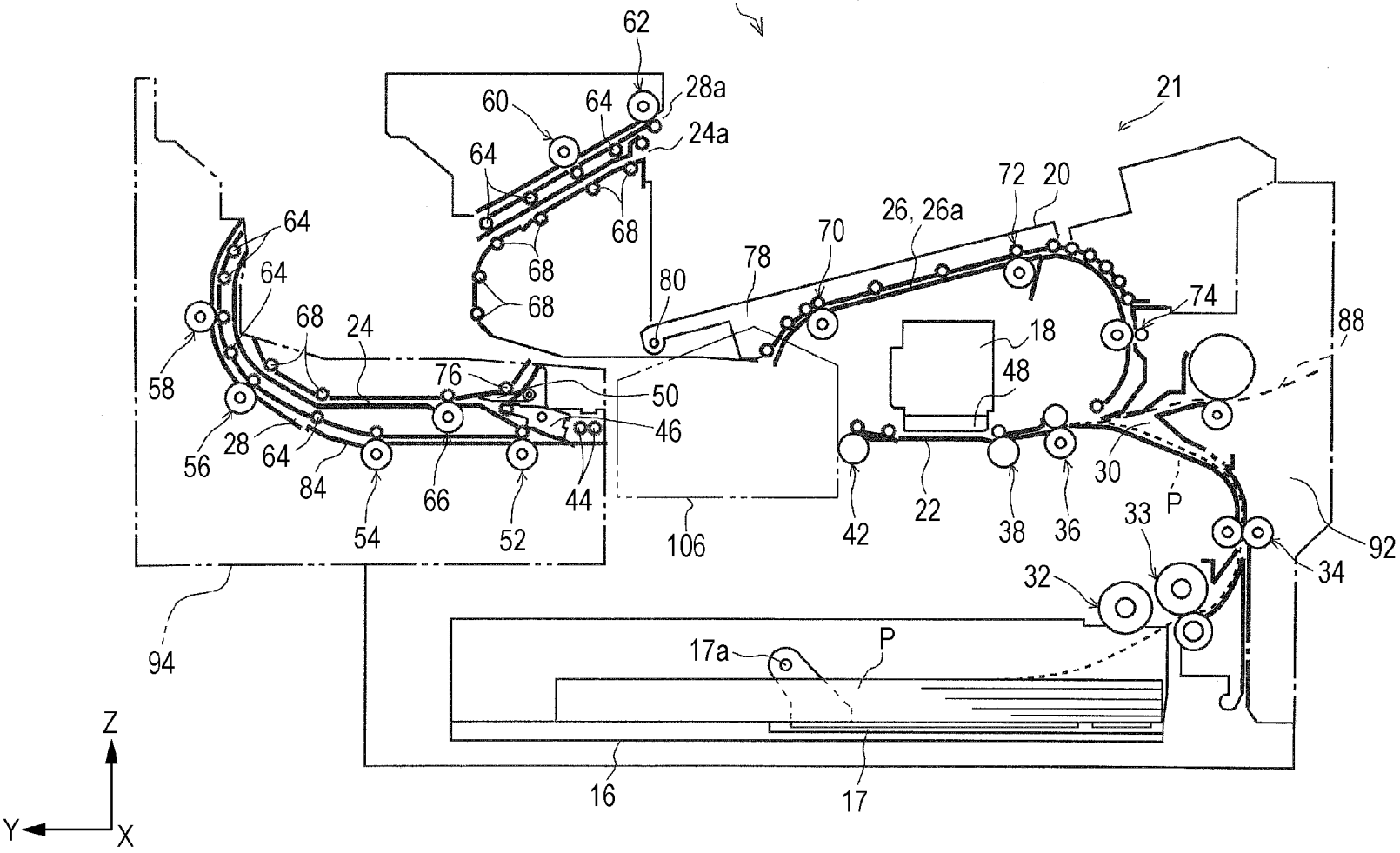
FIG. 22 is a view illustrating the second state where a unit body opens the medium transporting path in the medium transporting path.

FIG. 16 is a view illustrating a third state of the medium which is transported in the medium transporting path. FIG. 17 is a view illustrating a fourth state of the medium which is transported in the medium transporting path. FIG. 18 is a view illustrating a fifth state of the medium which is transported in the medium transporting path. FIG. 19 is a view illustrating a sixth state of the medium which is transported in the medium transporting path. FIG. 20 is a view illustrating a state where an opening/closing unit is detached from the medium transporting path. FIG. 21 is a view illustrating a state where an upper member is rotationally moved and an upper section is exposed in the medium transporting path. FIG. 22 is a view illustrating the second state where a unit body opens the medium transporting path in the medium transporting path.

In each drawing, in an X-Y-Z coordinate system, an X direction means a depth direction of the recording apparatus and a width direction of the medium, a Y direction means a width direction of the recording apparatus and a transporting direction of the medium, and a Z direction means a height direction of the apparatus. In addition, in each drawing, a −X direction side is an apparatus front surface side, and a +X direction side is an apparatus rear surface side.

Overview of Printer and Transporting Path

An ink jet printer 10 (hereinafter, referred to as a printer 10) will be described as an example of the recording apparatus with reference to FIGS. 1 to 2. The printer 10 is configured as a multifunction printer which is provided with an apparatus main body 12 and a scanner unit 14. The apparatus main body 12 is provided with a plurality of medium accommodation cassettes 16 which accommodate the medium. Each medium accommodation cassette 16 is attached to be attachable to and detachable from a front surface side (−X-axis direction side in FIG. 1) of the apparatus main body 12. In addition, a medium P in the present specification indicates a paper sheet, such as a plain paper sheet, a thick paper sheet, or a photographic paper sheet.

In addition, in an apparatus height direction (Z-axis direction) in the apparatus main body 12, a medium receiving tray 20 which receives the medium P on which recording is performed in a recording portion 18 which will be described later is provided between the scanner unit 14 and the medium accommodation cassette 16.

A transporting path of the medium P in the printer 10 will be described with reference to FIGS. 2 and 14. In addition, in FIG. 2, only main configuration elements of the transporting path of the medium P are given reference numerals, and in particular, a plurality of spurs is not given reference numerals. Meanwhile, in FIG. 14, the detailed configuration elements of the transporting path of the medium P are given reference numerals.

The printer 10 in the embodiment is provided with a medium transporting path 21. The medium transporting path 21 is configured of a straight path 22 as a "first transporting path", a switching-back path 24 as a "second transporting path", a reversing path 26 as a "third transporting path", a face-down discharging path 28 as a "fourth transporting path", and a feeding path 30 which is connected to the straight path 22 from the medium accommodation cassette 16.

In the feeding path 30, a feeding roller 32, a separating roller pair 33, and a first transporting roller pair 34 are provided in order along the transporting direction of the medium P. The feeding roller 32 is rotationally driven by a driving source which is not illustrated. One roller 33*a* of the separating roller pair 33 is a roller which rotates in a driven manner in a state where a predetermined rotational resistance is applied, and performs separation of the medium P by nipping the medium P between one roller 33*a* and the other roller 33*b* (roller which is rotationally driven).

One roller 34*a* of the first transporting roller pair 34 is configured as a driven roller which rotates in a driven manner in accordance with rotational driving of the other roller 34*b*, and the other roller 34*b* is configured as a driving roller which is rotationally driven by the driving source which is not illustrated.

In addition, in the embodiment, one roller 34*a* and the other roller 34*b* of the first transporting roller pair 34 are configured of rubber rollers. In addition, each driving roller is controlled by a control portion (not illustrated) provided inside the apparatus main body 12 via the driving source which is not illustrated. In addition, a recording head 48 which will be described later is also controlled by the control portion. In other words, the control portion is configured to perform controls which are necessary for a recording operation in the printer 10.

In addition, in the description below, one roller in each transporting roller pair mentioned in the present specification is configured as a driven roller, and the other roller is configured as a driving roller which is rotationally driven by the driving source which is not illustrated. In addition, in the embodiment, when there is no specific description, one roller is configured as a spur which is provided with a plurality of teeth on an outer circumference, and the driving roller which is the other roller is configured as a rubber roller as an example.

As illustrated in FIG. 2, the medium P accommodated in the medium accommodation cassette 16 is supported on a hopper 17 which is provided inside the medium accommodation cassette 16. The hopper 17 rotationally moves by considering a rotational moving axis 17*a* which is provided in the hopper 17 as a fulcrum, and the medium P is lifted up. At this time, the feeding roller 32 comes into contact with the uppermost medium P among the media P supported by the hopper 17, and transports the medium P to a downstream side in the transporting direction. At this time, there is a case where the media P following the uppermost medium P is transported together with the uppermost medium P. However, the uppermost medium P and the media P following the uppermost medium P are separated from each other by the separating roller pair 33, and only the uppermost medium P is transported to the downstream side in the transporting direction.

Hereinafter, the description will refer to FIG. 14. In addition, in the embodiment, a face-down discharge which makes a recording surface of the medium P face downward and discharges the medium P toward the medium receiving tray 20 is assumed. On the downstream side in the transporting direction of the first transporting roller pair 34, a second transporting roller pair 36 is provided. The second transporting roller pair 36 is also provided with one roller 36*a* and the other roller 36*b*.

In the embodiment, the feeding path 30 and the straight path 22 are connected to each other at a position of the second transporting roller pair 36. In other words, the feeding path 30 is set to be a path from the medium accommodation cassette 16 to the second transporting roller pair 36.

The straight path 22 is configured as a path which extends in a straight line shape, and is provided with the second transporting roller pair 36, a third transporting roller pair 38, the recording portion 18, a spur 40, a fourth transporting roller pair 42, a spur 44, and a first flap 46 in order in the transporting direction. In addition, the straight path 22 in the embodiment is set to be a path from the second transporting roller pair 36 to the first flap 46. In other words, the straight path 22 passes along the recording portion 18, and is set to be a path which extends to an upstream side and a downstream side of the recording portion 18.

The third transporting roller pair 38 is provided with one roller 38*a* and the other roller 38*b*. Next, the recording portion 18 is provided with the recording head 48. In the embodiment, when the medium P is transported to a position which opposes the recording head 48, the recording head 48 is configured to eject ink onto the recording surface of the medium P and perform recording. The recording head 48 according to the embodiment is a recording head which is provided so that nozzles which eject the ink cover the entire paper sheet in a width direction, and is configured as a recording head which can perform recording over the entire width of the paper sheet regardless of the movement of the paper sheet in the width direction.

In the transporting path on the downstream side of the recording head 48, that is, the recording portion 18, on a side which opposes the recording surface of the medium P, the spur 40, one roller 42*a* (spur) of the fourth transporting roller pair 42, and the spur 44 are provided to be rotatable. In other words, as the paper sheet guidance on the recording surface of the medium P is performed by these spurs, it is possible to reduce a contact area on the recording surface, to suppress transfer omission or white spots on the recording surface, and to suppress deterioration of recording quality.

Next, the first flap 46 is positioned on the downstream side of the spur 44 in the transporting direction. The first flap 46 connects (state in FIG. 14) the straight path 22 and the switching-back path 24 to each other by a driving mechanism which is controlled by the control portion (not illustrated) provided inside the apparatus main body 12, or is switchable so as to connect (state in FIG. 16) the straight path 22 and the face-down discharging path 28 to each other. In addition, in the embodiment, the driving mechanism which drives the first flap 46 is configured of a solenoid. In addition, a posture switching operation of the first flap 46 is controlled by the control portion (not illustrated).

In other words, when the straight path 22 and the switching-back path 24 are connected to each other by the first flap 46, the medium P is sent to the switching-back path 24 from the straight path 22 by the fourth transporting roller pair 42 (refer to FIG. 3). In addition, when the straight path 22 and the face-down discharging path 28 are connected to each other, the medium P is sent to the face-down discharging path 28 from the straight path 22 by the fourth transporting roller pair 42 (refer to FIG. 19).

In addition, here, a second flap 50 will be described. The second flap 50 is provided above the first flap 46 in the apparatus height direction (Z-axis direction). The second flap 50 is linked to the operation of the first flap 46 and is driven by a linking mechanism which is not illustrated. In other words, the second flap 50 is controlled by the control portion via the first flap 46 and the linking mechanism.

To describe the operation in detail, in a state where the first flap 46 connects the straight path 22 and the switching-back path 24 to each other, the second flap 50 has a posture in which the connection between the switching-back path 24 and the reversing path 26 is blocked (FIG. 14). Meanwhile, as illustrated in FIG. 16, in a state where the first flap 46 connects the straight path 22 and the face-down discharging path 28 to each other, the second flap 50 has a posture in which the switching-back path 24 and the reversing path 26 are connected to each other.

The face-down discharging path 28 will be described with reference to FIG. 14 again. The face-down discharging path 28 is bent and reversed while extending to an upper side from the straight path 22 in the apparatus height direction. The face-down discharging path 28 is provided with a fifth transporting roller pair 52, a sixth transporting roller pair 54, a seventh transporting roller pair 56, an eighth transporting roller pair 58, a ninth transporting roller pair 60, a tenth transporting roller pair 62, and a plurality of spurs 64.

The face-down discharging path 28 is a path from the first flap 46 to an outlet 28*a* which is positioned on the downstream side of the tenth transporting roller pair 62 in the transporting direction. In other words, the face-down discharging path 28 is a transporting path which is connected to the straight path 22, and is a path which bends, reverses, and discharges the medium P which passes along the recording portion 18.

The medium P on which recording is performed on the recording surface by the recording portion 18 is sequentially nipped and transported by the fifth transporting roller pair 52, the sixth transporting roller pair 54, the seventh transporting roller pair 56, the eighth transporting roller pair 58, the ninth transporting roller pair 60, and the tenth transporting roller pair 62 in order along the transporting direction from the first flap 46 in the face-down discharging path 28. Then, the medium P is discharged toward the medium receiving tray 20 from the outlet 28*a*.

Here, when the medium P is transported through the face-down discharging path 28, the medium P is transported as the recording surface on which final recording is performed by the recording portion 18 faces upward, next, the medium P is transported as the recording surface is bent toward an inner side of a bent part of the face-down discharging path 28, and then, the medium P is discharged toward the medium receiving tray 20 from the outlet 28*a* as the recording surface faces downward.

In addition, one roller 52*a* of the fifth transporting roller pair 52, one roller 54*a* of the sixth transporting roller pair 54, one roller 56*a* of the seventh transporting roller pair 56, one roller 58*a* of the eighth transporting roller pair 58, one roller 60*a* of the ninth transporting roller pair 60, one roller 62*a* of the tenth transporting roller pair 62, and the plurality of spurs 64 are disposed on the inner side of the bent part of the face-down discharging path 28, that is, on a side which opposes the recording surface on which final recording is performed in the recording portion 18.

Furthermore, the other roller 52*b* of the fifth transporting roller pair 52, the other roller 54*b* of the sixth transporting roller pair 54, the other roller 56*b* of the seventh transporting roller pair 56, the other roller 58*b* of the eighth transporting roller pair 58, the other roller 60*b* of the ninth transporting roller pair 60, and the other roller 62*b* of the tenth transporting roller pair 62 are disposed on an outer side of the bent part of the face-down discharging path 28, that is, on a side which is opposite to a side opposing the recording surface on which final recording is performed in the recording portion 18.

In other words, when the medium P is transported, since the plurality of spurs which is disposed on the inner side of the bent part of the face-down discharging path 28 comes into contact with the recording surface on which final recording is performed in the recording portion 18, it is possible to minimize the contact between the spurs and the recording surface, and to suppress deterioration of the recording quality of the medium P.

Here, the medium receiving tray 20 will be described with reference to FIG. 2 again. The medium receiving tray 20 has an upwardly (+Z-axis direction) inclined posture toward a side far from the outlet 28*a* of the face-down discharging path 28, that is, a −Y-axis direction side. The medium receiving tray 20 is configured to mount the medium P which is discharged from the face-down discharging path 28 thereon. In addition, the medium receiving tray 20 in the embodiment is positioned above the recording portion 18 in the Z-axis direction, that is, on the +Z-axis direction side.

Next, the switching-back path 24 will be described with reference to FIG. 14 again. When recording is performed on a second surface after performing recording on a first surface on the medium P, that is, when recording is performed on both surfaces, the switching-back path 24 and the reversing path 26 are paths through which the medium P passes. In addition, similarly, in a case where recording is not performed on the first surface, but recording is performed on the second surface, the medium P passes through the switching-back path 24 and the reversing path 26. In other words, recording on both surfaces in the present specification means that the medium P is reversed and recording is performed on the second surface regardless of whether or not recording is performed on the first surface.

The switching-back path 24 is positioned on the inner side of the face-down discharging path 28 which is bent and reversed upwardly in the apparatus height direction, and extends along the face-down discharging path 28. The switching-back path 24 is provided with an eleventh transporting roller pair 66 and a plurality of spurs 68. One roller 66*a* of the eleventh transporting roller pair 66 and the plurality of spurs 68 are disposed on the inner side of the switching-back path 24 in a bending direction. In addition, the other roller 66*b* of the eleventh transporting roller pair 66 is disposed on the outer side of the switching-back path 24 in the bending direction.

In addition, in the embodiment, a switching-back path is set to be a path from the second flap 50 to an opening 24*a* which is provided at a tip end of the switching-back path 24. In the switching-back path 24, as illustrated in FIGS. 3 and 14, when the switching-back path 24 and the straight path 22 are connected to each other by the first flap 46, the medium P is fed to the switching-back path 24 via the first flap 46 from the recording portion 18 by the fourth transporting roller pair 42. The medium P is fed to a position where a rear end portion of the medium P is nipped by the eleventh transporting roller pair 66 in the transporting direction in the switching-back path 24.

Furthermore, at this time, according to a length of the medium P in the transporting direction, there is a case where a path length of the switching-back path 24 becomes longer. In this case, the tip end side of the medium P is in a state where the tip end part of the medium P is protruded from the opening 24*a* which is provided at the tip end of the switching-back path 24, and is exposed to the outside of the apparatus main body 12. When the medium P is sent to the reversing path 26, the tip end part of the medium P which is protruded from the opening 24*a* is drawn into the switching-back path 24 from the opening 24*a*. Therefore, it is possible to respond to a case where the length of the medium P in the transporting direction is longer than the path length of the switching-back path 24.

In addition, when the posture in a state (refer to FIG. 14) where the first flap 46 connects the straight path 22 and the switching-back path 24 to each other is switched to a posture in a state (refer to FIG. 16) where the straight path 22 and the switching-back path 24 are disconnected from each other, a posture of the second flap 50 is switched to a posture (refer to FIGS. 4 and 16) in which the second flap 50 connects the switching-back path 24 and the reversing path 26 to each other.

Accordingly, the control unit rotates the eleventh transporting roller pair 66 in a direction reverse to a direction in which the medium P is fed to the switching-back path 24, and sends out the medium P to the reversing path 26 by considering the rear end side of the medium P as the tip end side. In other words, the medium P is switched back. Therefore, the switching-back path 24 is a transporting path which is connected to the straight path 22, and is a path which switches back and transports the medium P in the direction reverse to the feeding direction after the medium P which passes along the recording portion 18 is fed.

Next, the reversing path 26 will be described with reference to FIG. 14. The reversing path 26 is set to be a path from the second flap 50 to the second transporting roller pair 36 of the straight path 22 passing above the recording portion 18.

The reversing path 26 is provided with a twelfth transporting roller pair 70, a thirteenth transporting roller pair 72, a fourteenth transporting roller pair 74, and a plurality of spurs 76. In the reversing path 26, the other roller 70*b* of the twelfth transporting roller pair 70, the other roller 72*b* of the thirteenth transporting roller pair 72, the other roller 74*b* of the fourteenth transporting roller pair 74 are provided on the inner side of transporting path with respect to the recording portion 18, that is, to be close to the recording portion 18. In addition, one roller 70*a* of the twelfth transporting roller pair 70, one roller 72*a* of the thirteenth transporting roller pair 72, and the spurs 76 are provided on the outer side of the transporting path.

In addition, in the embodiment, a section from a spur with a reference numeral 76*a* to a spur with a reference numeral 76*b* via the twelfth transporting roller pair 70 and the thirteenth transporting roller pair 72, is set as an upper section 26*a*, and a portion from the spur with a reference numeral 76*b* to the second transporting roller pair 36 is set as a reversing portion 26*b*.

The upper section 26*a* is provided with an upper member 78 (refer to FIG. 2) which is a path forming member that forms the upper section 26*a*. The upper member 78 is positioned on the upper side of the upper section 26*a*, and the medium receiving tray 20 is formed above the upper member 78. In other words, an upper surface of the upper member 78 constitutes the medium receiving tray 20, and the lower surface of the upper member 78 constitutes a part of the upper section 26*a*. In other words, the upper member 78 is formed to be integrated with the medium receiving tray 20.

In addition, in the reversing path 26, the spurs 76, 76*a*, and 76*b*, which are positioned inside the upper section 26*a*, one roller 70*a* of the twelfth transporting roller pair 70, and one roller 72*a* of the thirteenth transporting roller pair 72, are attached to the upper member 78 to be rotatable.

In addition, as illustrated in FIG. 2, in the upper member 78, a rotational movement fulcrum 80 is provided in an end portion on the +Y-axis direction side. Therefore, the upper member 78 obtains a closed posture (refer to a solid line portion in FIG. 2) which constitutes the upper section 26*a*, and a posture (refer to a two-dot chain line portion in FIG. 2) in which the upper section 26*a* is opened. In addition, the rotational movement of the upper member 78 will be described in more detail later.

In FIG. 14 again, the upper section 26*a* in the reversing path 26 is inclined upwardly (+Z-axis direction) and extends in the −Y-axis direction. In other words, the upper section 26*a* extends along the medium receiving tray 20 (refer to FIG. 2). As a result, it is possible to reduce a curvature of a part which is bent and bends the medium in the reversing portion 26*b*, that is, a reversing part, and to smoothly transport the medium P since the medium P is bent without difficulty.

The outlet side of the reversing portion 26*b* is configured to be merged with the straight path 22 at an upstream position of the second transporting roller pair 36 in the straight path 22. Then, the medium P is fed to the straight path 22 again. In other words, the reversing path 26 is a transporting path which is connected to the switching-back path 24, and is set to be a path which makes the medium transported in the reverse direction, that is, the switched-back medium P, detour the upper side of the recording portion 18, reverses the medium P, and makes the medium P merge by the second transporting roller pair 36 which is positioned on the upstream side of the recording portion 18 in the straight path 22.

Here, when the medium P is merged from the reversing path 26 to the straight path 22, skew-removing is performed. In the embodiment, the other roller 74*a* of the fourteenth transporting roller pair 74 is configured as a resin roller. In addition, in a path between the second transporting roller pair 36 and the fourteenth transporting roller pair 74, a spur 82 is provided on the inner side of the transporting path to be rotatable.

In other words, the medium P which is transported along the reversing path 26 is nipped by the fourteenth transporting roller pair 74, the tip end of the medium P butts against the second transporting roller pair 36, and accordingly, skew-removing is performed. At this time, the spur 82 prevents the bent medium from being rubbed with the path forming member inside the reversing path 26 during the skew-removing.

Above, an overview of the medium transporting path when the face-down discharge is performed with respect to the medium receiving tray 20 in the printer 10, is described. In the embodiment, when recording is performed on both surfaces with respect to the medium P, that is, on the first surface and the second surface of the medium P, in the printer 10, the transporting path of the medium P starts from the medium accommodation cassette 16, goes through the straight path 22, the recording portion 18, the switching-back path 24, and the reversing path 26, passes along the straight path 22 and the recording portion 18 again, goes through the face-down discharging path 28, and reaches the medium receiving tray 20.

In addition, the printer 10 in the embodiment is also configured to be able to perform a face-up discharge. A part of the path forming member between the other roller 54*b* of the sixth transporting roller pair 54 and the other roller 56*b* of the seventh transporting roller pair 56 in the face-down discharging path 28 is configured as a third flap 84. The third flap 84 is configured to be able to switch a posture (refer to FIGS. 2 and 14) which constitutes the transporting path of the face-down discharging path 28 and a face-up discharging posture (not illustrated) with each other. Furthermore, the third flap 84 in the embodiment is controlled by the control portion.

By switching the third flap 84 to the face-up discharging posture, the medium P which is sent to the face-down discharging path 28 from the straight path 22 is discharged to a face-up discharging tray 86 illustrated in FIG. 8 via the third flap 84, while the recording surface of the medium P faces upward.

In addition, a dashed line with a reference numeral 88 in FIG. 2 illustrates a manual feeding path of the medium P which is supplied from a manual feeding tray 90 in a state where the manual feeding tray 90 (refer to FIG. 1) is rotationally moved with respect to the apparatus main body 12 and is opened. The manual feeding path 88 is configured to be merged with the feeding path 30. Accordingly, both recording on one surface and recording on both surfaces can also be performed on the medium P which is supplied from the manual feeding path 88 in the printer 10. A posture in which the manual feeding tray 90 is opened with respect to the apparatus main body 12 is not illustrated.

Regarding Transportation of Plurality of Media in Printer

Next, with reference to FIGS. 14 to 19, transportation of the media in the medium transporting path when recording on both surfaces is performed on a plurality of media Pn in the printer 10 will be described. In addition, in FIGS. 14 to 19, a dashed line with a reference numeral P1 indicates a medium which is firstly transported in the transporting path, a dashed line with a reference numeral P2 indicates a medium which is secondly transported, and a dashed line with a reference numeral P3 indicates a medium which is thirdly transported.

As illustrated in FIG. 14, the medium P1 which is sent along the feeding path 30 by the feeding roller 32 (refer to FIG. 2) from the medium accommodation cassette 16 (refer to FIG. 2) is nipped by the second transporting roller pair 36 and the third transporting roller pair 38 in order, and is transported to the recording portion 18, that is, a position which opposes the recording head 48. Then, recording is performed on a first surface of the medium P1 in the recording portion 18. The medium P1 on which recording is performed on the first surface is nipped by the fourth transporting roller pair 42, and is transported toward the first flap 46 which is positioned on the downstream side of the transporting direction of the fourth transporting roller pair 42 in the transporting direction.

At this time, the first flap 46 has a posture in which the straight path 22 and the switching-back path 24 are connected to each other. As illustrated in FIG. 15, the medium P1 is fed to the switching-back path 24 via the first flap 46 by the fourth transporting roller pair 42.

Then, the medium P1 is nipped by the eleventh transporting roller pair 66 and is sent along the switching-back path 24 up to a position where a rear end of the medium P1 does not interfere with the second flap 50. At this time, the second medium P2 is sent out to the feeding path 30 from the medium accommodation cassette 16 by the feeding roller 32.

Next, as illustrated in FIG. 16, the control portion (not illustrated) switches a posture of the first flap 46, and connects the straight path 22 and the face-down discharging path 28 to each other. As a result, the second flap 50 is linked to the operation of the first flap 46, and obtains a posture in which the switching-back path 24 and the reversing path 26 are connected to each other. Then, the eleventh transporting roller pair 66 is rotationally driven in a direction reverse to a direction in which the medium P1 is fed to the switching-back path 24, by the control of the control portion. As a result, the medium P1 is sent out to the reversing path 26 by considering the rear end side in the transporting direction as a tip end side in the transporting direction when the medium P1 is fed to the switching-back path 24. In other words, the medium P1 is switched back. At this time, recording is performed on a first surface of the medium P2 in the recording portion 18.

Next, as illustrated in FIG. 17, the medium P1 is nipped by the twelfth transporting roller pair 70 and the thirteenth transporting roller pair 72 in order, and is transported to the upper section 26*a* which is positioned above the recording portion 18 in the reversing path 26. In addition, when the medium P1 passes through the second flap 50, the posture of the first flap 46 is switched, and the straight path 22 and the switching-back path 24 are connected to each other again.

Then, the medium P2 on which recording on the first surface is completed in the recording portion 18 is transported to the switching-back path 24 via the fourth transporting roller pair 42, the first flap 46, and the eleventh transporting roller pair 66. In addition, a posture of the second flap 50 is switched to a posture in a state where the switching-back path 24 and the reversing path 26 are disconnected from each other in accordance with switching of the posture of the first flap 46.

Next, as illustrated in FIG. 18, when the medium P1 is transported along the reversing portion 26*b* of the reversing path 26, the first surface and the second surface of the medium P1 are reversed, the medium P1 is nipped by the fourteenth transporting roller pair 74, and the medium P1 is transported toward the straight path 22. At this time, the tip end of the medium P butts against the second transporting roller pair 36, and skew-removing is performed. Then, the medium P1 is fed to the straight path 22 by making the second surface face the side which opposes the recording head 48 of the recording portion 18. The medium P1 which is fed to the straight path 22 is nipped by the second transporting roller pair 36 and the third transporting roller pair 38 in order, and is transported to the recording portion 18.

Then, recording is performed on the second surface of the medium P1 in the recording portion 18. In addition, the first flap 46 is provided for discharging the medium P1, and switches the posture in which the straight path 22 and the switching-back path 24 are connected to each other to the posture in which the straight path 22 and the face-down discharging path 28 are connected to each other, by the control portion. In addition, the second flap 50 is also linked to the first flap 46, and switches the posture in which the switching-back path 24 and the reversing path 26 are disconnected from each other to the posture in which the switching-back path 24 and the reversing path 26 are connected to each other.

Next, as illustrated in FIG. 19, the medium P1 on which recording is performed on the second surface in the recording portion 18 is sent out to the face-down discharging path 28 by the fourth transporting roller pair 42. The medium P1 is nipped by the fifth transporting roller pair 52, the sixth transporting roller pair 54, the seventh transporting roller pair 56, the eighth transporting roller pair 58, the ninth transporting roller pair 60, and the tenth transporting roller pair 62 in order in the face-down discharging path 28, is transported to the downstream side in the transporting direction, and is discharged toward the medium receiving tray 20 from the outlet 28*a* of the face-down discharging path 28 while a surface on which final recording is performed, that is, the second surface, is a lower side.

Furthermore, at this time, the medium P2 is fed to the reversing path 26 from the switching-back path 24 by the eleventh transporting roller pair 66. Then, the third medium P3 enters the straight path 22, and is transported to the recording portion 18. Then, recording on a first surface of the medium P3 is performed in the recording portion 18.

Then, the medium P3 is fed to the switching-back path 24 by the fourth transporting roller pair 42 and the eleventh transporting roller pair 66 via the first flap 46 of which the posture in which the straight path 22 and the face-down discharging path 28 are connected to each other is switched to the posture in which the straight path 22 and the switching-back path 24 are connected to each other. Furthermore, when the medium P3 passes through the first flap 46, the posture is switched again. Then, recording on the second surface of the medium P2 which is sent from the reversing path 26 is performed in the recording portion 18, and the medium P2 is discharged to the medium receiving tray 20 passing along the face-down discharging path 28.

After this, until the recording operation is ended as recording on the second surfaces of a predetermined number of media Pn is performed and the media Pn are discharged to the medium receiving tray 20, after recording on the first surface of a medium Pn−1 is performed in the recording portion 18, recording on the first surface of the medium Pn is performed in the recording portion 18 while the medium Pn−1 is transported through the switching-back path 24 and the reversing path 26. After this, the medium Pn is transported from the straight path 22 and the switching-back path 24.

Then, after the medium Pn is transported to the switching-back path 24, recording on the second surface of the medium Pn−1 is performed in the recording portion 18, the operation of discharging the medium Pn−1 from the face-down discharging path 28 to the medium receiving tray 20 is repeated. Above, transportation of the medium in the medium transporting path 21 when recording on both surfaces of the plurality of media Pn is performed in the printer 10, is described.

In other words, the medium transporting path 21 in the embodiment is provided with the switching-back path 24 along the face-down discharging path 28, and the reversing path 26 which is connected to the switching-back path 24 is provided to go around the recording portion 18. For this reason, three media P can be respectively transported at the same time inside the medium transporting path 21, and recording can be performed in order. Accordingly, it is possible to increase the number of media which is in the middle of recording processing per unit time. In other words, it is possible to improve throughput in the printer 10.

To summarize the description above, the printer 10 according to the embodiment includes: the straight path 22 which is the transporting path that transports the medium P, passes along the recording portion 18 that performs recording on the medium P, and extends to the upstream side and the downstream side of the recording portion 18; the switching-back path 24 which is the transporting path that is connected to the straight path 22, and switches back and transports the medium P in a direction reverse to the feeding direction after the medium P which passes along the recording portion 18 is fed; the reversing path 26 which is the transporting path that is connected to the switching-back path 24, makes the medium P transported in the reverse direction detour the upper side of the recording portion 18, reverses the medium P, and makes the medium P merge at the position on the upstream side of the recording portion 18 in the straight path 22; and the face-down discharging path 28 which is the transporting path that is connected to the straight path 22, bends the medium P which passes along the recording portion 18, and reverses and discharges the medium P. The switching-back path 24 is formed along the face-down discharging path 28.

In other words, after the medium P which passes along the recording portion 18 is fed, the switching-back path 24, which switches back and transports the medium P in a direction reverse to the feeding direction, is formed along the face-down discharging path 28 which bends, reverses, and discharges the medium P which passes along the recording portion 18. For this reason, the switching-back path 24 and the face-down discharging path 28 do not respectively occupy a region separately and independently inside the printer 10, and it is possible to further reduce the size of the apparatus.

In addition, the switching-back path 24 and the face-down discharging path 28 in the embodiment are positioned on the reversing path 26 with respect to the straight path 22.

Here, to summarize the positional relationship of the straight path 22, the switching-back path 24, the reversing path 26, and the face-down discharging path 28, the switching-back path 24 and the face-down discharging path 28 are positioned on the reversing path 26 side with respect to the straight path 22 in the apparatus height direction. Therefore, the switching-back path 24, the reversing path 26, and the face-down discharging path 28 use at least partially the same region in the apparatus height direction in the printer 10, and it is possible to more efficiently suppress an increase in dimensions of the apparatus height direction.

In addition, in the embodiment, as illustrated in FIG. 2, the switching-back path 24 and the face-down discharging path 28 are in the occupied region of the face-down discharging path 28 in the height direction.

In other words, the switching-back path 24 and the reversing path 26 do not occupy the region independently in the apparatus height direction, and it is possible to further reduce the size of the apparatus.

In addition, in the embodiment, the switching-back path 24 is disposed inside the face-down discharging path 28.

As a result, a path from the switching-back path 24 toward the reversing path 26 does not intersect a path from the straight path 22 toward the face-down discharging path 28, and it is possible to improve a degree of freedom of control when recording is performed, and further, to improve throughput.

In the embodiment, the printer 10 is provided with the medium receiving tray 20 which receives the medium P discharged from the face-down discharging path 28 above the recording portion 18. The medium receiving tray 20 has an upwardly inclined posture toward a side far from the outlet 28*a* of the face-down discharging path 28. In addition, the reversing path 26 is reversed after being inclined upwardly along the upwardly inclined posture of the medium receiving tray 20, and is merged with the straight path 22.

As a result, it is possible to reduce a curvature of the reversed part in the reversing path 26, and to smoothly reverse the medium without difficulty.

In addition, the switching-back path 24 in the embodiment bends the medium P, by considering the first surface which opposes the recording head 48 that constitutes the recording portion 18 on the medium P which passes along the straight path 22, as an inner side.

Here, when recording is performed on both surfaces (the first surface and the second surface) of the medium P, since the recording portion 18 is configured to perform recording by discharging the ink as the "liquid" onto the medium P, there is a tendency (curling tendency) that the medium P onto which the ink is discharged is bent by considering a surface (surface on which recording is performed) onto which the ink is discharged as an outer side. When the medium P is reversed and sent to the recording portion 18 again, since the medium P is bent by considering the surface which opposes the recording head 48 as the inner side, so-called head rubbing, that is, a case where a tip end or a rear end of the medium P is in contact with the recording head 48, is likely to occur.

However, in the embodiment, since the switching-back path 24 bends the medium P by considering the first surface (surface on which recording is already performed) which opposes the recording head 48 that constitutes the recording portion 18 on the medium P which passes along the straight path 22 as the inner side, that is, the switching-back path 24 bends the medium P in a direction for correcting the curling tendency, it is possible to prevent or suppress the head rubbing.

Regarding Configuration for Paper Jam Processing in Apparatus Main Body

Next, a configuration for paper jam processing of the medium P which occurs in the transporting path in the apparatus main body 12 will be further described with reference to FIGS. 2, 5 to 13, and 20.

Jam Processing in Feeding Path and Reversing Portion 26*b*

In FIG. 20, a one-dot chain line portion with a reference numeral 92 illustrates the opening/closing unit which can be opened and closed with respect to the apparatus main body. Furthermore, in FIG. 20, an opening/closing unit 92 is illustrated in a state of being moved in the horizontal direction from the medium transporting path 21, for convenience of description. The opening/closing unit 92 can be in a closed state with respect to the apparatus main body 12 as illustrated in FIG. 1, and in an opened state with respect to the apparatus main body 12 as illustrated in FIG. 5. The opening/closing unit 92 has a rotational movement fulcrum (not illustrated) in an end portion on the +X-axis direction side. The opening/closing unit 92 is configured to rotationally move with respect to the apparatus main body 12 around the rotational movement fulcrum (refer to FIGS. 1 and 5).

The opening/closing unit 92 is provided with the manual feeding tray 90 which can be opened and closed with respect to the opening/closing unit 92. Furthermore, when the opening/closing unit 92 is in the closed state with respect to the apparatus main body 12, the opening/closing unit 92 forms a path from the first transporting roller pair 34 to a merging position with the manual feeding path 88 in the feeding path 30, and a part of the reversing portion 26*b* of the reversing path 26. In addition, the opening/closing unit 92 is provided with one roller of the fourteenth transporting roller pair 74, that is, the roller 74*a* which can rotate in a driven manner.

Therefore, as illustrated in FIGS. 5 and 20, when the opening/closing unit 92 is in the opened state with respect to the apparatus main body 12, the path from the first transporting roller pair 34 to the merging position with the manual feeding path 88 in the feeding path 30 and the part of the reversing portion 26*b* of the reversing path 26 are exposed toward the outer side of the apparatus main body 12. At this time, as illustrated in FIG. 20, one roller 34*a* and the other roller 34*b* of the first transporting roller pair 34 are separated from each other, and a nipped state in the first transporting roller pair 34 is released. Therefore, it is possible to easily remove the medium P jammed in the feeding path 30. Therefore, it is possible to more easily perform the jam processing.

Similarly, since one roller 74*a* and the other roller 74*b* of the fourteenth transporting roller pair 74 are separated from each other, a nipped state in the fourteenth transporting roller pair 74 is released. Therefore, it is possible to easily remove the medium P jammed in the reversing portion 26*b* of the reversing path 26. Therefore, it is possible to more easily perform the jam processing.

Jam Processing in Upper Section 26*a* in Reversing Path 26

Next, the upper member 78 will be described with reference to FIGS. 6, 7, and 21. The upper member 78 can be rotationally moved to an upper side (+Z-axis direction side) from a closed state (refer to FIG. 6) with respect to the apparatus main body 12 to an opened state (refer to FIG. 7) with respect to the apparatus main body 12 by considering the rotational movement fulcrum 80 (refer to FIG. 21) provided in the end portion on the +Y-axis direction side as a fulcrum.

When the upper member 78 is in the opened state (refer to FIG. 21) with respect to the apparatus main body 12, the upper section 26*a* of the reversing path 26 is opened. In other words, the upper section 26*a* of the reversing path 26 is in an exposed state toward the outer side of the apparatus main body 12. In addition, one roller 70*a* (spur) and the other roller 70*b* of the twelfth transporting roller pair 70 which is disposed in the upper section 26*a* are separated from each other, and a nipped state in the twelfth transporting roller pair 70 is released. Similarly, one roller 72*a* (spur) and the other roller 72*b* of the thirteenth transporting roller pair 72 which is disposed in the upper section 26*a* are separated from each other, and a nipped state in the thirteenth transporting roller pair 72 is released.

In addition, since the spurs 76, 76*a*, and 76*b* which are disposed in the upper section 26*a* are provided in the upper member 78, when the upper member 78 is rotationally moved, the rollers which remain in the upper section 26*a* are only the other roller 70*b* (rubber roller) of the twelfth transporting roller pair 70 and the other roller 72*b* (rubber roller) of the thirteenth transporting roller pair 72 which support the lower side of the medium P in the apparatus height direction. Therefore, since there is no member which blocks the upper part of the upper section 26*a*, it is possible to easily perform the jam processing of the medium P.

To summarize the description above, the printer 10 in the embodiment includes: the straight path 22 which is the transporting path that transports the medium P, passes along the recording portion 18 that performs recording on the medium P, and extends to the upstream side and the downstream side of the recording portion 18; the switching-back path 24 which is the transporting path that is connected to the straight path 22, and switches back and transports the medium P in the direction reverse to the feeding direction after the medium P which passes along the recording portion 18 is fed; the reversing path 26 which is the transporting path that is connected to the switching-back path 24, makes the medium P transported in the reverse direction detour the upper side of the recording portion 18, reverses the medium P, and makes the medium P merge at the position on the upstream side of the recording portion 18 in the straight path 22; and the upper member 78 which is the path forming member that forms the upper section 26*a* of the recording portion 18 in the reversing path 26, is positioned on the upper side of the upper section 26*a*, and can open the upper section 26*a*.

In the embodiment, the reversing path 26 is configured as a path which makes the medium P detour the upper part of the recording portion 18, reverses the medium P, and makes the medium P merge at the position on the upstream side of the recording portion 18 in the straight path 22. In other words, the reversing path 26 is positioned above the recording portion 18. Since the upper section 26*a* of the recording portion 18 is formed of the upper member 78 which can open the upper section 26*a*, by opening the upper member 78, without moving the recording portion 18 or making the recording portion 18 an obstacle, it is possible to easily perform the jam processing operation for removing the jammed paper in the upper section 26*a*.

The upper section 26*a* is provided with the twelfth transporting roller pair 70 which nips and transports the medium P. As one roller 70*a* which constitutes the twelfth transporting roller pair 70 is provided in the upper member 78, and the upper member 78 is opened, one roller 70*a* which constitutes the twelfth transporting roller pair 70 is separated from the other roller 70*b*. Similarly, the upper section 26*a* is also provided with the thirteenth transporting roller pair 72 which nips and transports the medium P. As one roller 72*a* which constitutes the thirteenth transporting roller pair 72 is provided in the upper member 78, and the upper member 78 is opened, one roller 72*a* which constitutes the thirteenth transporting roller pair 72 is separated from the other roller 72*b*.

As a result, the nipped state of the medium P by one roller 70*a* and the other roller 70*b* of the twelfth transporting roller pair 70 is released. In addition, similarly, the nipped state of the medium P by one roller 72*a* and the other roller 72*b* of the thirteenth transporting roller pair 72 is also released. According to this, it is possible to more easily remove the jammed medium P.

In the embodiment, one roller 70*a* of the twelfth transporting roller pair 70 provided in the upper member 78 is a roller which can rotate in a driven manner, and the other roller 70*b* is a roller which is rotationally driven by the driving source. In addition, similarly, one roller 72*a* of the thirteenth transporting roller pair 72 provided in the upper member 78 is also a roller which can rotate in a driven manner, and the other roller 72*b* is a roller which is rotationally driven by the driving source.

Therefore, as one roller 70*a* of the twelfth transporting roller pair 70 and one roller 72*a* of the thirteenth transporting roller pair 72 which are provided in the upper member 78 are rollers which can rotate in a driven manner, it is not necessary to provide a power transmission mechanism in the upper member 78, and it is possible to avoid an increase in weight of the upper member 78, and to easily open and close the upper member 78 with a low amount of force.

One roller 70*a* of the twelfth transporting roller pair 70 and one roller 72*a* of the thirteenth transporting roller pair 72 which are provided in the upper member 78 are serrated rollers (spurs) which have a plurality of teeth on the outer circumference, and the serrated roller is in contact with one surface of the medium P on which recording is already performed.

In other words, one roller 70*a* of the twelfth transporting roller pair 70 and one roller 72*a* of the thirteenth transporting roller pair 72 which are provided in the upper member 78 are spurs (serrated rollers) which have a plurality of teeth on the outer circumference, and since the spurs are in contact with one surface of the medium on which recording is already performed, it is possible to suppress transfer omission or white spots on the recording surface.

The printer 10 is provided with the medium receiving tray 20 which is positioned above the upper section 26*a* and receives the discharged medium P, and the face-down discharging path 28 which is the transporting path that is connected to the straight path 22 and transports the medium which passes along the recording portion 18 to the medium receiving tray 20. The medium receiving tray 20 is configured to be integrated with the upper member 78, and can be opened and closed.

Therefore, as the medium receiving tray 20 in which the opening/closing region is ensured to be large and the upper member 78 are configured to be integrated with each other, it is possible to more easily perform the jam processing operation in a state where the upper member 78 is opened.

As the medium receiving tray 20 has the upwardly inclined posture toward the side far from the outlet 28*a* of the face-down discharging path 28 in the closed state, and rotationally moves, the medium receiving tray 20 can be opened and closed, and the rotational movement fulcrum 80 is positioned on the upstream side of the medium receiving tray 20 during the rotational movement.

Therefore, it is possible to ensure a large range of rotational movement of the medium receiving tray 20 and the upper member 78, and to more easily perform the jam processing operation by opening the upper member 78.

Jam Processing in Switching-Back Path and Face-Down Discharging Path

In FIG. 22, a two-dot chain line portion with a reference numeral 94 in FIG. 22 illustrates the unit body which can be in a first state where the medium transporting path 21 is formed with respect to the apparatus main body 12 and in a second state where the medium transporting path 21 is opened. Furthermore, in FIG. 22, only the spurs which are related to the unit body 94 among the plurality of spurs provided in the medium transporting path 21 are given reference numerals, and reference numerals of other spurs are omitted.

The unit body 94 includes a path from the downstream side of the fourth transporting roller pair 42 to the first flap 46 and the second flap 50 in the straight path 22, and a path from the second flap 50 to the middle of the bent and reversed part via the eleventh transporting roller pair 66 in the switching-back path 24. Furthermore, the unit body 94 includes a path from the first flap 46 in the face-down discharging path 28, to the middle of a path from the eighth transporting roller pair 58 toward the ninth transporting roller pair 60, via the fifth transporting roller pair 52, the sixth transporting roller pair 54, the seventh transporting roller pair 56, and the eighth transporting roller pair 58.

As illustrated in FIG. 8, the unit body 94 is configured to be movable in the Y-axis direction with respect to a structure 96 which constitutes the medium transporting path 21 inside the apparatus main body 12. In the embodiment, the unit body 94 is configured to be able to be put in and taken out of the structure 96 by one pair of rail members 98 provided in the structure 96.

Next, as illustrated in FIG. 9, a lever 100 is provided in an upper portion of the unit body 94. The lever 100 is configured to be able to be engaged with a locking mechanism which is not illustrated and which is provided inside the apparatus main body 12. In a state where the unit body 94 is closed with respect to the apparatus main body 12 (refer to FIG. 9), that is, in a state where the unit body 94 is in the first state where the medium transporting path 21 is formed, the lever 100 is in an engaged state with the locking mechanism. Accordingly, the unit body 94 is in a state where the movement of the unit body 94 is restricted with respect to the apparatus main body 12.

Next, when the engaged state with the locking mechanism is released, for example, by pulling up the lever 100, it is possible to draw out the unit body 94 from the apparatus main body 12 by pulling up the lever 100, releasing a locked state, and pulling the lever 100. In other words, in a state where the engagement between the lever 100 and the unit body 94 is released, when the lever 100 is pulled to the +Y-axis direction side in FIGS. 9 and 10, as illustrated in FIG. 10, the unit body 94 is in a state of being drawn out from the apparatus main body 12, that is, the second state where the medium transporting path 21 is opened.

As illustrated in FIG. 22, when the unit body 94 is in a state of being drawn out from the apparatus main body (second state), a part of the straight path 22, a part of the switching-back path 24, and a part of the face-down discharging path 28 are exposed toward the outer side of the apparatus main body 12. In particular, when a paper jam occurs in the switching-back path 24 and the face-down discharging path 28, the switching-back path 24 and the face-down discharging path 28 can be visually confirmed, and it is possible to more easily perform the jam processing operation in the switching-back path 24 and the face-down discharging path 28.

In addition, in the unit body 94, an opening/closing cover 102 (refer to FIG. 9) is provided to be rotationally movable with respect to the unit body 94. When the opening/closing cover 102 is in an opened state (not illustrated) with respect to the unit body 94, the face-up discharging tray 86 provided in the unit body 94 is exposed toward the outer side of the apparatus main body 12, and it is possible to take out the medium P discharged to the face-up discharging tray 86 from the apparatus main body 12.

Jam Processing in Straight Path

Next, the jam processing in the straight path 22 and in the transporting path in the vicinity thereof will be described with reference to FIGS. 8, 11 to 14, and 22.

As illustrated in FIG. 8, a frame 104 is provided to stand on a front side of the apparatus in a depth direction of the recording apparatus which is a direction that intersects the transporting direction of the medium in the structure 96. The frame 104 is a frame which constitutes a framework of the structure 96. An opening 106 is formed in the frame 104. When the unit body 94 is in the first state with respect to the structure 96 in the frame 104, that is, when the unit body 94 constitutes the medium transporting path 21, the opening 106 is formed at a position which corresponds to the fourth transporting roller pair 42, the fifth transporting roller pair 52, the sixth transporting roller pair 54, the eleventh transporting roller pair 66, the first flap 46, and the second flap 50, as illustrated in FIG. 14. Furthermore, in FIGS. 14 and 22, a two-dot chain line portion with the reference numeral 106 illustrates the opening.

As illustrated in FIGS. 8 and 22, when the unit body 94 is in the second state with respect to the structure 96, that is, when the unit body 94 is drawn out from the structure 96 and opens the medium transporting path 21, a user can access the recording portion 18, a part of the straight path 22, for example, the fourth transporting roller pair 42 or the periphery thereof, in the medium transporting path 21 from a side of the medium transporting path 21, that is, the front surface side of the apparatus, via the opening 106. In addition, the user can also access an inlet of the switching-back path 24 or the face-down discharging path 28.

Here, in consideration of a case where the opening 106 is provided in the frame 104, in order to access the straight path 22, for example, the fourth transporting roller pair 42 or the periphery thereof, which is at a position deep inside the structure 96, it is necessary to gain access the straight path 22 from the unit body 94 side which is drawn out from the structure 96. As a result, as an access distance proximate to the straight path 22 or the recording portion 18 from the unit body 94 side becomes longer, and it is difficult to visually confirm a state of the paper jam, operability of the jam processing operation extremely deteriorates.

In the embodiment, as the opening 106 is provided at a position which corresponds to the fourth transporting roller pair 42, the fifth transporting roller pair 52, the sixth transporting roller pair 54, the eleventh transporting roller pair 66, the first flap 46, and the second flap 50 in the medium transporting path 21 in the frame 104, that is, on the side of the medium transporting path 21, when the unit body 94 is drawn out from the structure 96, that is, when the unit body 94 is in the second state, it is possible to easily access and visually confirm the recording portion 18, the straight path 22, and further, the switching-back path 24, and the inlet of the face-down discharging path 28, which are at the position deep inside the apparatus main body 12.

In addition, the jam processing operation in the periphery of the recording portion 18 and the straight path 22 by the opening 106 will be described in detail. As illustrated in FIGS. 9 and 11, a front surface cover 108 which can rotationally move with respect to the apparatus main body 12 by considering a lower end portion as a rotational movement fulcrum is provided at a position which corresponds to the structure 96 in the apparatus height direction in the apparatus main body 12, that is, on the front surface side (−X-axis direction side) of the apparatus of the frame 104. As the front surface cover 108 is rotationally moved with respect to the apparatus main body 12, the opening 106 is exposed toward the outer side of the apparatus main body 12.

In this state, since the unit body 94 is accommodated in the structure 96, and a part of the unit body 94 forms the medium transporting path 21, the user cannot put their hand into the opening 106, or the straight path 22 at the downstream side part of the recording portion 18 inside the medium transporting path 21 cannot be visually confirmed.

Next, in FIGS. 12 and 13, when the locked state of the unit body 94 with respect to the apparatus main body 12 is released by operating the lever 100, and the unit body 94 is drawn out from the apparatus main body 12, a part of the unit body 94 which closes the opening 106 moves in the +Y-axis direction. As a result, the straight path 22 which is at the position deep inside the apparatus main body 12 on the inner side of the opening 106, for example, the fourth transporting roller pair 42 and the periphery thereof which are positioned on the downstream side of the recording portion 18, can be visually confirmed. Then, the user can put their hand into the medium transporting path 21 via the opening 106, and the jam processing can be performed.

In addition, when the unit body 94 is drawn out from the structure 96, one roller (roller which can rotate in a driven manner) 42*a* in the fourth transporting roller pair 42 is separated from the other roller (driving roller) 42*b* by the linking mechanism which is not illustrated, and the nipped state in the fourth transporting roller pair 42 is released. Accordingly, it is possible to easily perform the jam (paper jam) processing which occurs in the recording portion 18.

To summarize the description above, the printer 10 in the embodiment includes the recording portion 18 which performs recording on the medium P, the medium transporting path 21 which transports the medium P, and the frame 104 which is provided to stand in the apparatus depth direction which is the direction that intersects the transporting direction of the medium with respect to the medium transporting path 21 and in which an opening 106 that makes it possible to access the medium transporting path 21 is formed.

In other words, according to the embodiment, it is possible to access the medium transporting path 21 from the side (−X-axis direction side) via the opening 106. Accordingly, even when the jam occurs at the position deep inside the apparatus, it is possible to gain access from a location which is near the position where the jam occurs, and to easily perform the jam processing operation.

In the embodiment, the transporting direction of the medium P is the apparatus width direction in the printer 10, and the frame 104 is provided to stand on the front surface side of the apparatus.

Therefore, in the embodiment, as the opening 106 is positioned on the front surface side of the apparatus, accordingly, it is possible to more easily perform the jam processing operation.

In the printer 10 in the embodiment, the unit body 94 which can be in the first state where the medium transporting path 21 is formed and the second state where the medium transporting path 21 is opened is provided in the frame 104, that is, the structure 96. As the unit body 94 is in the second state, a part of the medium transporting path 21 is exposed to the inner side of the opening 106.

As a result, it is possible to expose the medium transporting path 21 to the inner side of the opening 106 in a larger manner, and thus, to more easily perform the jam processing operation.

In the printer 10 in the embodiment, the fourth transporting roller pair 42 which nips and transports the medium P to the inner side of the opening 106 is provided. In addition, as the unit body 94 is in the second state, one roller 42*a* which constitutes the fourth transporting roller pair 42 is separated from the other roller 42*b*. In addition, the fourth transporting roller pair 42 is a roller pair which is initially positioned downstream of the recording portion 18.

Then, as the unit body 94 is in a state of being drawn out from the apparatus main body 12, one roller 42*a* which constitutes the fourth transporting roller pair 42 is separated from the other roller 42*b*. Accordingly, restriction of the medium P in the fourth transporting roller pair 42 is released, and thus, it is possible to more easily perform the jam processing operation.

Modification Example of Embodiment (1) The opening 106 in the embodiment is configured to be provided on the side of the position which corresponds to the fourth transporting roller pair 42, the fifth transporting roller pair 52, the sixth transporting roller pair 54, the eleventh transporting roller pair 66, the first flap 46, and the second flap 50, in the medium transporting path 21. However, instead of this configuration, the opening 106 may be provided at a position which corresponds to that in other configurations of the medium transporting path 21.

(2) In the embodiment, a configuration in which it is possible to access the inside of the opening 106 by sliding the unit body 94 with respect to the apparatus main body 12 is employed. However, instead of this configuration, a configuration in which it is possible to access the inside of the opening 106 without sliding the unit body 94 with respect to the apparatus main body 12 may be employed.

(3) In the embodiment, when the transporting direction of the medium P is the apparatus width direction, the opening 106 is provided in the frame 104 provided on the front side of the apparatus. However, instead of this configuration, when the transporting direction of the medium P is the apparatus depth direction, the opening 106 may be provided on the side surface of the apparatus. In other words, the opening 106 may be provided to be able to be accessed from the direction which intersects the transporting direction of the medium in the medium transporting path 21.

Embodiment 2

Figure 23:
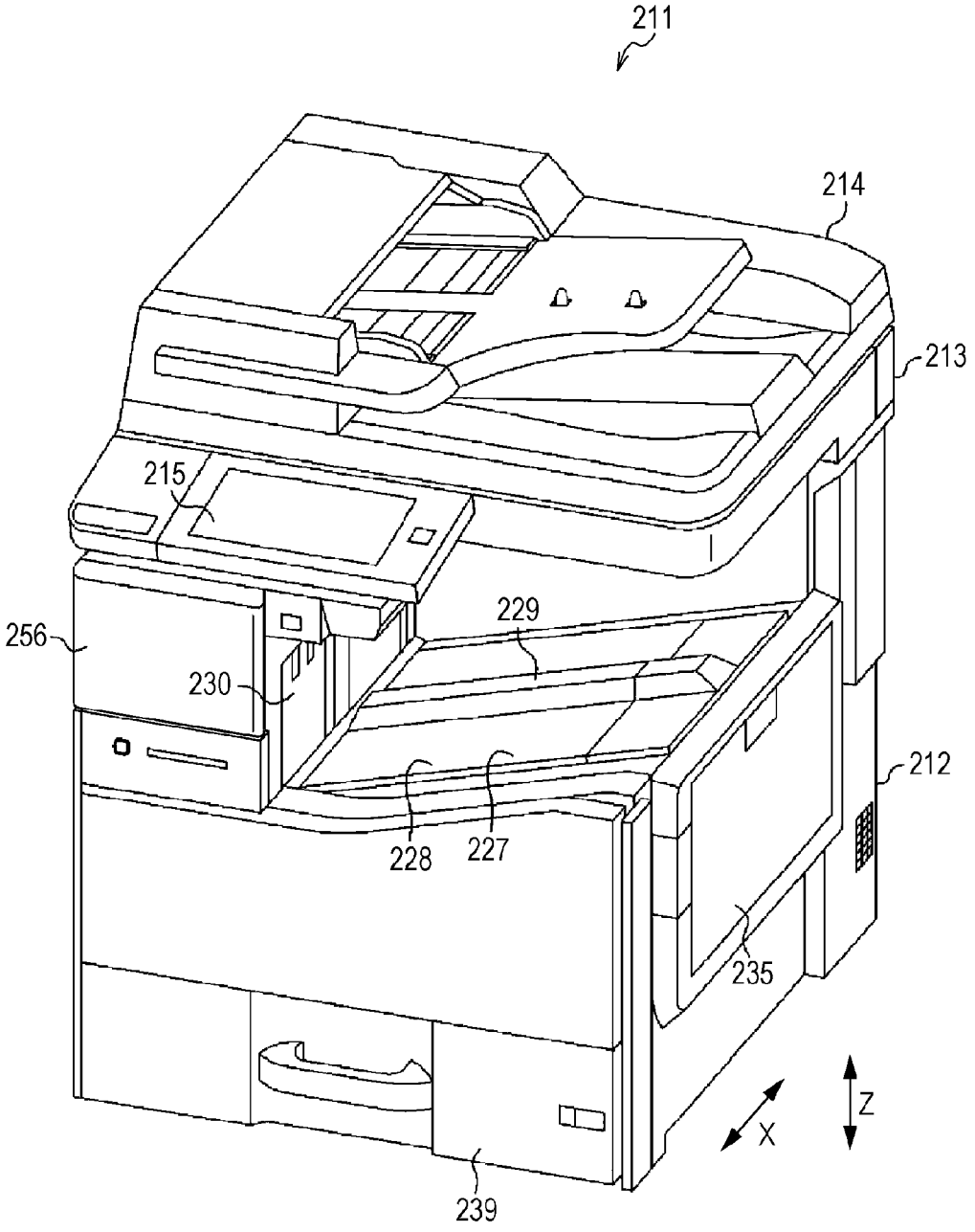
FIG. 23 is a perspective view of a recording apparatus according to Embodiment 2.

As illustrated in FIG. 23, a recording apparatus 211 has a substantially rectangular parallelepiped shape which is long in a perpendicular direction Z on the whole, and includes a printer portion 212 which is an example of an accommodation unit, a scanner portion 213 which is disposed on the printer portion 212, and an automatic paper supplying device 214 which is disposed on the scanner portion 213. Next to the scanner portion 213 on the printer portion 212, an operating portion 215 for performing various operations of the recording apparatus 211 is provided.

Figure 24:
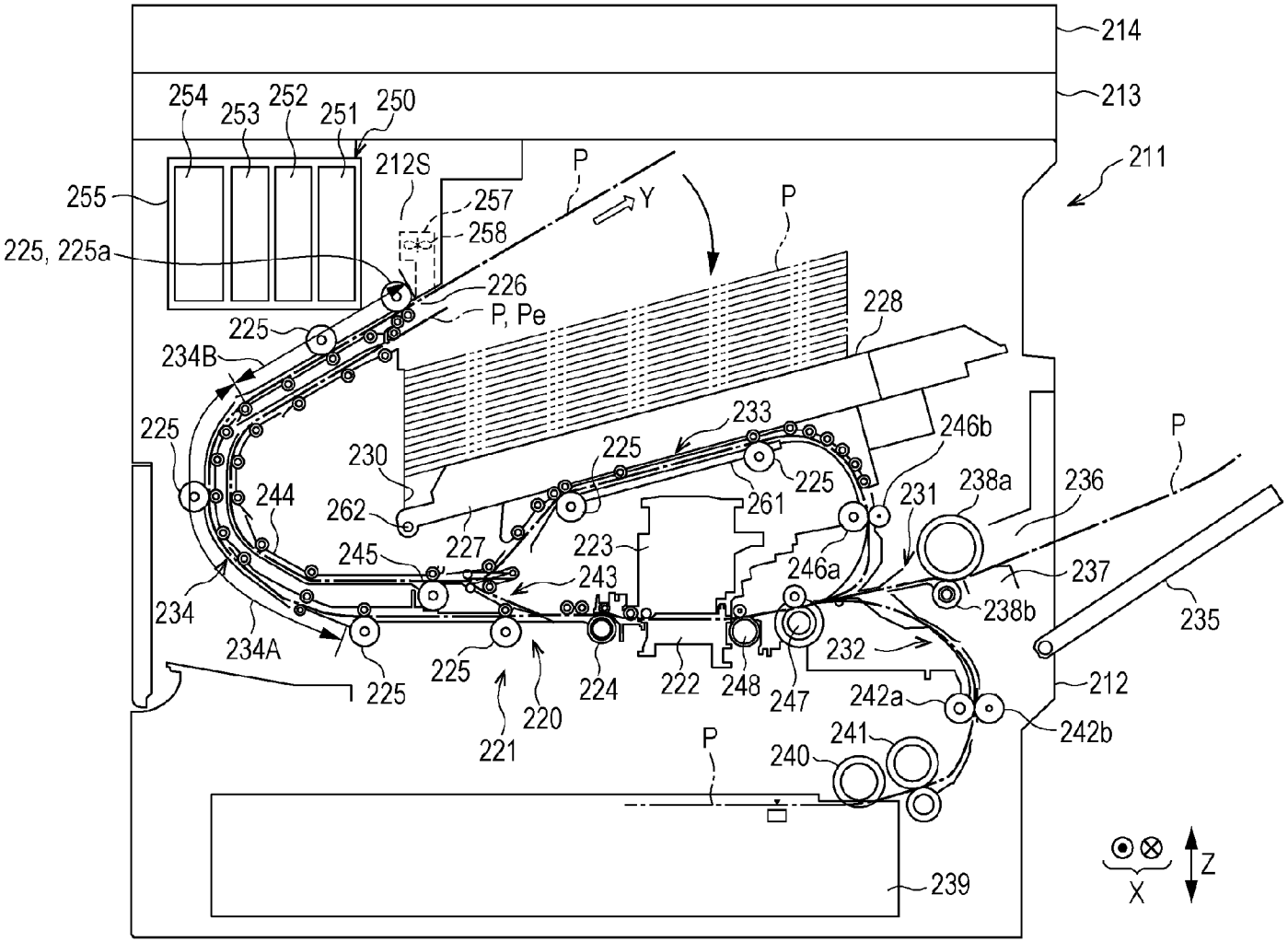
FIG. 24 is a schematic view of a structure of the recording apparatus.

As illustrated in FIG. 24, inside the printer portion 212, a medium transporting path 220 which is an example of the transporting path that transports a paper sheet P which is an example of the medium, and a transporting portion 221 which is configured of a plurality of rollers (roller pairs) and transports the paper sheet P along the medium transporting path 220, are provided. In addition, inside the printer portion 212, a supporting stand 222 which supports the paper sheet P from a lower side of a perpendicular direction Z, and a line type recording portion 223 which is provided with the recording head 48 across the width direction of the medium and in which the recording head 48 which prints (records) an image on the paper sheet P supported by the supporting stand 222 is a fixed type, are accommodated.

The printer portion 212 transports the paper sheet P above the supporting stand 222 and along the medium transporting path 220 by considering a direction which is perpendicular to the paper surface as a width direction X of the paper sheet P, and a direction which intersects the width direction X as the transporting direction, in FIG. 24. The recording portion 223 is provided with a line head in a lower portion thereof as the liquid ejecting head which crosses substantially the entire region in the width direction X which intersects the transporting direction of the paper sheet P, and can eject the ink at the same time. The recording portion 223 prints the image by ejecting the ink from the upper side of the perpendicular direction Z and adhering the ink to the paper sheet P transported above the supporting stand 222.

The printed paper sheet P is transported to the medium transporting path 220 from the recording portion 223 by a paper discharging roller pair 224 or another plurality of transporting roller pairs 225, and is discharged from a medium discharging port 226 which is an example of the discharging portion provided in the end portion on the downstream side of the medium transporting path 220. The paper sheet P which is discharged from the medium discharging port 226 drops down and is mounted on a mounting stand (medium receiving tray) 227 which is an example of the supporting portion (upper member) disposed on the upper side of the recording portion 223 in the perpendicular direction Z, in a stacked state illustrated by a two-dot chain line in FIG. 24. In other words, the mounting stand 227 sequentially receives and supports the paper sheet P on which printing is done and which is discharged from the medium discharging port 226 and drops down.

As illustrated in FIGS. 23 and 24, the mounting stand 227 has a substantially rectangular shape, and is inclined so that a height thereof increases towards the discharging direction Y of the paper sheet P. An upper surface of the mounting stand 227 is an inclined mounting surface 228, and the paper sheet P is mounted on the mounting surface 228. At the substantial center of the paper sheet P in the width direction X on the mounting surface 228, a convex portion 229 which extends in the discharging direction Y is formed.

Then, the paper sheet P which is mounted on the mounting surface 228 slides down in a direction opposite to the discharging direction Y along the inclination of the mounting surface 228, and as illustrated by the two-dot chain line in FIG. 24, the end portion on a side opposite to the discharging direction Y side is positioned by abutting against a vertical side wall 230 which is provided on the lower side of the medium discharging port 226 in the printer portion 212. In addition, the discharging direction Y of the paper sheet P is inclined in a larger manner than the mounting surface 228 with respect to a horizontal surface.

As illustrated in FIG. 24, in the embodiment, the medium transporting path 220 includes a medium discharging path 234 which transports the paper sheet P from the recording portion 223 to the medium discharging port 226, and the medium supplying path which supplies the paper sheet P to the recording portion 223. The medium supplying path is configured of a first medium supplying path 231, a second medium supplying path 232, and a third medium supplying path 233 which is an example of the reversing path.

The medium discharging path 234 includes a bending path 234A in which the paper sheet P which is printed on by the recording portion 223 is bent by considering the recording surface of the paper sheet P printed on by the recording portion 223 as the inner side, and a straight line path 234B through which the paper sheet P is transported in one direction toward the medium discharging port 226 from the bending path 234A, while the paper sheet P printed on by the recording portion 223 is transported to the medium discharging port 226.

Then, as the paper sheet P is transported through the bending path 234A and the straight line path 234B, the medium discharging path 234 functions as a bending and reversing path which reverses the paper sheet P from a state where the recording surface of the paper sheet P faces the upper side in the perpendicular direction to a state where the recording surface faces the lower side. Therefore, as the paper sheet P passes along the medium discharging path 234 which functions as the bending and reversing path, the recording surface is in a state where the recording surface confronts the mounting surface 228 of the mounting stand 227, and the paper sheet P is discharged onto the mounting stand 227 which is positioned above the recording portion 223 from the medium discharging port 226.

In addition, in the medium discharging path 234 which is provided in the medium transporting path 220, the transporting direction of the paper sheet P which is transported through the straight line path 234B is one direction of the straight line path 234B, and in the embodiment, the one direction is an upwardly inclined direction which ascends toward the medium discharging port 226. Therefore, the inclined direction (one direction) of the straight line path 234B is the discharging direction Y of the paper sheet P discharged from the medium discharging port 226.

In the first medium supplying path 231, the paper sheet P inserted from an insertion port 236 which is exposed by opening a cover 235 provided on one side surface of the printer portion 212, is transported to the recording portion 223. In other words, the paper sheet P inserted to the insertion port 236 is transported toward the recording portion 223 as a first driving roller 238*a* is rotationally driven, after the paper sheet P is pressed to the first driving roller 238*a* by a hopper 237, is transported as the first driving roller 238*a* is rotationally driven, and is nipped between the first driving roller 238*a* and a first driven roller 238*b*.

In the second medium supplying path 232, the paper sheet P, which is mounted to be stackable in a paper sheet cassette 239 provided to be insertable into a bottom portion which is the lower side of the printer portion 212, is transported to the recording portion 223. In other words, the paper sheet P which is mounted in a stacked state in the paper sheet cassette 239 is nipped between a second driving roller 242*a* and a second driven roller 242*b*, and is transported toward the recording portion 223 as the second driving roller 242*a* is rotationally driven, after the uppermost paper sheet P is sent out by a pick-up roller 240 and the paper sheets P are separated one by one by a separating roller pair 241.

In the third medium supplying path 233, when printing on both surfaces is performed, in which printing on a sheet surface (paper surface) on both sides with respect to the paper sheet P is performed, the paper sheet P on which printing on one sheet surface side is done by the recording portion 223 is transported to the recording portion 223 again. In other words, further on the downstream side of the paper sheet P in the transporting direction than the recording portion 223, a branch transporting path 244 which is branched from the medium discharging path 234 by an operation of a branching mechanism 243 provided in the middle of the medium discharging path 234 is provided. In the branch transporting path 244, a branch transporting path roller pair 245 which can rotationally move both in a normal direction and in a reverse direction is provided on the downstream side of the branching mechanism 243.

The paper sheet P on which one side sheet surface is printed is first transported to the branch transporting path 244 toward the mounting stand 227 side from the recording portion 223 side when printing on both surfaces is performed by the branch transporting path roller pair 245 which rotates in a normal direction. At this time, when a part Pe on the tip end side of the paper sheet P, which is transported to the branch transporting path 244, in the transporting direction, jumps out from the medium discharging port 226, the position of jumping out is set not to be in contact with the paper sheet P mounted in a stacked state in the mounting stand 227.

After this, the paper sheet P transported to the branch transporting path 244 is transported in reverse to the recording portion 223 side from the mounting stand 227 side through the branch transporting path 244 by the branch transporting path roller pair 245 which rotates in a reverse direction. At this time, the reverse-transported paper sheet P is transported to the third medium supplying path 233, and is transported toward the recording portion 223 by the plurality of transporting roller pairs 225. As the paper sheet P is transported to the third medium supplying path 233, the paper sheet P is reversed so that the sheet surface on which printing is not performed opposes the recording portion 223, is nipped between a third driving roller 246*a* and a third driven roller 246*b*, and is transported toward the recording portion 223 as the third driving roller 246*a* is rotationally driven.

The tip end of the paper sheet P transported toward the recording portion 223 through each medium supplying path butts against an aligned roller pair 247 which stops rotational movement after the paper sheet P is transported to the aligned roller pair 247 which is placed on the upstream side of the recording portion 223 in the transporting direction. The inclination of the paper sheet P with respect to the transporting direction is corrected (skew-removing) as the paper sheet P butts against the aligned roller pair 247. Then, after this, as the aligned roller pair 247 is rotationally driven, the paper sheet P in which inclination is corrected is in an aligned state and is transported to the recording portion 223 side.

The paper sheet P transported to the recording portion 223 side by the aligned roller pair 247 is transported while opposing the recording portion 223, by a paper feeding roller pair 248 which is placed on the upstream side of the paper sheet P in the transporting direction with respect to the recording portion 223, or the paper discharging roller pair 224 and the transporting roller pairs 225 which are placed on the downstream side in the transporting direction. On the transported paper sheet P, the ink is ejected from the opposing recording portion 223, and printing is performed.

As illustrated in FIG. 24, inside the printer portion 212, a liquid storing portion 250 which stores the ink supplied to the recording portion 223 is provided. In other words, in the liquid storing portion 250, the stored ink is supplied to the recording portion 223 via the ink supplying path which is not illustrated and which is configured of a tube or the like, the recording portion 223 ejects the supplied ink, and the image or the like is printed on the paper sheet P. In the embodiment, the liquid storing portion 250 is disposed further on the upper side of the perpendicular direction Z than the paper sheet P mounted on the mounting stand 227. In addition, the liquid storing portion 250 is disposed to cover at least a part of the medium discharging path 234 when viewed from the upper side in the perpendicular direction Z.

In other words, the upper side of the medium discharging path 234 which is the bending and reversing path has a shape inclined in one direction by the straight line path 234B continuously from the bending path 234A. For this reason, inside the printer portion 212, a space 212S is formed on the upper side between the part on the upper side of the bending path 234A to the medium discharging port 226 of the straight line path 234B which has an inclined shape.

In the embodiment, the space 212S is formed inside the printer portion 212 to cover the medium discharging path 234 when viewed from the upper side, in the width direction X. In the space 212S, the liquid storing portion 250 is disposed to cover at least a part of the medium discharging path 234 when viewed from the upper side. In addition, in the embodiment, the liquid storing portion 250 is disposed to cover the entire medium discharging path 234 when viewed from the upper side in the width direction X.

In addition, in the space 212S, a transporting roller pair 225*a*, which is positioned on the most downstream side of the paper sheet P in the transporting direction in the medium discharging path 234 among the plurality of transporting roller pairs 225 which functions as the discharging roller provided in the medium discharging path 234, is provided at a position overlapped with the liquid storing portion 250 when viewed from the horizontal direction.

Furthermore, in the space 212S, an air blowing portion 257, which is positioned inside the space excluding the space occupied by the liquid storing portion 250, that is, further on the downstream side of the paper sheet P in the discharging direction Y than the medium discharging port 226, and which blows the air in a direction in which the paper sheet P discharged from the medium discharging port 226 is pressed to the mounting surface 228 side, is provided. The air blowing portion 257 is configured to have a rotary fan 258, and is provided at a position overlapped with the liquid storing portion 250 when viewed from the horizontal direction.

In addition, in the embodiment, one air blowing portion 257 is provided in the width direction X of the paper sheet P so that an air outlet opposes both end portions of the paper sheet P in the width direction X around the convex portion 229 of the mounting surface 228. The air outlets may be provided consecutively in the width direction X of the paper sheet P while one air blowing portion 257 is provided.

The liquid storing portion 250 is configured to include ink cartridges 251, 252, 253, and 254 as liquid storing bodies which respectively store plural types (here, four colors) of ink, and to include a frame body 255 which has each of the ink cartridges 251, 252, 253, and 254 mounted thereon. Each of the ink cartridges 251, 252, 253, and 254 has a substantially rectangular parallelepiped shape in a longitudinal direction, and is mounted to be insertable and extractable by considering the longitudinal direction as an inserting and extracting direction, with respect to the frame body 255 of which one surface has an opened-box shape, via the opening.

In the embodiment, the inserting and extracting direction of each of the ink cartridges 251, 252, 253, and 254 is considered as a direction along the width direction X. For this reason, in the printer portion 212, an opening portion which is not illustrated and in which the opening of the frame body 255 is exposed when viewed from the width direction X is formed, and a storing portion cover 256 (refer to FIG. 23) which can open and close the opening portion is provided. For example, a user of the recording apparatus 211 can open the storing portion cover 256 (refer to FIG. 23), expose the opening portion which is not illustrated, and insert or extract each of the ink cartridges 251, 252, 253, and 254 from the frame body 255 along the width direction X, via the exposed opening portion.

In addition, in the embodiment, when each of the ink cartridges 251, 252, 253, and 254 is in a state of being mounted on the frame body 255, a short direction thereof is considered as the perpendicular direction Z, a longitudinal direction thereof is considered as the width direction X, and a thickness direction thereof is considered as the horizontal direction along the discharging direction Y. Each of the ink cartridges 251, 252, 253, and 254 has the same length in the short direction (perpendicular direction Z) as each other, and is mounted on the frame body 255 in a state of being aligned in the thickness direction.

In addition, the ink cartridge 254 among the ink cartridges 251, 252, 253, and 254 is considered as an ink cartridge which stores the ink of a color (for example, black color) having the highest ejection frequency from the recording portion 223, and is disposed at a position which is the most separated to the side opposite to the mounting stand 227 side with respect to the medium discharging port 226. The ink cartridge 254 is thicker than other ink cartridges 251, 252, and 253, and can store a larger amount of ink than a storing amount of ink of other ink cartridges 251, 252, and 253.

As illustrated in FIG. 24, between the recording portion 223 and the mounting stand 227 at a part of the printer portion, a reversing path forming member 261, which has a rectangular shape that forms a part of the third medium supplying path 233 which is a reversing path that reverses the paper sheet P at the mounting stand 227, is disposed. In other words, the third medium supplying path 233 is formed on a lower surface of the mounting stand 227 and an upper surface of the reversing path forming member 261. The reversing path forming member 261 is inclined so that a height thereof increases towards the discharging direction Y.

Figure 25:
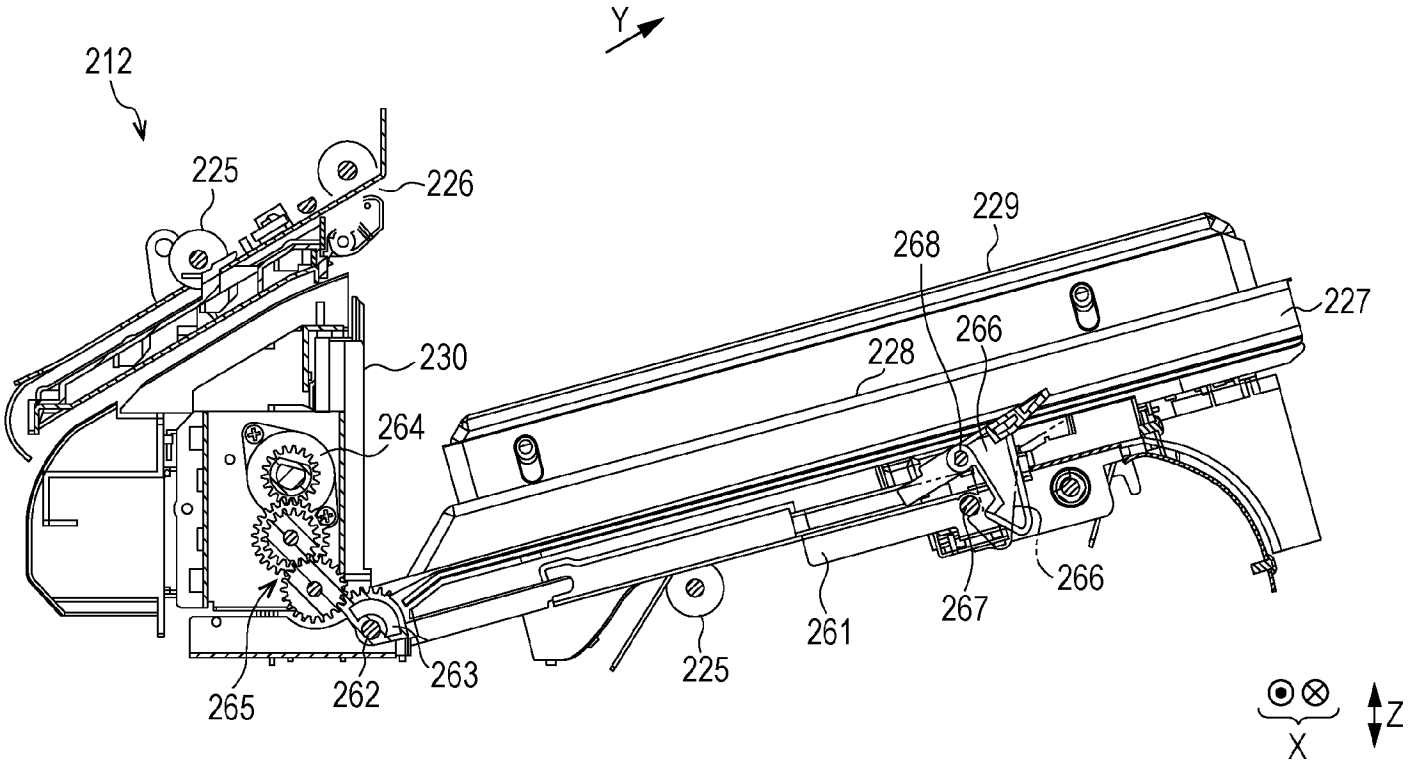
FIG. 25 is a side cross-sectional view of a mounting stand and the vicinity thereof in the recording apparatus.

As illustrated in FIG. 25, axes 262 are provided on the lower side of the vertical side wall 230 in the printer portion 212 to be a pair in the width direction X, and this pair of axes 262 extends in the width direction X. A sector gear 263 having a sector shape is provided in one end portion in the width direction X in the end portion on the upstream side of the mounting stand 227 in the discharging direction Y, and a bearing portion which is not illustrated is provided in the other end portion. The sector gear 263 is linked to be rotatable as one body with one axis 262, and the bearing portion is supported to be rotatable by the other axis 262. Therefore, the mounting stand 227 is rotatable around the pair of axes 262.

Figure 26:
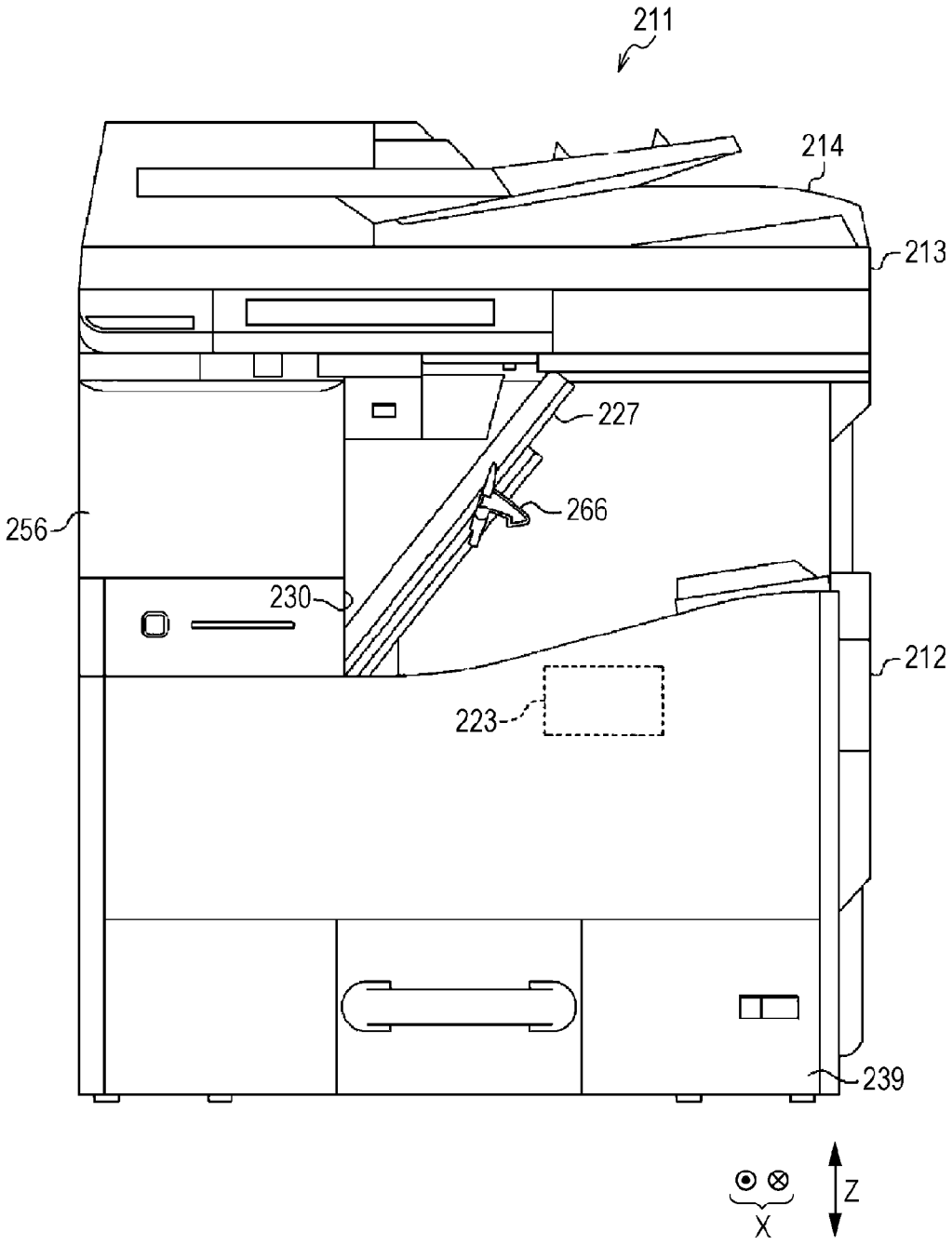
FIG. 26 is a front view illustrating a state when the mounting stand is at an opening position in the recording apparatus.

In other words, the mounting stand 227 is provided to be able to be opened and closed with respect to the printer portion 212, and can rotationally move (opening/closing movement) between a closed position (position in a closed state illustrated in FIG. 23) at which the printer portion 212 is closed and an opened position (position in an opened state illustrated in FIG. 26) at which the printer portion 212 is opened. Therefore, an opening/closing fulcrum (center of rotational movement) when the mounting stand 227 performs the opening/closing operation (rotational movement) is positioned on the upstream side (left side in FIG. 25) of the discharging direction Y.

In this case, a part of the mounting stand 227 which is overlapped with the recording portion 223 when viewed from above is configured to be able to be opened until the overlapped part becomes smaller compared to a closed state. In other words, the part of the mounting stand 227 which is overlapped with the recording portion 223 when viewed from above is configured to be smaller at the opened position than at the closed position.

As illustrated in FIG. 25, on the side opposite to the mounting stand 227 in the vertical side wall 230 inside the printer portion 212, a torque hinge 264 is provided. The torque hinge 264 is engaged with the sector gear 263 via a gear mechanism 265 which has a plurality of gears. In this case, the torque hinge 264 always biases the mounting stand 227 in a direction in which the mounting stand 227 rotationally moves toward the opened position side, via the gear mechanism 265.

A biasing force of the torque hinge 264 is not so large as to automatically rotationally move the mounting stand 227 to the opened position from the closed position, and is set to be large enough as to assist the user when the user rotationally moves the mounting stand 227 to the opened position from the closed position. Furthermore, the biasing force of the torque hinge 264 is set to be slightly larger than a necessary force for holding the mounting stand 227, which is rotationally moved to the opened position, at the opened position.

Figure 27:
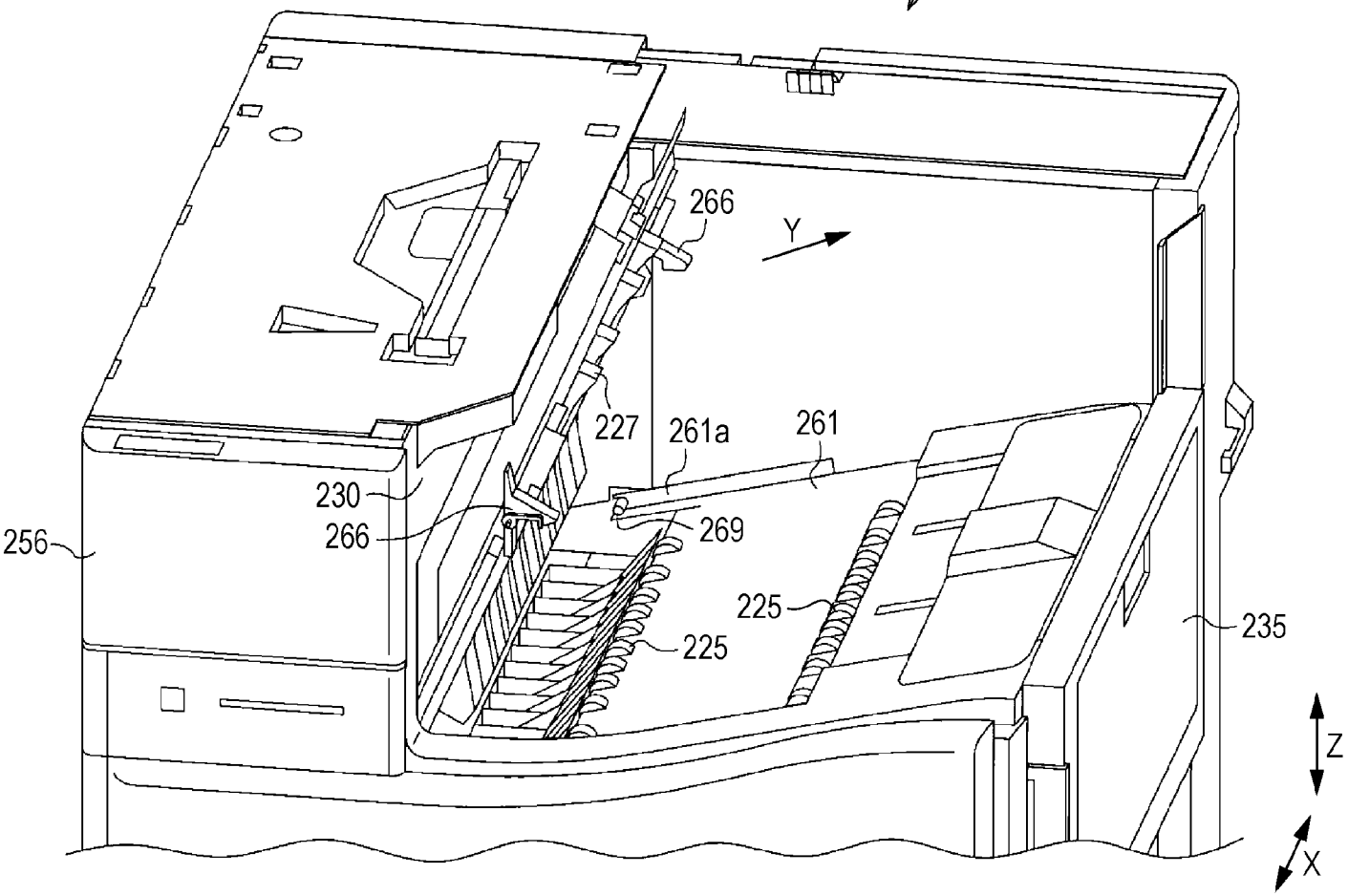
FIG. 27 is an enlarged perspective view of main portions illustrating a state when the mounting stand is opened by detaching a scanner portion, an automatic paper supplying device, and an operating portion from a printer portion in the recording apparatus.

As illustrated in FIGS. 25 and 27, in both side portions in the width direction X in the mounting stand 227, rotationally movable locking levers 266 are respectively provided around an axial member 268 which extends in the width direction X. Two locking levers 266 are respectively lockable with respect to pins 267 which are provided in both side portions in the width direction X in the reversing path forming member 261.

In other words, when the mounting stand 227 is at the closed position, each locking lever 266 can rotationally move between a locked position (position illustrated by a two-dot chain line in FIG. 25) at which each pin 267 is locked and a released position (position illustrated by a solid line in FIG. 25) at which the locked state with each pin 267 is released. Each locking lever 266 is always biased in a direction (clockwise direction in FIG. 25) in which the locking lever 266 rotationally moves around the axial member 268 toward the locked position, by a biasing member which is not illustrated. Therefore, when the mounting stand 227 is at the closed position, as each locking lever 266 is locked with each pin 267, the mounting stand 227 is held at the closed position against the biasing force of the torque hinge 264.

Figure 28:
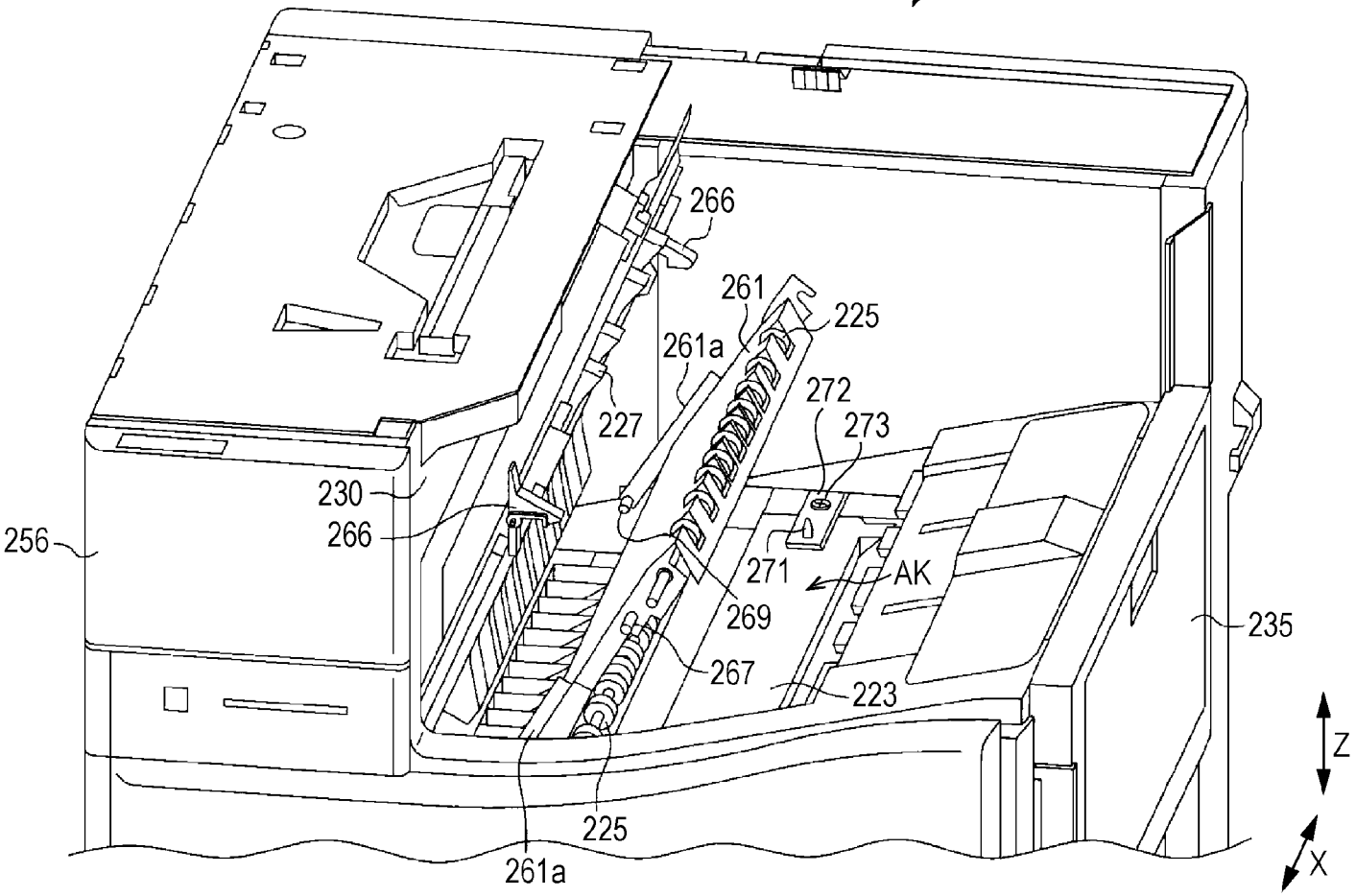
FIG. 28 is an enlarged perspective view of the main portions illustrating a state when the reversing path forming member is opened in FIG. 27.

As illustrated in FIGS. 27 and 28, the reversing path forming member 261 includes each supporting arm 261*a* in both end portions in the width direction X in the end portion of the vertical side wall 230. At a position which corresponds to a tip end portion of the two supporting arms 261*a* inside the printer portion 212, each axis portion 269 is provided to be protruded along the width direction X. In the tip end portion, each supporting arm 261*a* is supported to freely rotationally move and to be freely attached and detached with respect to each axis portion 269. Therefore, the reversing path forming member 261 can rotationally move around each axis portion 269.

In other words, the reversing path forming member 261 is provided to be able to be opened and closed with respect to the printer portion 212, and can rotationally move (opening/closing movement) between a closed position (position in a closed state illustrated in FIG. 27) at which the printer portion 212 is closed and an opened position (position in an opened state illustrated in FIG. 28) at which the printer portion 212 is opened. Therefore, an opening/closing fulcrum (center of rotational movement) when the reversing path forming member 261 performs the opening/closing operation (rotational movement) is positioned on the upstream side (left side in FIG. 27) of the discharging direction Y.

In this case, a part of the reversing path forming member 261 which is overlapped with the recording portion 223 when viewed from above is configured to be able to be opened until the overlapped part becomes smaller compared to a closed state. In other words, the part of the reversing path forming member 261 which is overlapped with the recording portion 223 when viewed from above is configured to be smaller at the opened position than at the closed position.

In general, the reversing path forming member 261 is screwed by a screw which is not illustrated with respect to the printer portion 212 when the reversing path forming member 261 is at the closed position. Therefore, after the screw is taken away and the screwed state with respect to the printer portion 212 is released, by taking away each supporting arm 261*a* from each axis portion 269, the reversing path forming member 261 can be detached from the printer portion 212. In other words, the reversing path forming member 261 is configured to be attachable to and detachable from the printer portion 212.

Next, an operation when the maintenance operation of the recording portion 223 is performed in the recording apparatus 211 will be described.

When an exchanging operation which is one example of the maintenance operation of the recording portion 223 is performed, in a case where the recording portion 223 is detached from the recording apparatus 211, first, as illustrated in FIG. 27, the scanner portion 213, the automatic paper supplying device 214, and the operating portion 215 are detached from the printer portion 212. Next, in a state where the locking lever 266 is rotationally moved to the released position, the mounting stand 227 performs an opening operation, and is rotationally moved to the opened position. At this time, the mounting stand 227 is held at the opened position by the biasing force of the torque hinge 264.

Next, after taking away the screw which fixes the reversing path forming member 261 to the printer portion 212 and releasing the screwed state of the reversing path forming member 261 with respect to the printer portion 212, as illustrated in FIG. 28, the reversing path forming member 261 performs the opening operation and rotationally moves to the opened position. Accordingly, the recording portion 223 is exposed. In other words, as the mounting stand 227 makes the reversing path forming member 261 perform the opening operation in the opened state, an access path AK, which makes it possible to access the recording portion 223 from above from the outside of the printer portion 212, is formed.

Figure 29:
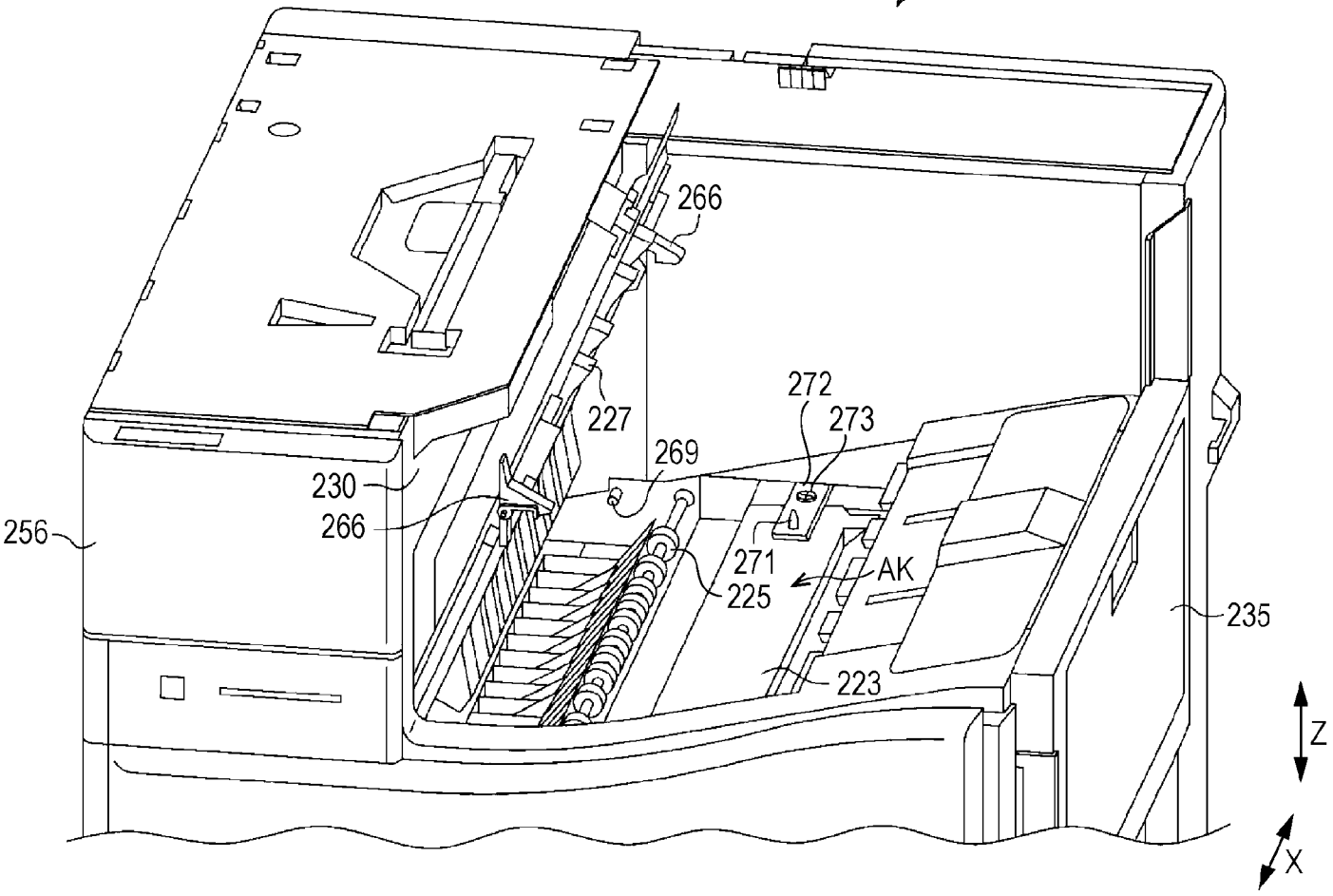
FIG. 29 is an enlarged perspective view of the main portions illustrating a state when the reverse path forming member is detached in FIG. 28.
Figure 30:
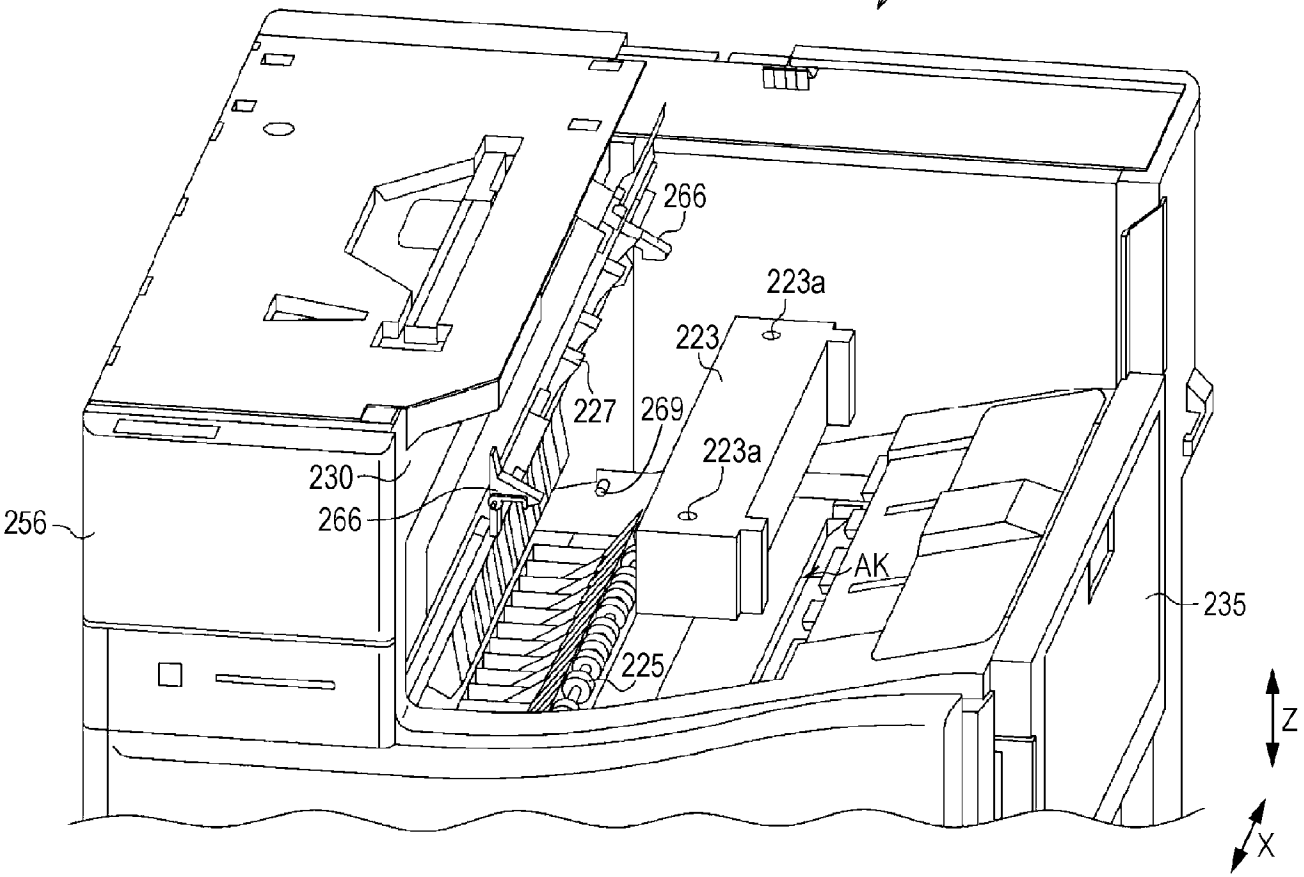
FIG. 30 is an enlarged perspective view of the main portions illustrating a state when a recording portion is taken out in FIG. 29.

Next, by taking away each supporting arm 261*a* of the reversing path forming member 261 from each axis portion 269, as illustrated in FIG. 29, the reversing path forming member 261 is detached from the printer portion 212. Next, as illustrated in FIG. 30, the recording portion 223 is accessed from above through the access path AK, and the recording portion 223 is taken out from the printer portion 212. Then, the taken-out recording portion 223 is exchanged with a new recording portion, and the exchanged recording portion is assembled at a predetermined position inside the printer portion 212.

Next, after attaching the reversing path forming member 261 to the original position in the printer portion 212, the mounting stand 227 rotationally moves to the closed position. After this, by assembling the scanner portion 213, the automatic paper supplying device 214, and the operating portion 215 to the printer portion 212, the operation is completed.

Next, a structure in which the recording portion 223 is attached to the printer portion 212 will be described.

Figure 31:
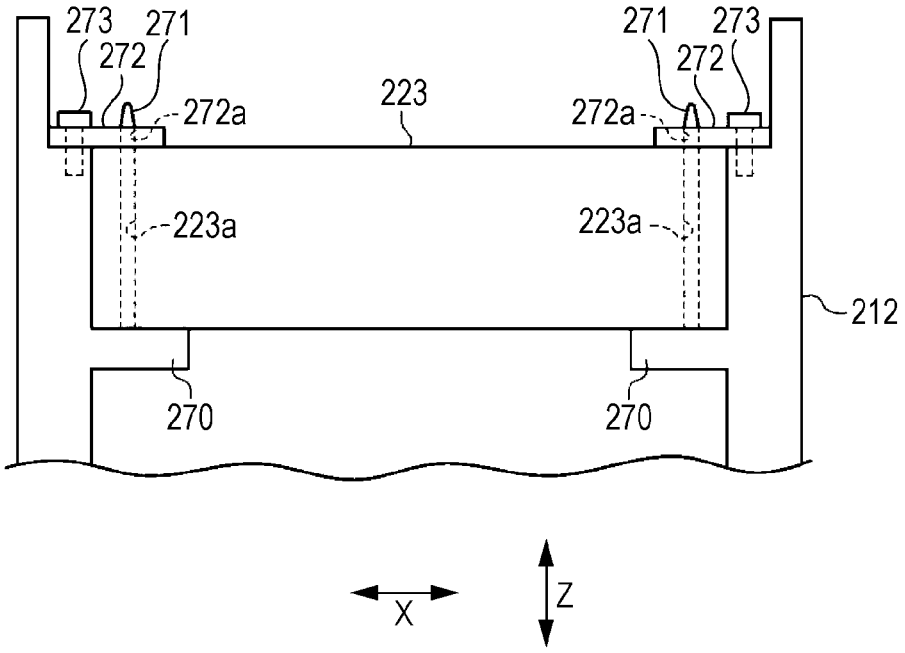
FIG. 31 is a schematic side view of the main portions illustrating a state when the recording portion is attached to the printer portion.

As illustrated in FIG. 31, plate-shaped supporting pieces 270 which support the recording portion 223 are respectively provided to be protruded on both side surfaces in the width direction X inside the printer portion 212, and pins 271 are provided to stand on each supporting piece 270. In both end portions in the width direction X in the recording portion 223, insertion holes 223*a* which can be inserted through the pins 271 are formed to penetrate in the perpendicular direction Z. As each pin 271 is inserted through each insertion hole 223*a*, the recording portion 223 is supported by each supporting piece 270. At this time, the recording portion 223 is positioned in the horizontal direction which is perpendicular to the perpendicular direction Z by each pin 271.

Both end portions in the width direction X on the upper surface of the recording portion 223 are supported to be respectively pressed from the upper side by a fastening plate 272 which has a substantially rectangular shape. In other words, in each fastening plate 272, tip end portions of the pins 271 are inserted through holes 272*a* provided in one end portion, and the other end portions are fixed to the printer portion 212 by a screw 273. At this time, the recording portion 223 is positioned in the perpendicular direction Z by each fastening plate 272.

Figure 32:
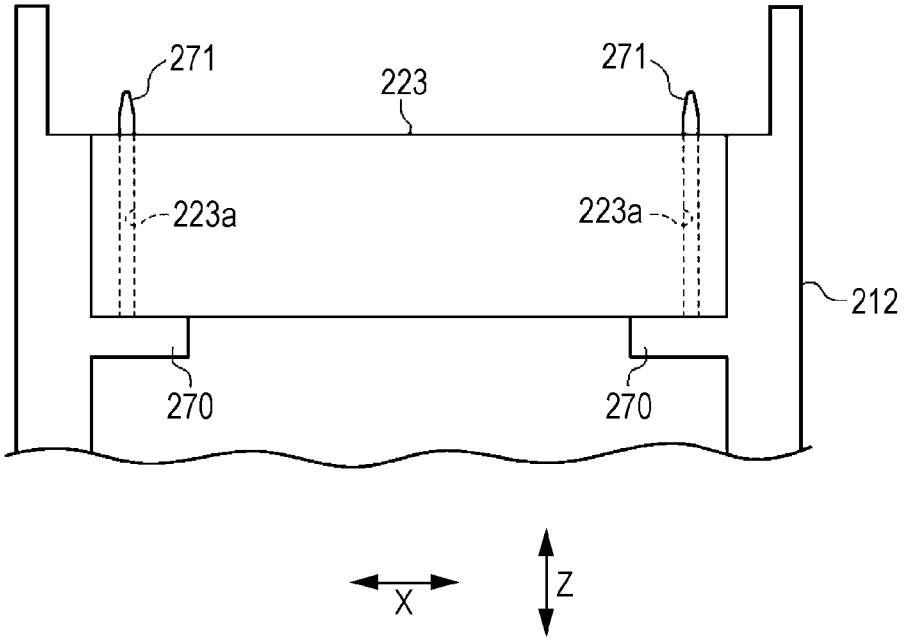
FIG. 32 is a schematic side view of the main portions illustrating a state when a fastening plate is detached from the printer portion in FIG. 31.
Figure 33:
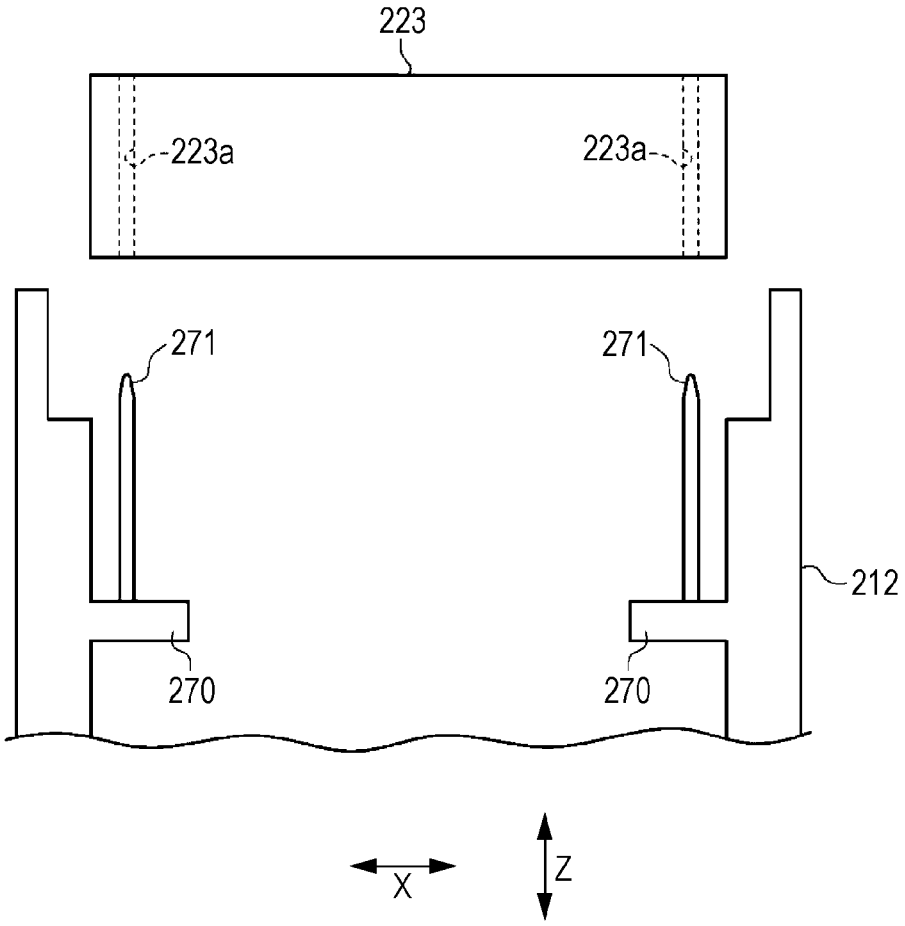
FIG. 33 is a schematic side view of the main portions illustrating a state when the recording portion is detached from the printer portion in FIG. 32.

When the recording portion 223 is taken out from the printer portion 212, as illustrated in FIG. 32, first, each screw 273 is taken away, and each fastening plate 272 is detached. After this, as illustrated in FIG. 33, when the recording portion 223 is pulled up, each pin 271 is extracted from each insertion hole 223*a*, and the recording portion 223 is taken out from the printer portion 212.

Meanwhile, when the recording portion 223 is attached to the printer portion 212, as illustrated in FIG. 32, first, each pin 271 is inserted through each insertion hole 223*a*, and the recording portion 223 is supported by each supporting piece 270. After this, as illustrated in FIG. 31, in a state where each pin 271 is inserted through the through holes 272*a* of each fastening plate 272, by fixing each fastening plate 272 by each screw 273 to the printer portion 212, the recording portion 223 is attached to the printer portion 212.

Above, it is possible to obtain the following effects according to the described embodiments.

(1) In the recording apparatus 211, as the reversing path forming member 261 performs the opening operation in a state where the mounting stand 227 which is a part of the printer portion 212 is opened, the access path AK which makes it possible to access the recording portion 223 from above from the outside of the printer portion 212 is formed. For this reason, it is possible to access the recording portion 223 from above through the access path AK from the outside of the printer portion 212. In addition, when the mounting stand 227 and the reversing path forming member 261 perform the opening operation, the recording portion 223 does not move. Therefore, while ensuring the positional accuracy of the recording portion 223, it is possible to easily perform the maintenance operation, such as the exchanging operation of the recording portion 223.

(2) In the recording apparatus 211, the mounting stand 227 and the reversing path forming member 261 are configured to be able to be opened until the overlapped parts with the recording portion 223 when viewed from above respectively become smaller than the overlapped parts in the closed state. By opening the mounting stand 227 and the reversing path forming member 261, it is possible to easily access the recording portion 223 from above.

(3) In the recording apparatus 211, the mounting stand 227 is inclined so that the height thereof increases towards the discharging direction Y in which the paper sheet P is discharged, and the opening/closing fulcrum when the mounting stand 227 performs the opening/closing operation is positioned on the upstream side in the discharging direction Y. For this reason, it is possible to easily open the mounting stand 227.

(4) In the recording apparatus 211, the reversing path forming member 261 is inclined so that the height thereof increases towards the discharging direction Y in which the paper sheet P is discharged, and the opening/closing fulcrum when the reversing path forming member 261 performs the opening/closing operation is positioned on the upstream side in the discharging direction Y. For this reason, it is possible to easily open the reversing path forming member 261.

(5) In the recording apparatus 211, the reversing path forming member 261 is configured to be attachable to and detachable from the printer portion 212. For this reason, by detaching the reversing path forming member 261 from the printer portion 212, it is possible to more easily access the recording portion 223 from above.

Modification Example

In addition, the above-described embodiments may be modified as follows.

In the recording apparatus 211, the mounting stand 227 may be configured to be attachable to and detachable from the printer portion 212. In this case, by detaching the mounting stand 227 from the printer portion 212, it is possible to more easily access the recording portion 223 from above.

In the recording apparatus 211, the reversing path forming member 261 is not necessarily configured to be attachable to and detachable from the printer portion 212.

In the recording apparatus 211, the reversing path forming member 261 is not necessarily inclined so that the height thereof increases towards the discharging direction Y in which the paper sheet P is discharged. In addition, when the reversing path forming member 261 performs the opening/closing operation, the opening/closing fulcrum is not necessarily positioned on the upstream side in the discharging direction Y.

In the recording apparatus 211, the mounting stand 227 is not necessarily inclined so that the height thereof increases towards the discharging direction Y in which the paper sheet P is discharged. In addition, when the mounting stand 227 performs the opening/closing operation, the opening/closing fulcrum is not necessarily positioned on the upstream side in the discharging direction Y.

In the recording apparatus 211, the mounting stand 227 and the reversing path forming member 261 are not necessarily configured to be able to be opened until the overlapped parts with the recording portion 223 when viewed from above respectively become smaller than the overlapped parts in the closed state.

In the recording apparatus 211, without detaching the scanner portion 213, the automatic paper supplying device 214, and the operating portion 215 from the printer portion 212, the exchanging operation (maintenance operation) of the recording portion 223 may be performed.

In the recording apparatus 211, in a state where the reversing path forming member 261 is held at the opened position, the exchanging operation of the recording portion 223 may be performed. In this case, it is preferable to provide a hook or the like for holding the reversing path forming member 261 at the opened position.

In the recording apparatus 211, in a state where the mounting stand 227 is detached from the printer portion 212, the exchanging operation of the recording portion 223 may be performed.

In the recording apparatus 211, the third medium supplying path 233 may be omitted. In other words, in the recording apparatus 211, the reversing path forming member 261 may be omitted. In this case, only as the mounting stand 227 performs the opening operation, the access path AK which makes it possible to access the recording portion 223 from above from the outside of the printer portion 212 is formed.

In the recording apparatus 211, the first transporting path (transporting path from the aligned roller pair 247 to the branching mechanism 243) which extends on the upstream side and the downstream side of the recording portion 223 is provided, the second transporting path is configured of the branch transporting path 244, the third transporting path is configured of the third medium supplying path 233, and the fourth transporting path is configured of the medium discharging path 234.

The medium may not only be the paper sheet P, but may also be a piece of cloth or a plastic film.

In the above-described embodiment, the recording apparatus 211 may be a fluid ejecting apparatus which performs recording by ejecting or discharging fluid (including liquid, a liquid body in which particles of a functional material are dispersed or mixed, a flowing body, such as gel, or a solid which can flow as the fluid and can be ejected) other than the ink. For example, the recording apparatus 211 may be a liquid body ejecting apparatus which performs recording by ejecting the liquid body including materials, such as an electrode material or a coloring material (pixel material), which are used in manufacturing a liquid crystal display, an electroluminescence (EL) display, and a surface light-emitting display, by dispersing or dissolving. In addition, the recording apparatus 211 may be a flowing body ejecting apparatus which ejects the flowing body, such as gel (for example, physical gel). It is possible to employ the invention in any one type of the fluid ejecting apparatus among these. In addition, in the present specification, the term "fluid" does not include a fluid which is only made of gas, and examples of the fluid include the liquid (including an inorganic solvent, an organic solvent, a solution, a liquid resin, or a liquid metal (molten metal)), the liquid body, or the flowing body.

The entire disclosure of Japanese Patent Application No.: 2014-065429, filed Mar. 27, 2014 and 2014-238088, filed Nov. 25, 2014 are expressly incorporated by reference herein.

What is claimed is:

1. A recording apparatus, comprising:

a first transporting path which is a transporting path that transports a medium, passes along a recording portion that performs recording on the medium, and extends to an upstream side and a downstream side of the recording portion;

a second transporting path which is a transporting path that is connected to the first transporting path, and switches back and transports the medium in a direction reverse to a feeding direction after the medium which passes along the recording portion is fed;

a third transporting path which is a transporting path that is connected to the second transporting path, makes the medium transported in the reverse direction detour an upper side of the recording portion, reverses the medium, and makes the medium merge at a position on the upstream side of the recording portion in the first transporting path; and an exposing member which exposes at least a portion of the third transporting path, wherein the third transporting path is provided with a roller pair which nips and transports the medium, and wherein, as one roller which constitutes the roller pair is provided in the exposing member and the exposing member is opened, the one roller which constitutes the roller pair is separated from the other roller wherein the one roller provided in the exposing member is a serrated roller which has a plurality of teeth on an outer circumference, and the serrated roller is in contact with the one surface on which recording is already performed on the medium.

2. The recording apparatus according to claim 1, wherein the one roller provided in the exposing member is a roller which can rotate in a driven manner, and wherein the other roller is a roller which is rotationally driven by a driving source.

3. The recording apparatus according to claim 1, wherein the portion of the third transporting path is inclined so as to rise toward the downstream side in a transporting direction of the medium.

4. A recording apparatus, comprising:

a first transporting path which is a transporting path that transports a medium, passes along a recording portion that performs recording on the medium, and extends to an upstream side and a downstream side of the recording portion;

a second transporting path which is a transporting path that is connected to the first transporting path, and switches back and transports the medium in a direction reverse to a feeding direction after the medium which passes along the recording portion is fed;

a third transporting path which is a transporting path that is connected to the second transporting path, makes the medium transported in the reverse direction detour an upper side of the recording portion, reverses the medium, and makes the medium merge at a position on the upstream side of the recording portion in the first transporting path;

an exposing member which exposes at least a portion of the third transporting path a medium receiving tray which is positioned above the transporting path and receives the discharged medium; and a fourth transporting path which is a transporting path that is connected to the first transporting path and transports the medium that passes along the recording portion together with the medium receiving tray, wherein the medium receiving tray is configured to be integrated with the exposing member, and can be opened and closed.

5. The recording apparatus according to claim 4, wherein the medium receiving tray has an upwardly inclined posture toward a side far from an outlet of the fourth transporting path in a closed state, and wherein the medium receiving tray can be opened and closed by rotational movement, and a rotational movement fulcrum thereof is positioned on an upstream side of the medium receiving tray during the rotational movement.

6. The recording apparatus according to claim 4, further comprising:

an accommodation unit which accommodates the recording portion; and a discharging portion which discharges the medium on which recording is performed by the recording portion, wherein the recording portion includes a fixed type head which performs recording on the transported medium, wherein the exposing member receives and supports the medium which is discharged by the discharging member, and is provided to be able to be opened and closed with respect to the accommodation unit, and wherein, as the exposing member performs an opening operation, an access path which makes it possible to access the recording portion from above is formed.

7. The recording apparatus according to claim 6, wherein the exposing member is configured to be able to be opened until a part which is overlapped with the recording portion when viewed from above becomes smaller than that when the upper member is in a closed state.

8. The recording apparatus according to claim 4, further comprising:

an accommodation unit which accommodates the recording portion;

the discharging portion which discharges the medium on which recording is performed by the recording portion; and a reversing path forming member which is disposed between the exposing member and the recording portion and forms a reversing path that reverses the medium, wherein the recording portion includes the fixed type head which performs recording on the transported medium, wherein the exposing member receives and supports the medium which is discharged by the discharging member, and is provided to be able to be opened and closed with respect to the accommodation unit, wherein, as the reversing path forming member performs an opening operation in a state where the upper member is opened, an access path which makes it possible to access the recording portion from above is formed.

9. The recording apparatus according to claim 8, wherein the reversing path forming member is inclined so that a height thereof increases towards a discharging direction in which the medium is discharged, and an opening/closing fulcrum when the reversing path forming member performs the opening/closing operation is positioned on an upstream side of the discharging direction.

10. The recording apparatus according to claim 8, wherein the reversing path forming member is configured to be attachable to and detachable from the accommodation unit.

11. The recording apparatus according to claim 10, wherein the exposing member is inclined so that the height thereof increases towards the discharging direction in which the medium is discharged, and an opening/closing fulcrum when the exposing member performs the opening/closing operation is positioned on the upstream side of the discharging direction.

12. The recording apparatus according to claim 11, wherein the upper member is configured to be attachable to and detachable from the accommodation unit.

13. A recording apparatus, comprising:

a first transporting path which is a transporting path that transports a medium, passes along a recording portion that performs recording on the medium, and extends to an upstream side and a downstream side of the recording portion;

a second transporting path which is a transporting path that is connected to the first transporting path, and switches back and transports the medium in a direction reverse to a feeding direction after the medium which passes along the recording portion is fed;

a third transporting path which is a transporting path that is connected to the second transporting path, makes the medium transported in the reverse direction detour an upper side of the recording portion, reverses the medium, and makes the medium merge at a position on the upstream side of the recording portion in the first transporting path; and an exposing member which exposes at least a portion of the third transporting path, wherein, when the exposing member is opened, it is possible to access the recording portion from above.

14. The recording apparatus according to claim 13, wherein the exposing member is configured to be able to be opened until a part which is overlapped with the recording portion when viewed from above becomes smaller than that when the upper member is in a closed state.

* * * * *